US008061159B2

(12) United States Patent
Mogil et al.

(10) Patent No.: US 8,061,159 B2
(45) Date of Patent: Nov. 22, 2011

(54) CONTAINER WITH COVER AND CLOSURE REINFORCEMENT

(75) Inventors: Melvin S. Mogil, North York (CA); Mark J. Greenstein, Montreal (CA); Michael Ramundi, Brampton (CA); Andrius S. Birutis, Winfield, IL (US); David W. Sagan, Des Plaines, IL (US); Evan R. Olander, Cicero, IL (US); Richard C. Stephens, Chicago, IL (US)

(73) Assignee: California Innovations Inc., Toronto (CA)

( * ) Notice: Subject to any disclaimer, the term of this patent is extended or adjusted under 35 U.S.C. 154(b) by 1347 days.

(21) Appl. No.: 11/096,273

(22) Filed: Apr. 1, 2005

(65) Prior Publication Data

US 2005/0205459 A1 Sep. 22, 2005

Related U.S. Application Data

(63) Continuation-in-part of application No. 10/674,795, filed on Oct. 1, 2003, now Pat. No. 7,162,890.

(51) Int. Cl.
*F25D 3/08* (2006.01)

(52) U.S. Cl. ..... 62/457.7; 62/457.1

(58) Field of Classification Search ..... 62/457.7, 62/457.1, 457.4, 371

See application file for complete search history.

(56) References Cited

U.S. PATENT DOCUMENTS 1,922,485 A 8/1933 McKee
1,949,677 A 3/1934 Crawford
1,964,795 A 7/1934 Frary
1,973,880 A 9/1934 Moody
2,289,254 A 7/1942 Eagles
2,555,788 A 6/1951 Donaldson
2,645,332 A 7/1953 Martin et al.
2,827,096 A 3/1958 Hinson
2,954,891 A 10/1960 Imber
3,001,566 A 9/1961 Lipsitz
3,238,002 A 3/1966 O'Connell et al.
3,255,607 A 6/1966 Bair et al.
3,572,054 A 3/1971 Curcio
3,791,547 A 2/1974 Branscum
3,998,072 A 12/1976 Shaw
4,050,264 A 9/1977 Tanaka
4,085,785 A 4/1978 Hoot
4,210,186 A 7/1980 Belenson
4,260,004 A 4/1981 Domke
4,286,440 A 9/1981 Taylor
4,468,933 A 9/1984 Christopher
4,499,998 A 2/1985 Carlson
4,506,769 A 3/1985 Franco et al.
4,541,540 A 9/1985 Gretz et al.
4,551,988 A 11/1985 Petrantoni
4,598,746 A 7/1986 Rabinowitz (Continued)

OTHER PUBLICATIONS

Canadian Office Action dated Jul. 7, 2010, Canadian Patent Application No. 2,509,503.

(Continued)

*Primary Examiner* — Melvin Jones

(57) ABSTRACT

A soft sided insulated container assembly includes a first portion having an insulated, soft sided external wall structure, and an internal, substantially rigid molded plastic receptacle mounted therein. It has a cover structure that includes a reinforcement member for engaging a land region of the molded receptacle, thereby tending to yield an interface tending to have a sealing relationship. The container may also include a thermal storage element, and the container may have an accommodation for receiving the thermal storage element.

20 Claims, 55 Drawing Sheets

U.S. PATENT DOCUMENTS

| | | | |
|---|---|---|---|
| 4,610,286 | A | 9/1986 | Cyr |
| 4,629,040 | A | 12/1986 | Jones |
| 4,655,052 | A | 4/1987 | Garcia |
| 4,673,117 | A | 6/1987 | Calton |
| 4,819,793 | A | 4/1989 | Willard et al. |
| 4,877,128 | A | 10/1989 | Strickland |
| 4,889,257 | A | 12/1989 | Steffes |
| 4,916,923 | A | 4/1990 | Adams et al. |
| D312,530 | S | 12/1990 | Gallen et al. |
| 5,095,718 | A | 3/1992 | Ormond et al. |
| 5,403,095 | A | 4/1995 | Melk |
| 5,421,172 | A | 6/1995 | Jones |
| D366,812 | S | 2/1996 | Collins et al. |
| 5,501,338 | A | 3/1996 | Preston |
| D369,065 | S | 4/1996 | Sylvestre et al. |
| D370,123 | S | 5/1996 | Klinger |
| 5,524,761 | A | 6/1996 | Wayman |
| 5,568,735 | A | 10/1996 | Newkirk et al. |
| 5,671,611 | A | 9/1997 | Quigley |
| 6,105,844 | A | 8/2000 | Walters et al. |
| 6,234,677 | B1 * | 5/2001 | Mogil ..... 383/110 |
| 6,238,091 | B1 | 5/2001 | Mogil |
| 6,296,165 | B1 | 10/2001 | Mears |
| 6,474,095 | B1 | 11/2002 | Chan |

OTHER PUBLICATIONS

Canadian Office Action dated Jul. 15, 2010, Canadian Patent Application No. 2,444,155.

* cited by examiner

CONTAINER WITH COVER AND CLOSURE REINFORCEMENT

This application is a continuation in part of Ser. No. 10/674,795 filed Oct. 1, 2003 now U.S. Pat. No. 7,162,890.

FIELD OF THE INVENTION

This invention relates to the field of portable insulated containers.

BACKGROUND OF THE INVENTION

Soft sided insulated containers have become popular for carrying either articles that may best be served cool, such as beverages or salads, or warm, such as appetizers, hot dogs, and so on. Such containers are frequently used to carry liquids, whether hot liquids, such as soup containers, coffee or tea, or cold liquids such as beer, soft drinks, or other carbonated beverages, juices and milk. The containers are typically made in a generally cube-like or rectangular parallelpiped shape, whether of sides of equal length or not, having a base, four upstanding walls, and a top. The top is generally a lid which opens to permit articles to be placed in, or retrieved from, the container.

While soft sided containers are, in general, quite convenient, the flexible structure may not provide adequate protection for items stored within the container. For example, sandwiches or other non-durable items may become crushed or squished when the container is carried or otherwise transported. It may be desirable that other objects that may be carried in a cooler, such as, for example, egg sandwiches or cucumber sandwiches, or items of a similar nature for a picnic, be kept cool before being eaten. Alternatively, if one has warmed canapes or hors d'oeuvres, it may be desirable that those appetizers be kept warm until served. However, such items as sandwiches or pastries may tend not to be overly amenable to immersion in water, and, even if placed in a supposedly waterproof bag or plastic container may tend to become damp or clammy. Further, sandwiches or appetizers tend not to be particularly resilient, and once squashed may tend not to return to their former state.

To alleviate this problem, a rigid insert such as a plastic receptacle, which may conform to the interior walls of the soft sided container, may be used to impart structural rigidity to the soft side container. Alternatively, as proposed herein, the various wall panels of the container may be provided with relatively stiff shields, or reinforcements, that while somewhat flexible, may be less prone to being squashed than, for example, a side panel whose stiffness is more strongly dependent a relatively soft layer of insulating foam. As a result of this increased rigidity, items placed within the rigid insert may be less apt to be affected by bumps or other forces applied to the soft sided container.

Further still, in soft sided coolers heretofore, the closure of the lid has tended to depend on the closing of a zipper, often a zipper running around three sides of a rectangle, with the fourth side being hinged. The lid may rest on a foam lip or bead. When a container of this nature falls over, its resistance to the spilling of liquid through the closure may not be as effective as might be desired. It might be advantageous to have a somewhat tighter seal, such as might be made by stiffer materials in an interference fit. A soft-sided panel would not normally be sufficiently stiff to achieve such a seal. The use of a seal in this nature might also permit the elimination of the main peripheral zipper of the main closure of the container. The elimination of the need to use a zipper to obtain access to the contents of the container may itself be considered an advantage. Some users may prefer not to fiddle with zippers, and may prefer a simpler release apparatus.

Further, it may be advantageous to provide a mounting for a thermal storage device, such as an ice pack or an exothermic package, that could be carried in the container. It would be advantageous for the thermal storage element to be removable, to permit it to be re-frozen in the freezer or refrigerator, or reheated, or recharged, as the case may be. Alternatively, it may be desirable to be able to choose between a number of various positions for the thermal storage element, depending on what might be carried in the insulated container. That is, in some cases it might be desirable to have the thermal storage element below objects in the insulated, sometimes above, and sometimes in the middle. Further still, it might be advantageous to be able to remove the thermal storage element from the insulated container entirely, and to use it as a flat surface upon which to serve or eat objects taken out of the container. This role might be advantageously enhanced by forming a recess, or recesses in the thermal storage element such as might be used as drink holders, or retainers for drinks or other objects, to prevent them from sliding in the event the surface is not precisely level (as may be the case on a picnic, or in a vehicle, or from spilling if jostled slightly, in the event the vehicle is moving). Further still, it may be advantageous to permit the thermal storage element to be held in the lids of the container when the container is open, to serve either of the above mentioned roles.

SUMMARY OF THE INVENTION

In an aspect of the invention there is an insulated container having panels assembled to define a chamber. The insulated container has an opening by which to obtain access to the chamber. Portions of the are being co-operatively assembled to define a periphery of the opening. At least one of the panels includes a layer of thermal insulation and a batten. The container has a closure member that is movable to an engaged position obstructing the opening and the batten is located to reinforce the periphery.

In an additional feature of that aspect of the invention, the insulated container is a soft sided insulated container. In another feature, the batten lies outwardly of the layer of thermal insulation. In a further feature, the closure member includes a plug, and the plug is insertable into the opening. In still another feature, the plug includes a layer of thermal insulation, and the layer of thermal insulation of the plug is substantially thicker than the layer of insulation of one of the panels. In yet a further feature, the closure member has a peripherly land extending about the plug and the peripheral land has a width. The plug has a depth. The depth of the plug is greater than the width of the land. In yet another feature, the plug has a depth and the batten has a width greater than the depth of the plug. In still another feature, the width of the batten is greater than double the depth of the plug.

In another feature, the insulated container has panels having battens therein are arranged to form a reinforced periphery extending substantially entirely about the opening. In a further feature, one of the panels has a pair of the battens, the battens being foldably moveable relative to each other to permit the one panel to be folded. In another feature, the insulated container with the closure member includes a closure securement operable to retain the closure in a closed position, and the securement is not a tracked fastener.

In a further feature, the insulated container has a plurality of panels assembled to define an internal chamber, the panels including a layer of insulation and a batten contained between inner and outer membranes, and a surround member, the surround member having an access to the chamber, and the surround member including a stiffener layer extending peripherally about the opening. In yet a further feature, the stiffener layer of the surround is mounted on an arcuate profile. In another feature, the insulated container includes a lid, and the lid includes a shoulder formed to seat on the arcuate profile of the surround. In another feature, the lid has a plug insertable in the opening and the plug is elastically deformable and includes a foam portion.

In a further feature, the insulated container having a first portion and a second portion co-operable to define an enclosed, insulated space, the first portion and the second portion meeting at a closure, the closure being zipperless, and the closure being peripherally reinforced. The insulated container also comprises of a securement operable to maintain the closure in a closed condition, and releasable to permit the closure to open, the securement being zipperless. The first portion has a first closure member, the second portion has a second closure member, the first and second closure members being matingly co-operable to define the zipperless closure, the first closure member including a resilient land for engaging the second closure member, and the resilient land being stiffened by a backing member.

BRIEF DESCRIPTION OF THE DRAWINGS

These aspects and other features of the invention can be understood with the aid of the following illustrations of a number of exemplary, and non-limiting, embodiments of the principles of the invention in which:

FIG. 11*l* is a partial section of the container assembly of FIG. 11*a* showing a detail of the main closure interface.

DETAILED DESCRIPTION

Figure 1A:
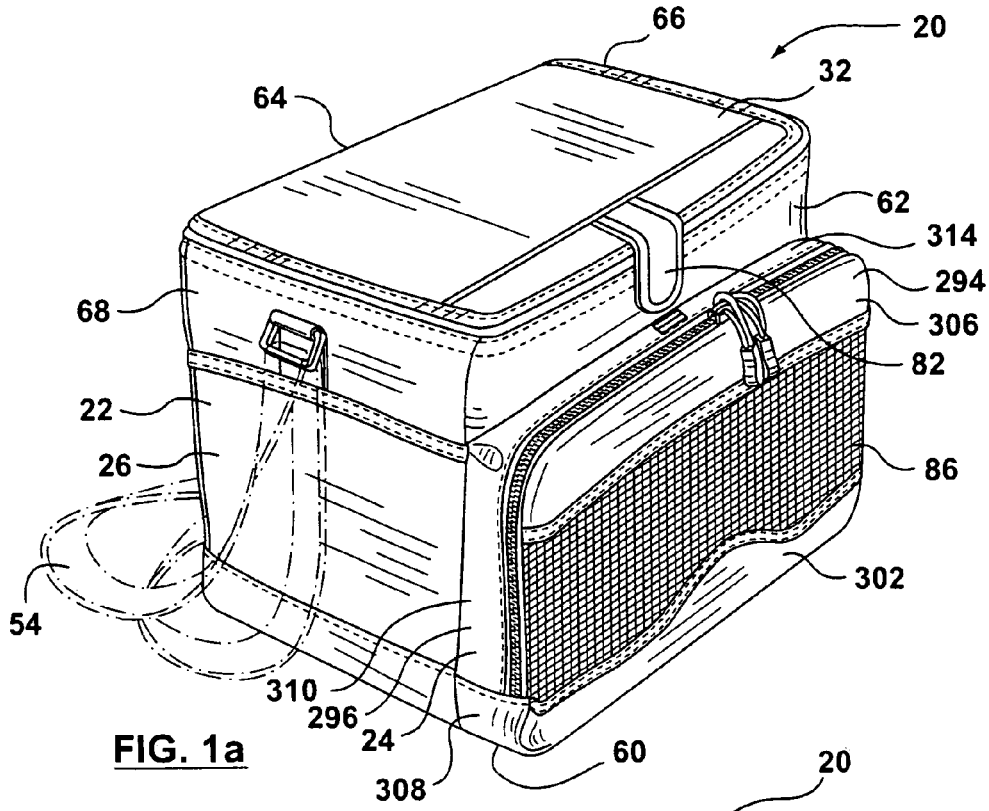
FIG. 1*a* shows an isometric view taken from in front, above, and to the left, of an embodiment of a container assembly in a closed position.

The description that follows, and the embodiments described therein, are provided way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In the description and drawings herein, reference may be made to a Cartesian co-ordinate system in which the vertical direction, or z-axis, extends in an up and down orientation from bottom to top. The x-axis extends in the shorter dimension of the container assembly, when fully expanded, running in the front-to-back direction. The y-axis extends cross-wise horizontally relative to the x-axis, running in the side-to-side direction. Unless noted otherwise, the terms "inside" and "outside", "inwardly" and "outwardly", refer to location or orientation relative to the enclosed spaces of the various portions of the container assembly, as may be.

Figure 1C:
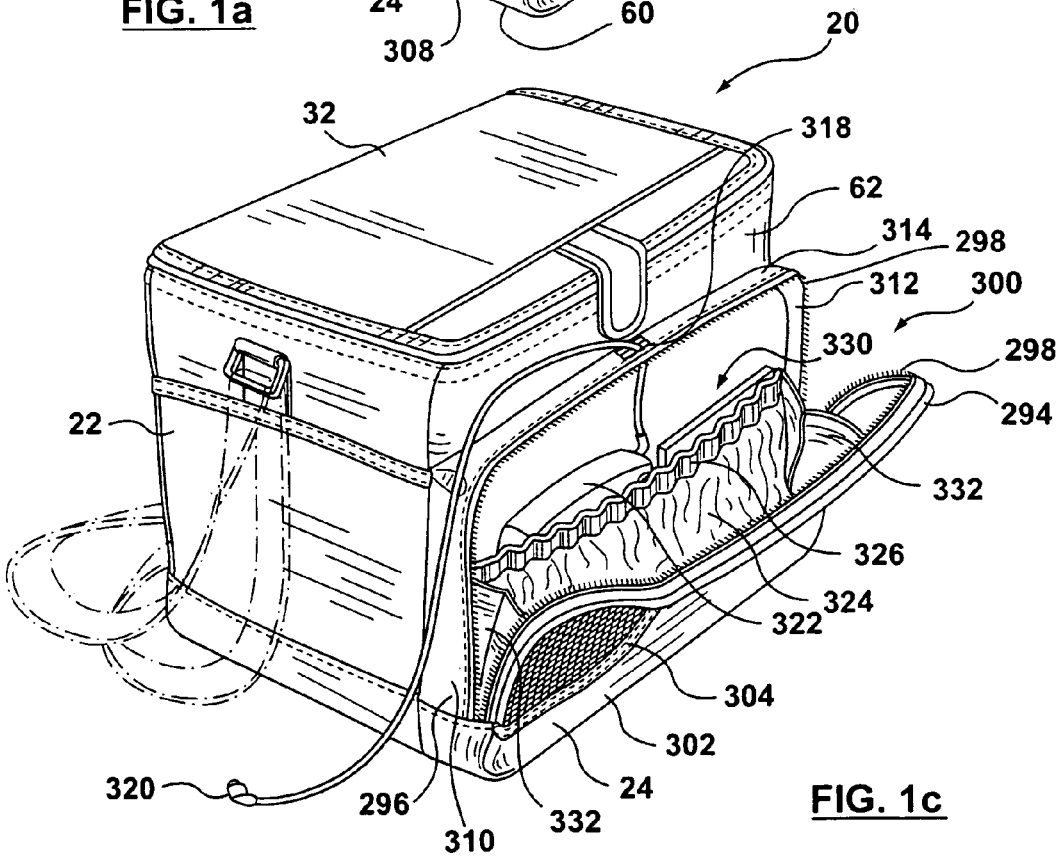
FIG. 1*c* shows the container assembly of FIG. 1*a* with an auxiliary portion thereof in an open position.
Figure 1B:
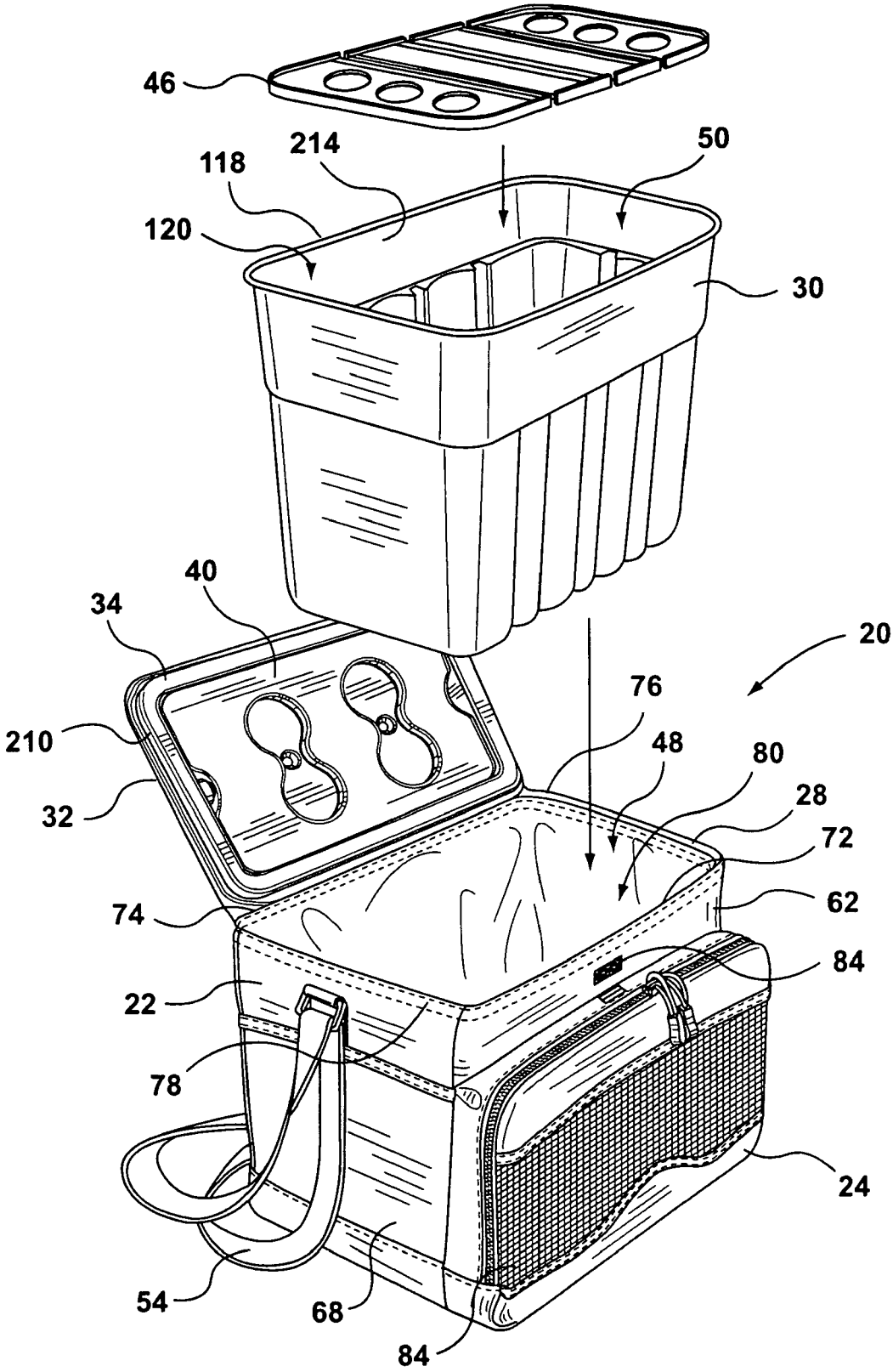
FIG. 1*b* shows the container assembly of FIG. 1*a* in an open, exploded position showing a soft-sided wall structure, a receptacle for seating in the soft-sided wall structure, and a multi-position dividing partition for seating in the receptacle.

Referring to FIGS. 1*a* and 1*b*, and by way of a general overview, a container assembly is indicated generally as 20. Container assembly 20 has a first, or main portion 22, that may include an optional auxiliary portion 24 mounted on the forward face thereof. Main portion 22 includes an outer casing 26 in the nature of a soft-sided, insulated wall structure 28, and a reinforcement member, or stiff wall structure, in the nature of a relatively rigid, resilient, molded plastic tub, indicated as receptacle 30, mounted within soft-sided insulated wall structure 28. Receptacle 30 is watertight, and is removable from within wall structure 28, and of container assembly 20 more generally, to facilitate washing thereof. When receptacle 30 is in place, container portion 22 is intended to be maintained in the shape shown in the Figures, and is not intended to be collapsible.

A second portion of container assembly 20 is indicated as a top panel, or lid 32, that has an internal structural member 34 for engagement with the upper portion of receptacle 30, thereby acting as a closure member to control access to the enclosed chamber 50 defined within receptacle 30. Internal structural member 34 has a peripherally extending seal member 210 for interferingly engaging the mouth of receptacle 30. Lid 32 as such may tend to deter the egress of materials, such as liquids, that might otherwise occur when container assembly 20 is inadvertently tipped over or jostled excessively energetically. internal structural member 34 also has a recess defined therein for receiving a removable and re-usable thermal storage member 40, such as may be employed to influence the environmental condition inside chamber 50, or alternatively, may be remove and employed as a chilled (or warmed) element upon which to rest foods, such as, for example, appetizers, or beverages. Lid 32 may also include such features as may permit lid 32 to provide a relatively stiff surface upon which to place objects, such as, for example, foods or beverages.

These assemblies of container assembly 20, are illustrated co-operatively in FIGS. 1*a* and 1*b*. They will now be described in greater detail.

First Portion 22

First insulated container portion 22 has an outer casing 26, an insert, namely receptacle 30, and a divider or partition 46. Outer casing 26 has a compartment 48 for receiving receptacle 30, and receptacle 30 has a chamber 50 which may be divided by placement of partition 46 therein. Partition 46 may be used to separate items placed within chamber 50. Items may also be retained by partition 46, as described in detail below. A closure member such as lid 32, attached to outer casing 26, may be used to enclose receptacle 30 within compartment 48. FIG. 1 a shows container assembly 20 with lid 32 in a closed position. An optional carrying means such as strap 54 may be attached to outer casing 26 to facilitate transport of container assembly 20.

Outer Casing 26

Outer casing 26 may be made of an insulative material for thermally insulating receptacle 30. The insulative material inhibits heat transfer between chamber 50 and the surroundings of container assembly 20. This may tend to help to maintain a preferred temperature of items such as food products stored within receptacle 30. For example, if items such as bottles of liquid 58, which are stored within chamber 50, have a lower temperature than the container assembly's surroundings, then the insulative material may reduce the rate of heat transfer to bottles of liquid 58, keeping the soft drink or wine at a low temperature for a longer period than if it were not placed within container assembly 20. When lid 32 is in a closed position, heat transfer may be inhibited to a greater extent.

The insulative material may additionally be soft, such as resilient foam so that the container may tend not to damage, or be damaged by, objects with which it may come into contact. If a suitable plastic or other material or stain resistant surface coating or surface treatment is used, then outer casing 26 may also be readily cleaned to remove dirt and other debris acquired through use.

Outer casing 26 may have an insulated bottom panel 60, and insulated wall panels, namely a front panel 62, a rear panel 64, and a pair of right and left hand side panels 66 and 68. In this description, the choice of front and rear, left and right, orientations is arbitrary. Each panel 60, 62, 64, 66 and 68 may be located at substantially right angles to two adjacent wall panels. For example, panel 64 is located adjacent panel 66 at one end, and adjacent panel 68 at an opposite end. The bottom panel may be attached to all four panels 62, 64, 66 and 68, along edges thereof. The combination of panels 62, 64, 66 and 68, and bottom panel 60, define compartment 48. Bottom panel 60 and panels 62, 64, 66 and 68, may be rectangular, with respective opposite panels 62 and 64, and 66 and 68, being congruent to one another. In this configuration, compartment 48 has a generally cube-like or rectangular parallelepiped shape. Panels 62, 64, 66 and 68, and bottom panel 60 may be fastened to one another by sewing, gluing or some other suitable fastening means. Alternatively, two or more panels (including the bottom panel) may be formed from a single piece of material having one or more folds therein to define the two or more panels. In one embodiment, the front, bottom and rear panels may be made from a single piece of insulated material. Lid 32 and an adjacent wall may also be formed from a single piece of material. For example, rear panel 64 and lid 32 may be formed from a single piece of material having a fold therein to define rear panel 64 and lid 32. It may be noted that lid 32 may thusly be connected to the upper margin of rear panel 64 by a flexible fabric hinge. In an alternative embodiment, outer casing 26 may have either less than four, or more than four, panels (not shown). For example, outer casing 26 may be configured to have one continuous panel defining a round wall, thereby forming a right cylinder, or some other generally rounded shape.

In one embodiment, connected panels 62, 64, 66 and 68 may each have an upper, or distal, edge 72, 74, 76 and 78, respectively, which in the case of edges 72, 76 and 78 is also a free edge, and edge 74 being a fabric hinge, the four edges co-operating to define container opening 80 through which receptacle 30 may be placed into compartment 48. Lid 32 is hingedly, or pivotally attached to rear panel edge 74. Rather than employing a zipper (or, optionally, in addition to a zipper, if a zipper is desired), internal structural member 34 engages the mouth of receptacle 30 in a relatively tight interference fit, thus effectively securing lid 32 to inhibit heat transfer to and from chamber 50. A strap, or flexible handle 82 is grasped to release the mating portions of a hook and eye fabric strip securement 84 (e.g., Velcro, t.m.) mounted to handle 82 and front panel 62 respectively, and to permit the interference fit seal of lid 32 inside receptacle 30 to be broken, and lid 32 moved pivotally about its rearward hinged edge between the closed, or sealed position, and an open, and unsealed, position.

Outer casing 26 may have shoulder strap 54 attached thereto, for example, at side panels 66 and 68. As noted above, outer casing 26 may also have an auxiliary portion or pouch 24. Pouch 24 may have a see-through mesh pocket 86, such as may be convenient for viewing the contents thereof, which may include knives, forks, spoons or other objects.

Figure 2A:
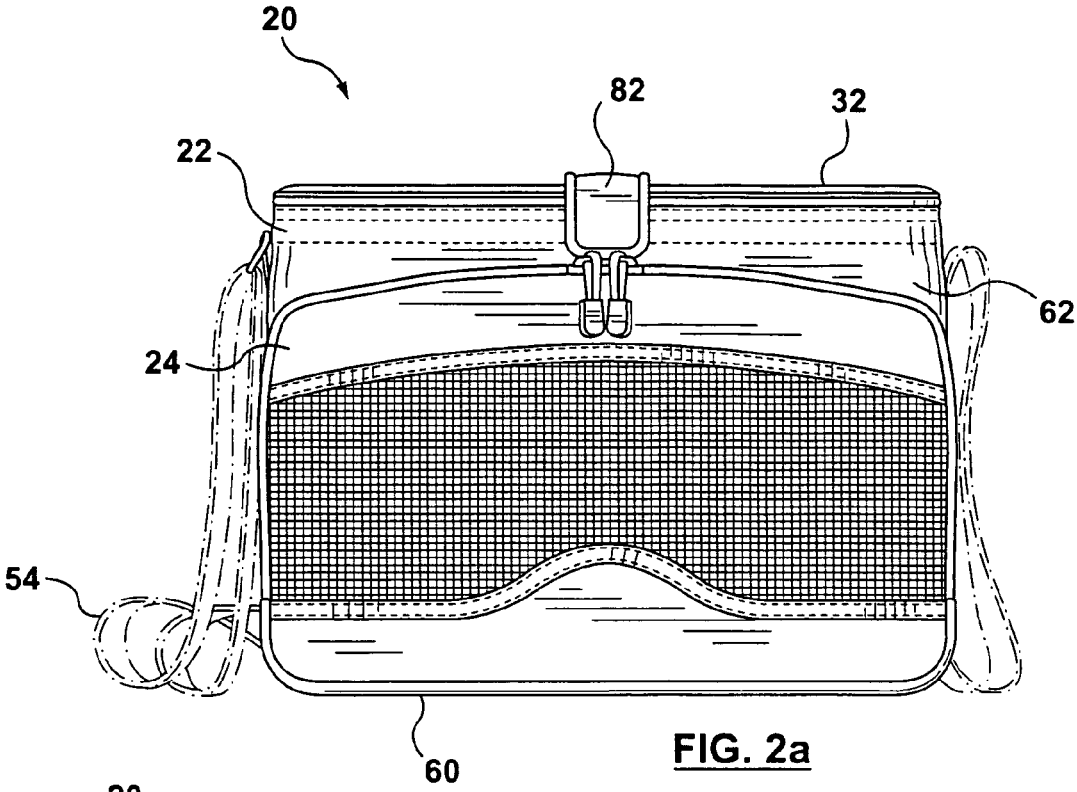
FIG. 2*a* shows a front view of the container assembly of FIG. 1*a;*
Figure 2D:
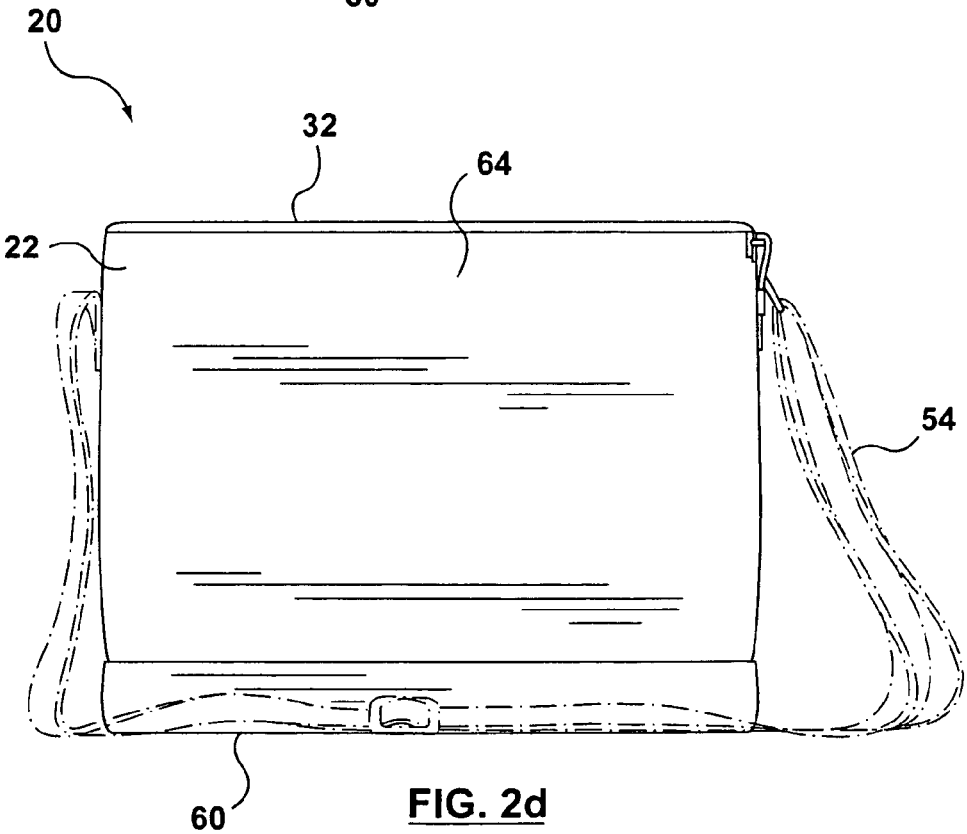
FIG. 2*d* shows a rear view of the container assembly of FIG. 1*a;*
Figure 2C:
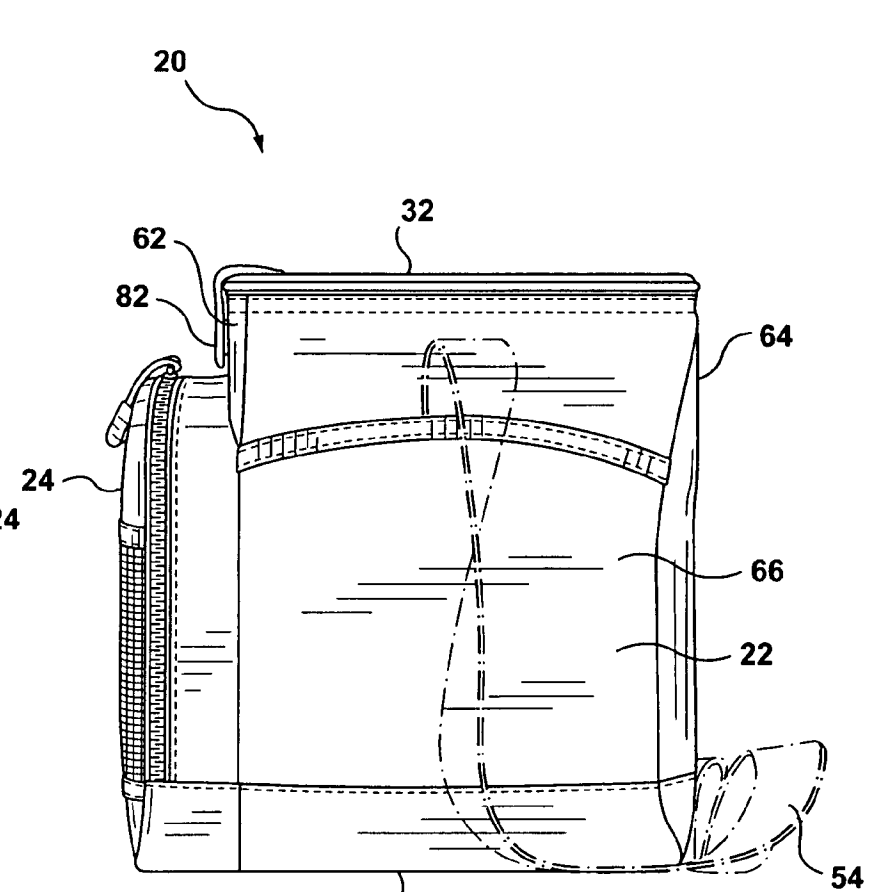
FIG. 2*c* shows a right hand side view of the container assembly of FIG. 1*a;*
Figure 2B:
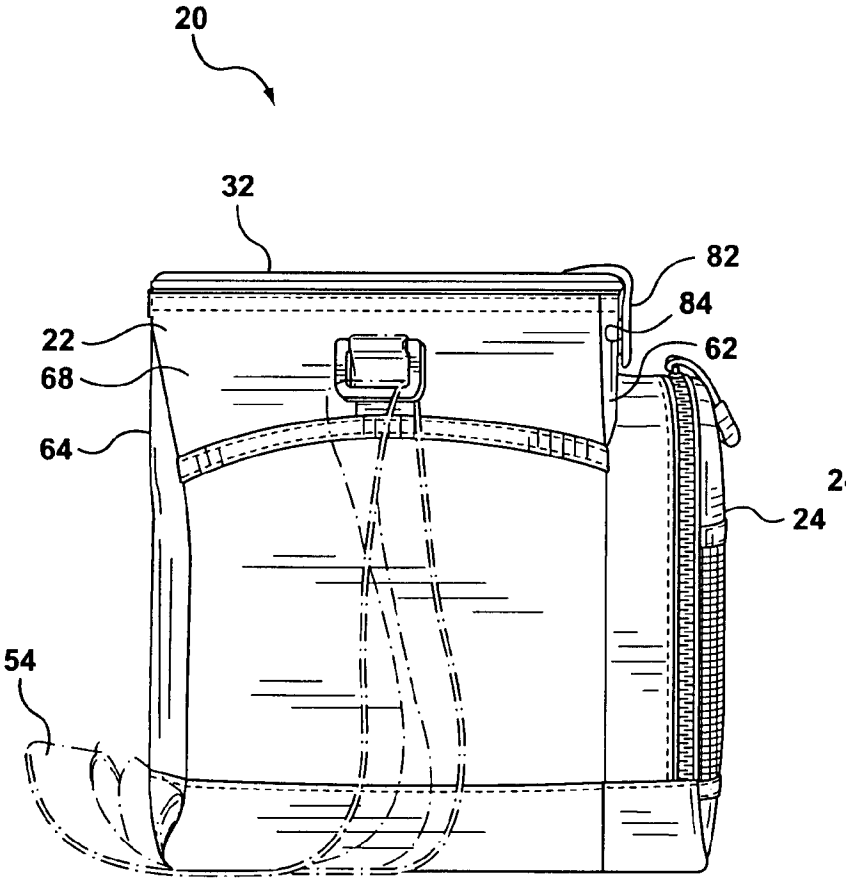
FIG. 2*b* shows a left hand side view of the container assembly of FIG. 1*a;*
Figure 2E:
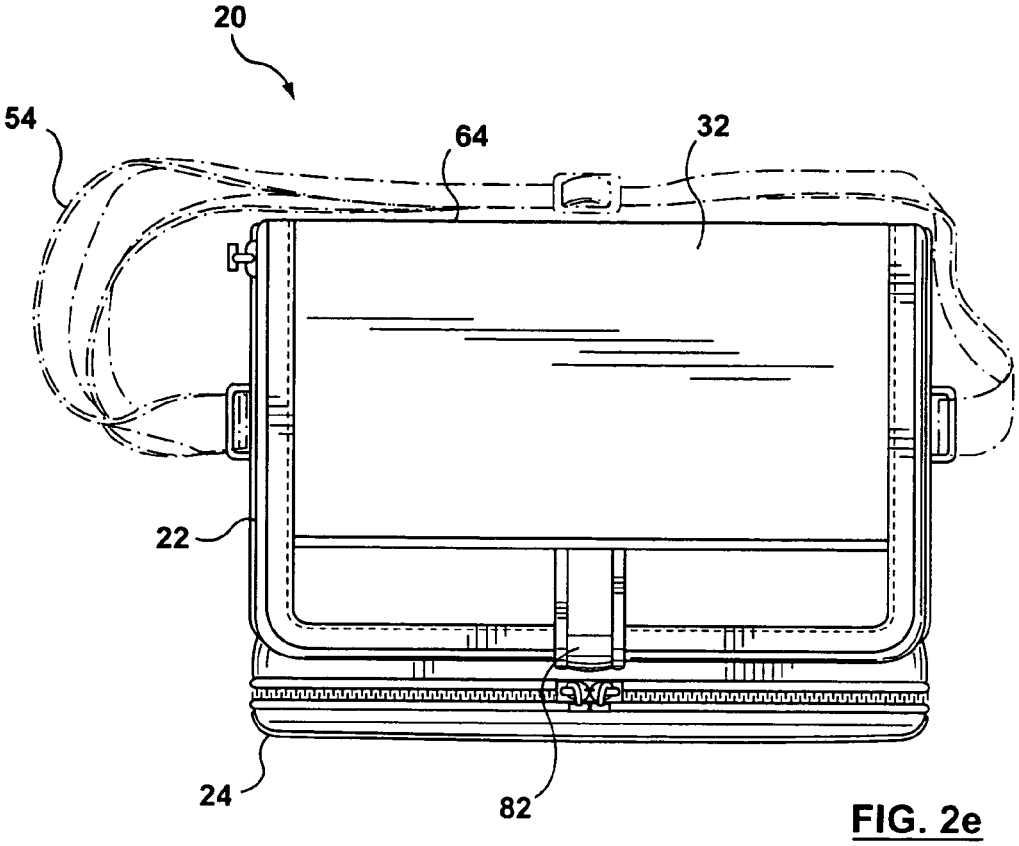
FIG. 2*e* shows a top view of the container assembly of FIG. 1*a;*
Figure 2F:
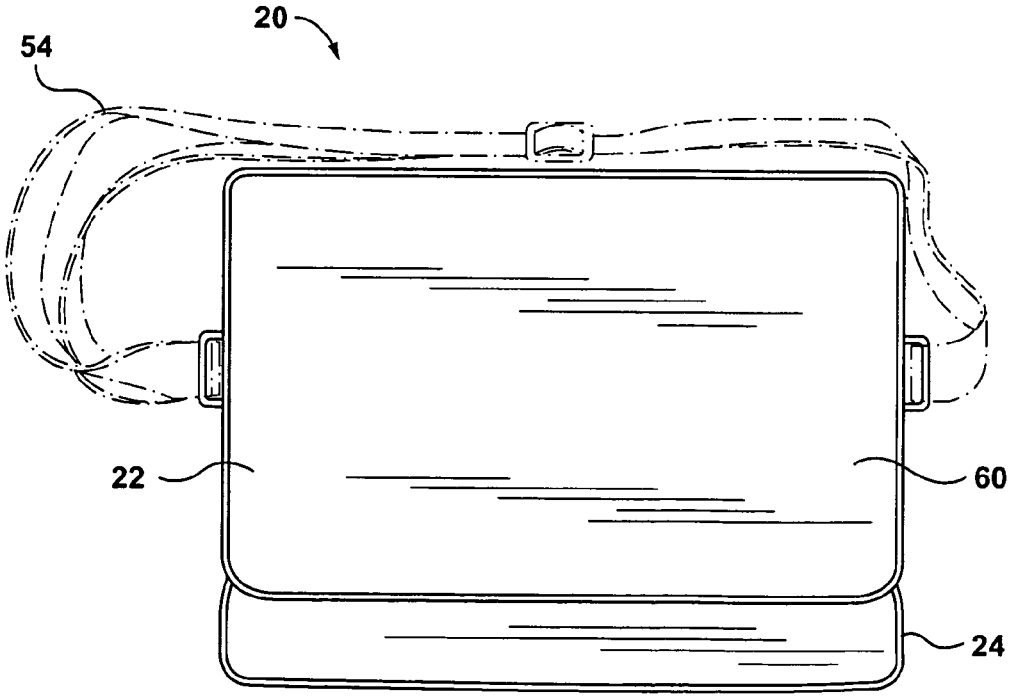
FIG. 2*f* shows a bottom view of the container assembly of FIG. 1*a;*
Figure 2H:
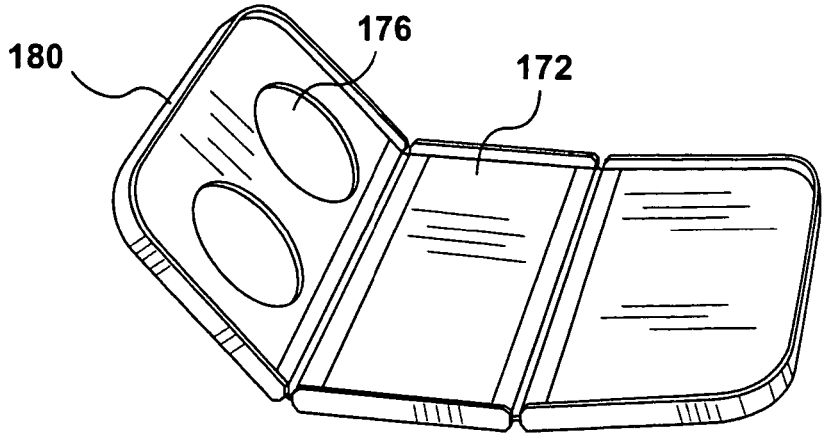
FIG. 2*h* shows an alternate multi-position dividing partition for container assemblies similar to the container of FIG. 1*a;*
Figure 2G:
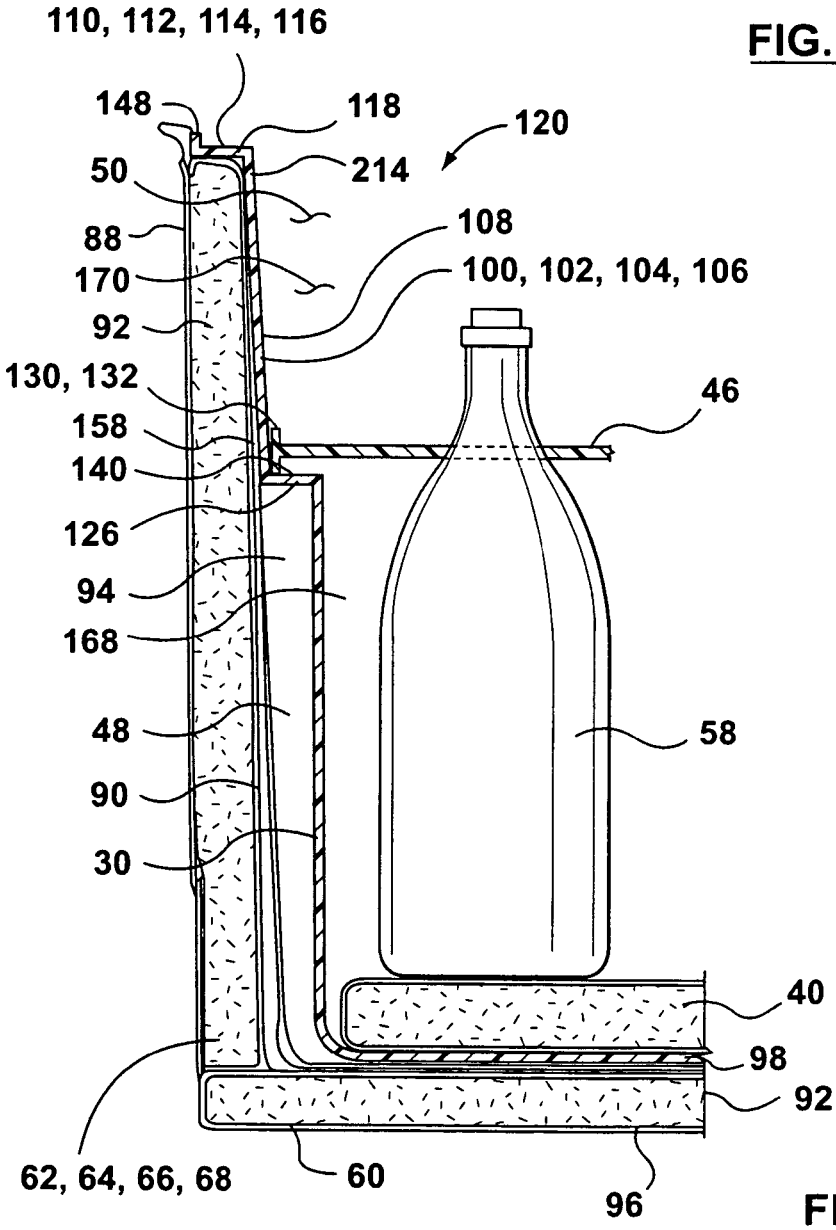
FIG. 2*g* shows a partial sectional view of the structure of the container assembly of FIG. 1*a;*

FIG. 2*g* shows the general structure of a cross-section of any of the insulated wall panels, such as left hand side wall panel 68 with receptacle 30 and partition 46 in place. A scab section of bottom panel 60 is also shown to reveal its layers of construction, as is a scab section of thermal storage member 40. With the exception of auxiliary pouch 24, this section is typical not only of front panel 62 but also, generally, of rear panel 64, side panels 66 and 68, bottom panel 60. The outer facing layer of the panel (be it 62, 64, 66 or 68) is an outer skin in the nature of a canvas covering layer 88 for resisting abrasion. It overlays an intermediate thermal insulation medium, such as may be in the nature of closed cell foam insulation layer 92 for impeding, which is to say discouraging, heat transfer between the interior of container assembly 20 and external ambient. The inner face of insulation layer 92 is covered by an inner skin in the nature of a flexible sheet 90, whether of vinyl (t.m.) or of plasticised metallic foil sheeting that is shiny and reflective. The metallic foil sheeting material may be the type sold under the name Therma-Flect (t.m.). The inside of compartment 48 is lined with white vinyl sheeting on its forward and bottom sides. This same general structural arrangement prevails in bottom panel 60, although outer covering layer 96 may be a rather thicker, scuff-resistant material than the outer skin of the upwardly extending side walls.

In the example illustrated in FIG. 2*g*, the bottle of liquid 58 rests upon thermal storage element 40, which, in this view being shown in one of its alternate positions, is seated, resting on the bottom of receptacle 30. The weight in receptacle 30 is then carried into bottom panel 60, and heat transfer from thermal storage element 40 is preferably biased (i.e., generally made easier by direct contact with item 40, rather than harder) toward the objects within receptacle 30, and generally impeded or resisted through panel 60.

Receptacle 30

Figure 3B:
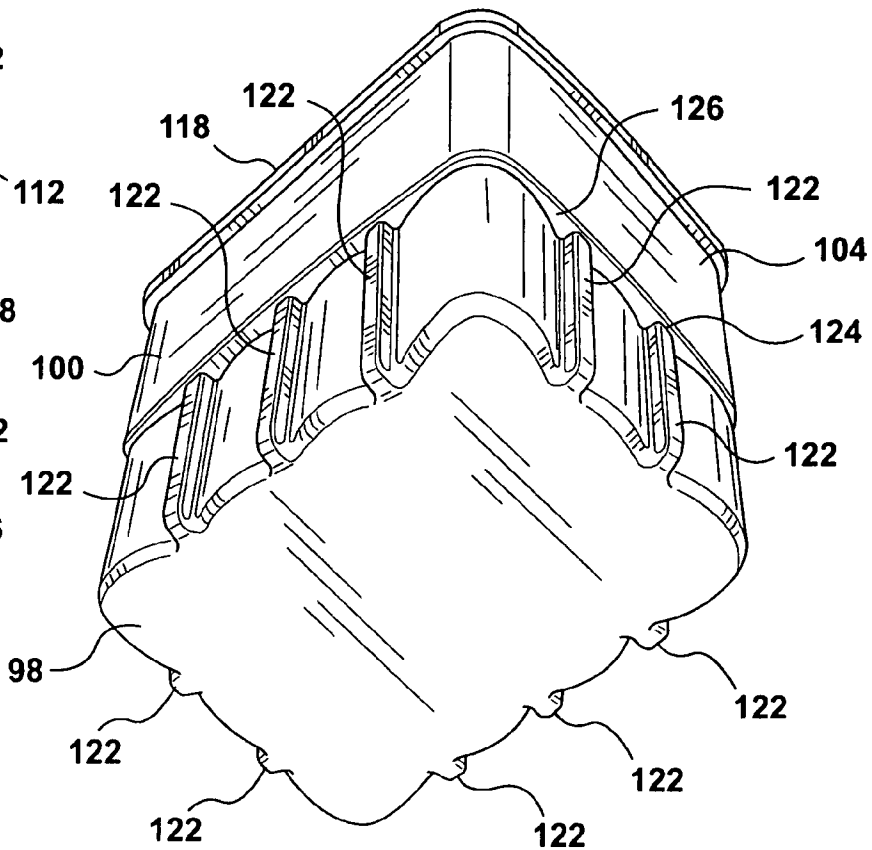
FIG. 3*b* shows an opposite isometric view of the receptacle of FIG. 3*a;*

As a preliminary matter, FIGS. 3*g* to 3*n* are perspective views, not orthogonal views, such that the foreshortening of the taper of the walls appears to be pronounced in an exaggerated, or somewhat disproportionate fashion. A top view, with partition 46 removed, and a bottom view, in FIGS. 3*e* and 3*f*, respectively, and a top view of an alternate embodiment, shown in FIG. 6*b*, provide a contrasting analogous orthogonal view.

Figure 3A:
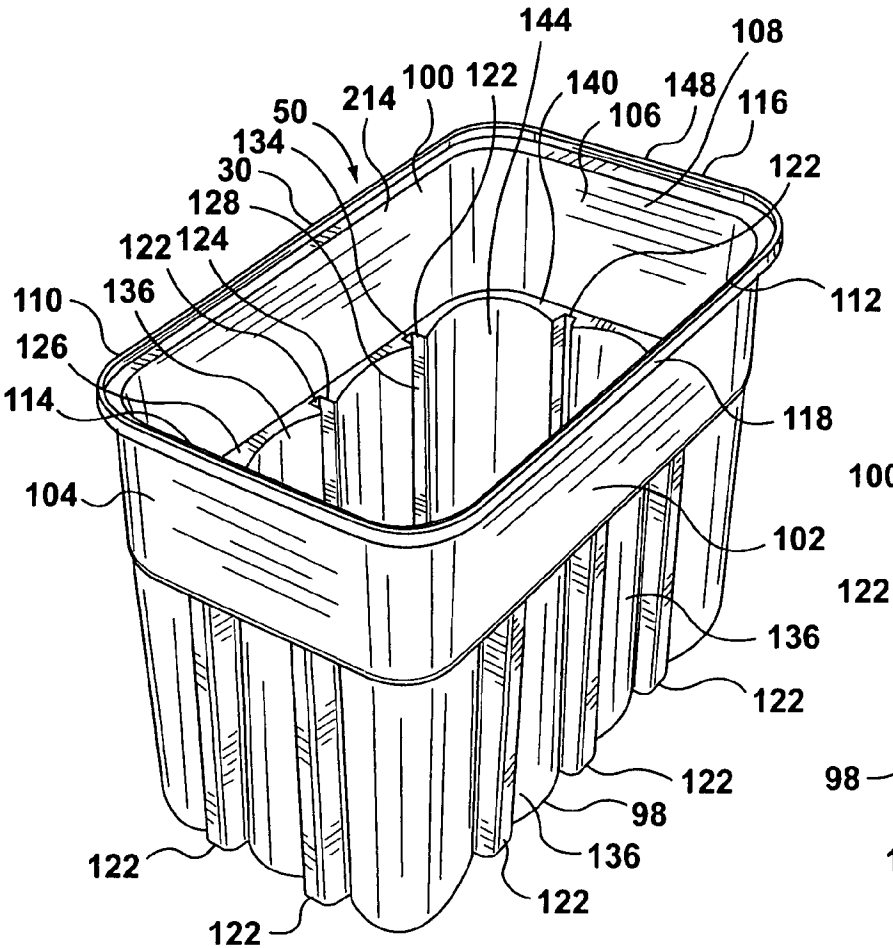
FIG. 3*a* shows an isometric view of a receptacle for use in the container assembly of FIG. 1*a*, taken from above one corner thereof.
Figure 3D:
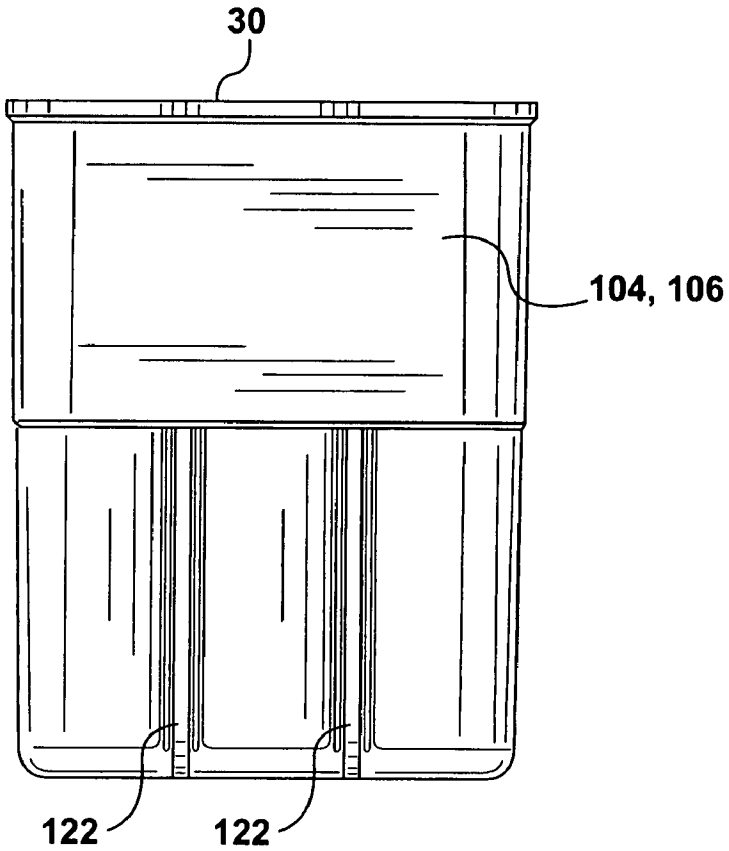
FIG. 3*d* shows an end elevation of the receptacle of FIG. 3*a;*
Figure 3C:
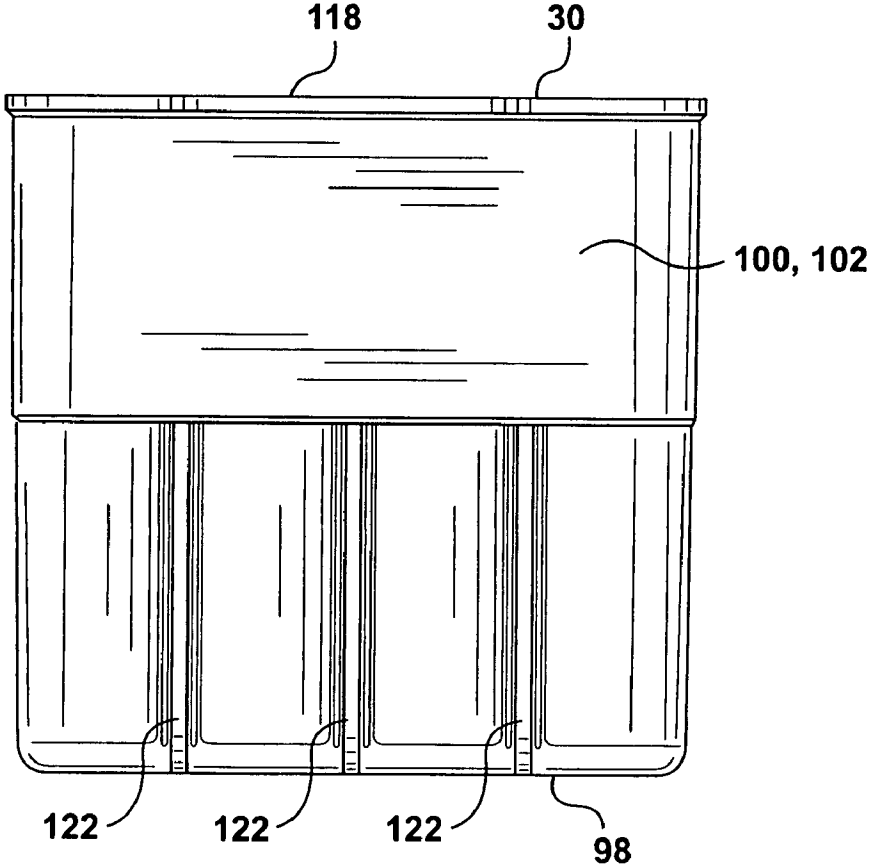
FIG. 3*c* shows a side elevation of the receptacle of FIG. 3*a;*
Figure 3E:
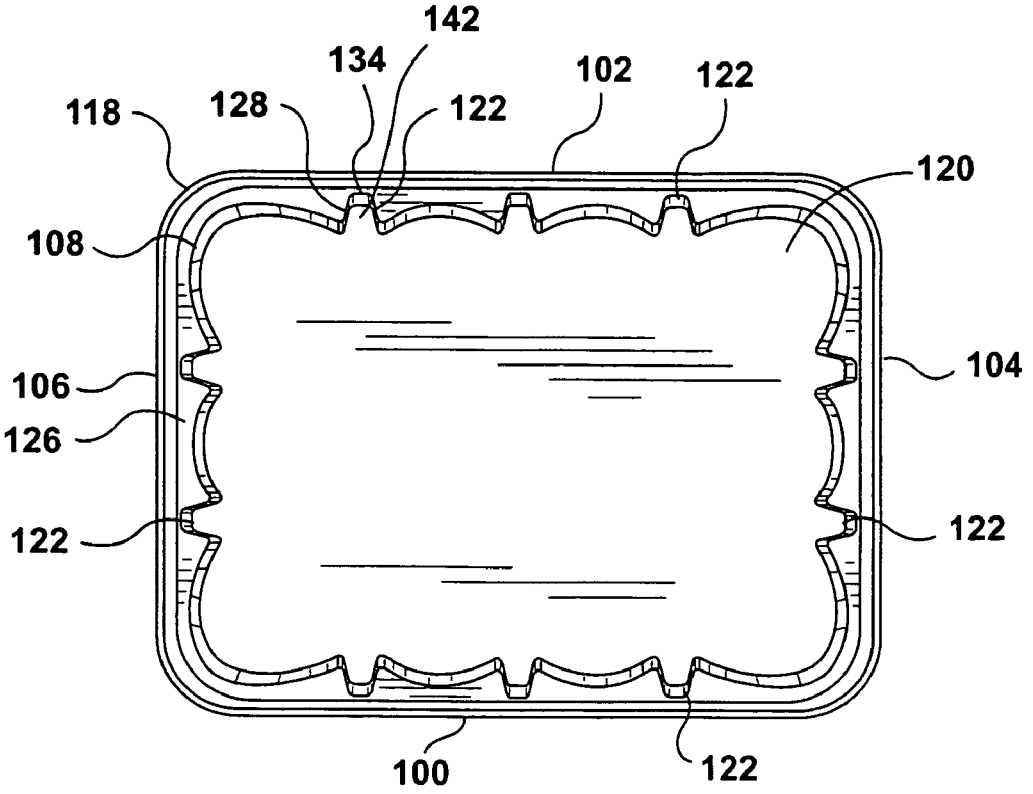
FIG. 3*e* shows a top view of the receptacle of FIG. 3*a;*
Figure 3F:
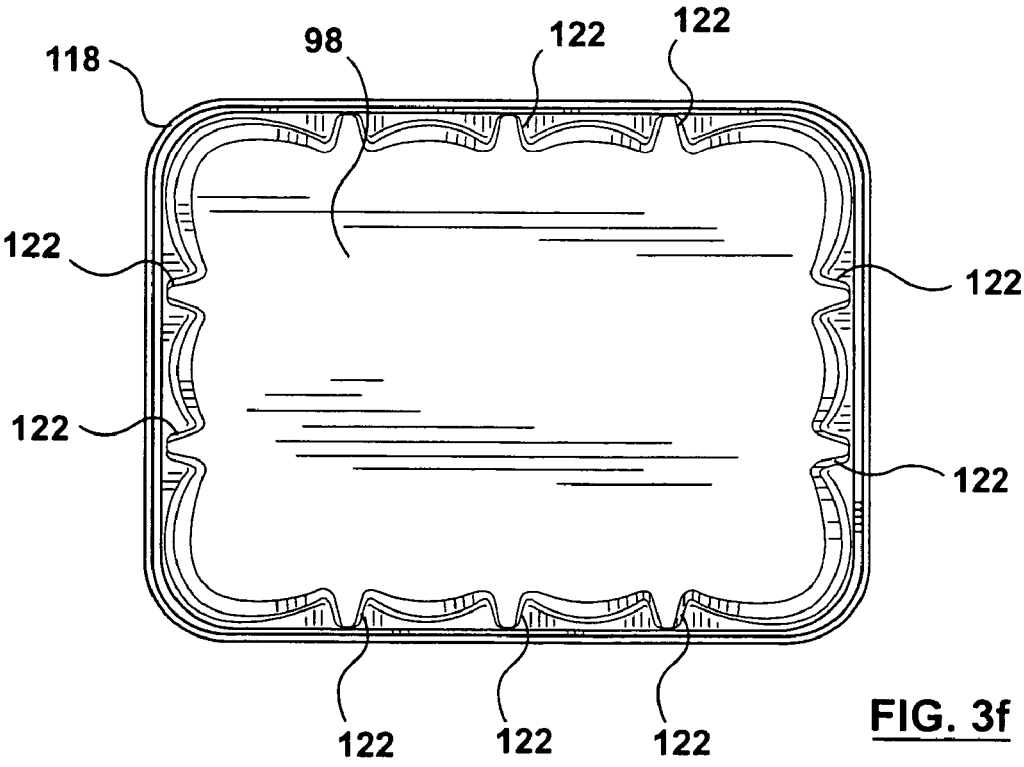
FIG. 3*f* shows a bottom view of the receptacle of FIG. 3*a;*
Figure 3G:
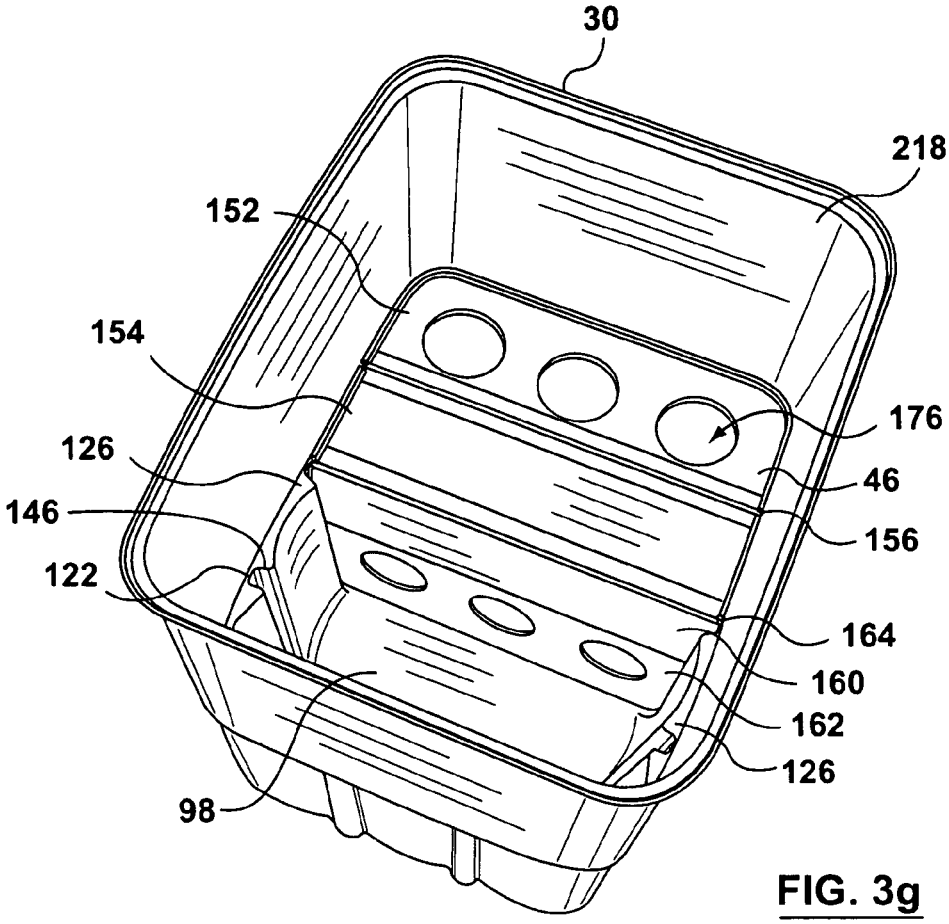
FIG. 3*g* shows an isometric view of the receptacle of FIG. 3*a* with a multi-position dividing partition mounted therein.
Figure 3H:
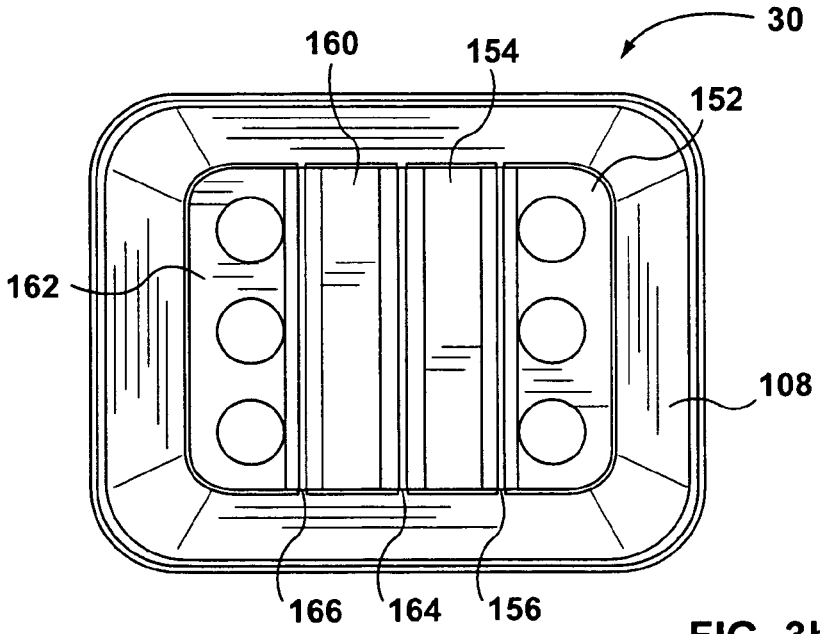
FIG. 3*h* shows a top view of the receptacle and dividing partition of FIG. 3*g* with the partition in a substantially planar mid-height position inside the receptacle.
Figure 3I:
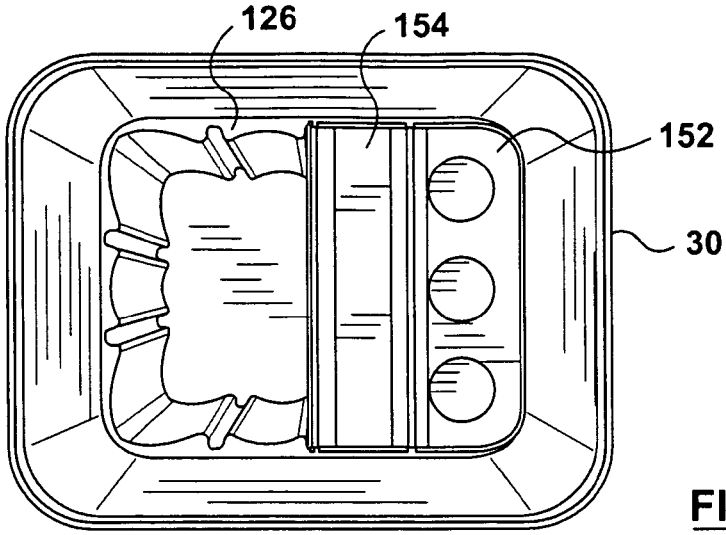
FIG. 3*i* shows a top view of the receptacle and dividing partition of FIG. 3*g* with the partition in a half vertical, half horizontal position inside the receptacle.
Figure 3J:
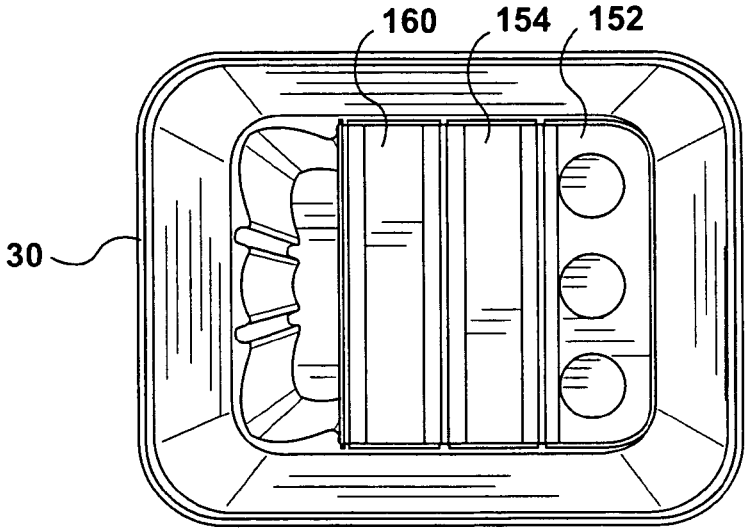
FIG. 3*j* shows a top view of the receptacle and dividing partition of FIG. 3*g* with the partition in a three quarter horizontal, one quarter vertical position inside the receptacle.
Figure 3K:
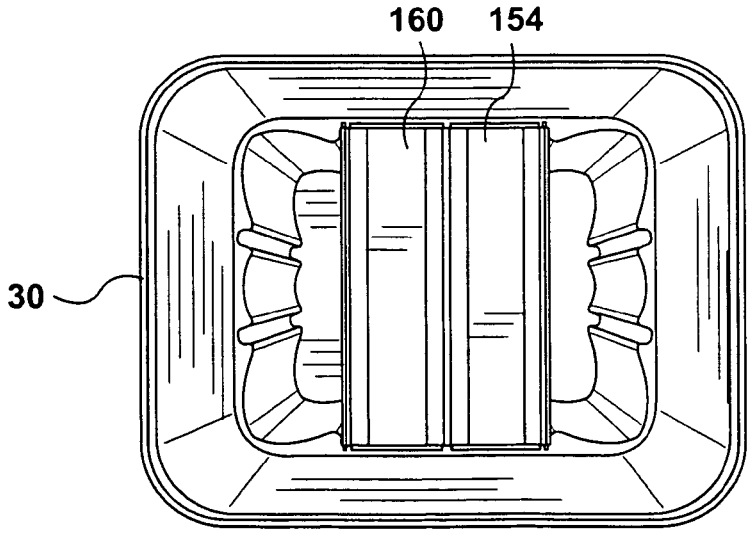
FIG. 3*k* shows a top view of the receptacle and dividing partition of FIG. 3*g* with the partition in a half horizontal, centered position inside the receptacle with both end quarters oriented vertically.
Figure 3L:
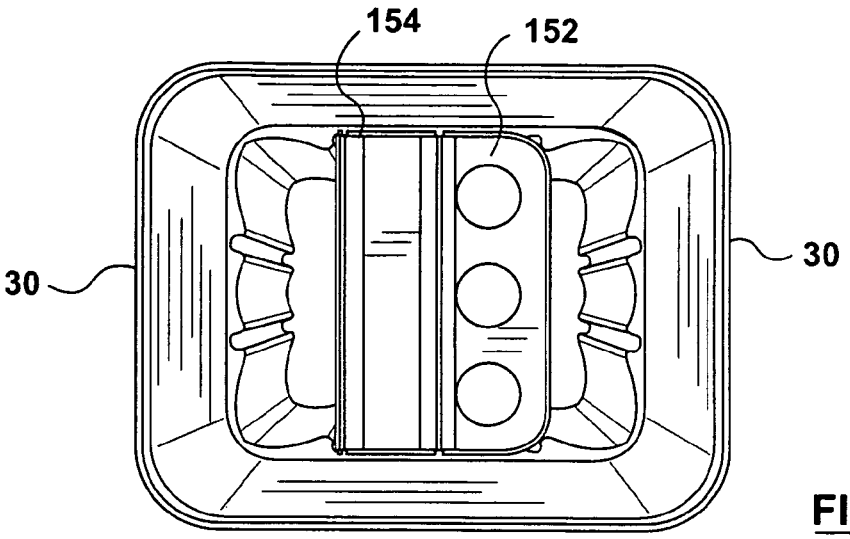
FIG. 3*l* shows a top view of the receptacle and dividing partition of FIG. 3*g* with the partition in a half horizontal, centered position, with one perforated panel portion and one solid panel portion being oriented horizontally.
Figure 3M:
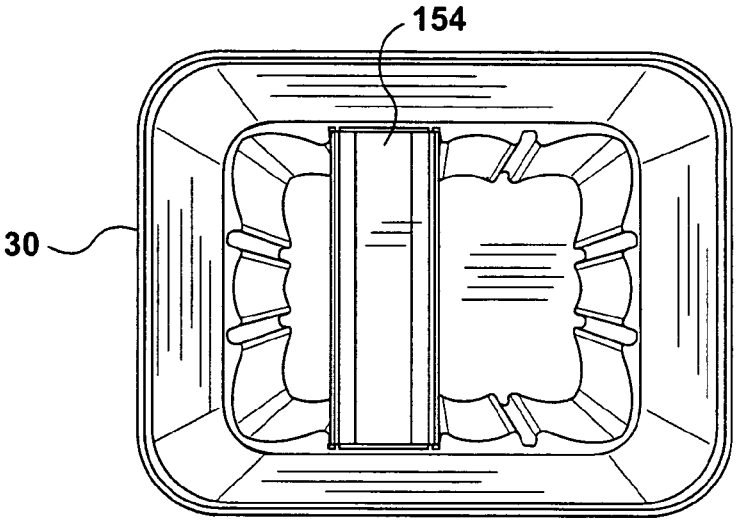
FIG. 3*m* shows a top view of the receptacle and dividing partition of FIG. 3*g* with one quarter of the partition in a planar horizontal position, and the remainder in vertical orientation inside the receptacle.
Figure 3N:
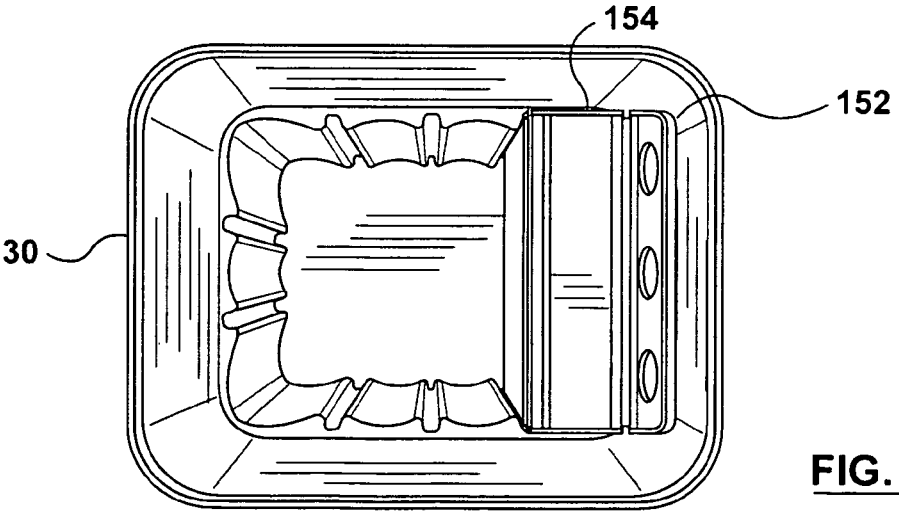
FIG. 3*n* shows a top view of the receptacle and dividing partition of FIG. 3*g* with one quarter of the partition in a substantially planar, side offset mid-height position inside the receptacle.

Referring to FIGS. 3*a* to 3*n*, receptacle 30 is preferably configured to be the same general size and shape as compartment 48 so that receptacle 30 may be placed within compartment 48 and lid 32 may be closed using flexible handle 82 to contain receptacle 30. While receptacle 30 preferably conforms to compartment 48, it may have some other configuration that fits within compartment 48. For example, receptacle 30 may have fewer than four, or greater than four walls. In an alternative embodiment, receptacle 30 may be configured to have one continuous wall defining a round cylindrical segment or another generally rounded shape.

In the preferred embodiment, receptacle 30 has a base or bottom wall indicated as bottom 98, a receptacle front wall 100, a rear wall 102, and a pair of right and left hand side walls 104 and 106. Each wall 100, 102, 104 and 106 is preferably generally located at a generally square corner to two adjacent walls, aside from the slight generally flared taper of the adjacent walls. For example, wall 102 is located adjacent wall 104 at one end of wall 102, and adjacent wall 106 at an opposite end of wall 102. Bottom 98 is be attached to all four walls 100, 102, 104 and 106, along edges thereof, the general structure of receptacle 30 being a molded plastic part such as may be used to contain liquids. Walls 100, 102, 104 and 106, and bottom 98, co-operate to define an interior surface 108 of receptacle 30, which bound chamber 50. Bottom 98 and walls 100, 102, 104 and 106, each are preferably generally rectangular in shape with opposite walls 100 and 102, and 104 and 106, being substantially congruent to one another. In this configuration, chamber 50 has a generally cube-like or rectangular parallelepiped shape having contours, as described in detail below. It should be noted that receptacle 30 may be configured without a bottom 98.

Walls 100, 102, 104 and 106 extend from receptacle bottom 98, and each wall terminates at free edges 110, 112, 114 and 116, respectively. Free edges 110, 112, 114 and 116 together define a receptacle rim, or edge 118 of generally rectangular plan form, with radiused corners. Receptacle edge 118 is preferably generally equidistant from bottom 98 (i.e., lies in a parallel, upwardly spaced plane) and defines a receptacle, identified as opening 120 by which to obtain access to chamber 50. While bottom 98 is generally planar, it may alternatively have portions defining indents (not shown) that conform to the profiles of one or more items to be contained within receptacle 30. Such indents may inhibit movement of these items when placed within the indents corresponding to their respective profiles.

Receptacle 30 is preferably rigid to provide a degree of protection to items stored therein from external forces caused, for example, by bumping, jostling, or knocking of container assembly 20 when it is transported or otherwise used. At the same time, receptacle 30 may tend to be sufficiently lightweight that it may not make container assembly 20 unduly heavy to carry when container assembly 20 is filled with items such as bottles of liquid 58 or sandwiches. A plastic, for example, may be used to form receptacle 30. A relatively tough plastic is preferred because it may tend to resist breakage, it can contain melting ice and spilled liquids, and it may be readily cleaned.

Receptacle 30 may be stiffened further by including one or more strengtheners, such as an array of ribs 122, that extend in a generally upwardly direction from bottom 98, to increase the rigidity of receptacle 30. Ribs 122 may be either attached to, formed integrally with, receptacle 30. Each wall 100, 102, 104 and 106 may have one or more ribs rib 122, which at least partially traverse an external surface thereof. As shown, for example, in FIGS. 3*a* and 3*b*, ribs 122 are generally parallel to one another, and originate adjacent bottom 98, extending from bottom 98 and ending at a rib terminus 124. While rib terminus 124 may be located at or adjacent receptacle edge 118, it may be located at some intermediate height between bottom 98 and receptacle edge 118. While any of ¼, ⅓, ½, ⅔, or ¾, or some other suitable proportion may be chosen, terminus 124 is roughly ½ way between bottom 98 and rim 118. In this intermediate position, rib terminus 124 may also meet interior shoulder 126 which may be used to support partition 46, as described in further detail below.

The interior surface 108 of receptacle 30 has at least one guide 128 for receiving or engaging a portion of partition 46, for example, an edge, such as edge 130 (as shown in FIG. 3*e*; and described in further detail below). Guide 128 may be added to, or, preferably be made integrally with, receptacle 30. Guide 128 may be integrally formed with a wall, such as wall 100 or 102, of receptacle 30, and is oriented so that an edge, for example edge 130, of partition 46 may be placed therein. When partition 46 is held by guide 128, it is preferably oriented to at least partially divide chamber 50. Most preferably, the internally facing surfaces of the integrally molded wall feature of rib 122 also function as guide 128.

Guide 128 may be in the nature of a rebate, groove or fluting, and may be substantially linear to permit partition 46 to be slidingly received therein. Guide 128 may be located to correspond to the location of a rib 122 so that guide 128 is defined within rib 122. Accordingly, guide 128 originates adjacent bottom 98, and extends along interior surface 108, from bottom 98, and ends at a guide terminus 134, which may corresponds to rib terminus 124. Guide terminus 134 may be located at or adjacent receptacle edge 118, but is preferably located at some mid-point between bottom 98 and receptacle edge 118 adjacent interior shoulder 126. A longitudinal axis of guide 128 may be substantially perpendicular to a plane of bottom 98.

Guide 128 need not be the same length as rib 122, it need only be of sufficient length to receive at least part of an edge (such as edge 130) of partition 46 to inhibit movement thereof in a direction transverse to a longitudinal axis of guide 128. Receptacle 30 may alternatively be formed with guide 128 (and, if desired, rib 122) oriented at an angle other than at 90 degrees relative to bottom 98. This would in turn alter the orientation of a received partition 46. If rib 122 and guide 128 are aligned, then rib 122 both strengthens receptacle 30 and defines guide 128. This arrangement may also facilitate the manufacture of receptacle 30 if, for example, it is made by injection moulding. In the preferred embodiment, guide 128 is configured to be substantially straight for receiving a substantially straight edge 130 of partition 46.

Receptacle 30 may be provided with additional guides 128 for receiving edge 130 of partition 46, for example. Two guides 128 may co-operate and each receive an edge of partition 46, such as edges 130 and opposite edge 132, to inhibit movement of partition 46 (as shown in FIG. 3*g*). The provision of multiple guides 128 within receptacle 30 permits chamber 50 of receptacle 30 to be sub-divided in different ways depending on which guides 128 are used for receiving partition 46 (as further explained below).

Each guide 128 may be bounded by generally parallel edges or boundaries, which have a concave rounded or arcuate intermediate portion 136 therebetween. The rounded intermediate portion 136 may facilitate the manufacture, for example by moulding, of receptacle 30, may increase the stiffness of the structure more generally, and may serve to provide a nesting curvature for a round cylindrical container, such as a bottle or can that may be placed in receptacle 30.

Receptacle 30 may also have a shoulder 126 for supporting partition 46, or a portion of partition 46, in a generally horizontal orientation, such as to function as a shelf or partial shelf. Shoulder 126 extends along interior surface 108, may be located between receptacle edge 118 and bottom 98. In the preferred embodiment, shoulder 126 may extend along the perimeter of interior surface 108 at a height intermediate to the bottom and the upper rim, preferably generally about halfway between the two. To reduce material in an alternate embodiment, shoulder portions in the nature of inwardly extending flutes of partial height, may instead be implemented to support partition 46. Shoulder 126 projects from interior surface 108, and may present a surface 140, that is generally planar and parallel to bottom 98. Subject to the existence of intermediate arcuate portions 136, surface 140 may have a generally uniform width, and may have gaps 142 therein where guides 128 intersect shoulder 126. Each gap 142 corresponds to a guide terminus 134.

In one embodiment, receptacle 30 has six generally parallel guides 128: three sets of opposed guides located in opposed walls 100 and 102, respectively. In an alternate embodiment it may also have two sets of opposed guides in opposed walls 104 and 106. Each guide 128 may be spaced on generally equal, regular pitches along walls 100, 102, 104 or 106.

As noted above, wall portions between adjacent guides 128 may accommodate items such as beverage bottles 58. For example, a wall portion 136, located between two guides 128, may be generally arcuate, or some other shape, to conform to a profile of a bottle 58. Similarly, a corner wall portion 144 may conform to a profile of bottle 58 and define a corner of receptacle 30. An axis of the apex of each wall portion may be substantially parallel to guides 128, and each guide and its adjacent arcuate portions have substantially linear co-terminating boundaries 146. While in one embodiment the width of shoulder surface 140 may be roughly uniform, it may vary to correspond to the profile of the wall portions, such as corner wall portion 144. In the alternate, embodiment of FIG. 6*b*, a receptacle 138 is shown that does not have arcuate wall portions, or arcuate corner molding portions, but rather has substantially planar walls, with corner radii, giving a smoother, and simpler, style of construction.

If receptacle 30 is configured to be substantially the same size as compartment 48, (or, that is of a corresponding size that fits well therein) then spaces or gaps 94 between receptacle 30 and one or more of walls 62, 64, 66 and 68, may be reduced. A smaller gap 94 may reduce the likelihood that spilled liquids, food, or such other matter may find its way between the inwardly facing wall surfaces of soft sided wall structure 28 and the outwardly facing surfaces of receptacle 30, which may tend to reduce the frequency with which compartment 48 requires cleaning. Gap 94 may be reduced by configuring receptacle edge 118 to have a reinforcement or stiffener in the nature of a flange or lip 148. Lip 148 may extend peripherally along receptacle edges 110, 112, 114, 116 and is preferably located adjacent one or more of outer casing free edges 72, 74, 76 and 78 when receptacle 30 is positioned within outer casing 26. This proximity of lip 148 to free edges 72, 74, 76 and 78, may tend to reduce the size of a gap 94 that may form between the flexible outer casing 26 and receptacle 30. By reducing the size of gap 94, matter such as a spilled liquid may be encouraged either to be caught within receptacle 30 or repelled by any portion of the exterior surface of outer casing 26. Lip 148 may have a generally L-shaped cross-section forming a step in receptacle edge 110, 112, 114 or 116 as may be, and may project outwardly and away from walls 100, 102, 104, 106, and chamber 50 in a generally horizontal plane. Lip 148 may alternatively or additionally be arcuate, rounded or have some other shape that projects from walls 100, 102, 104, 106 to discourage passage or matter between outer casing 26 and receptacle 30. (FIG. 2*g*).

Partition 46

Figure 8A:
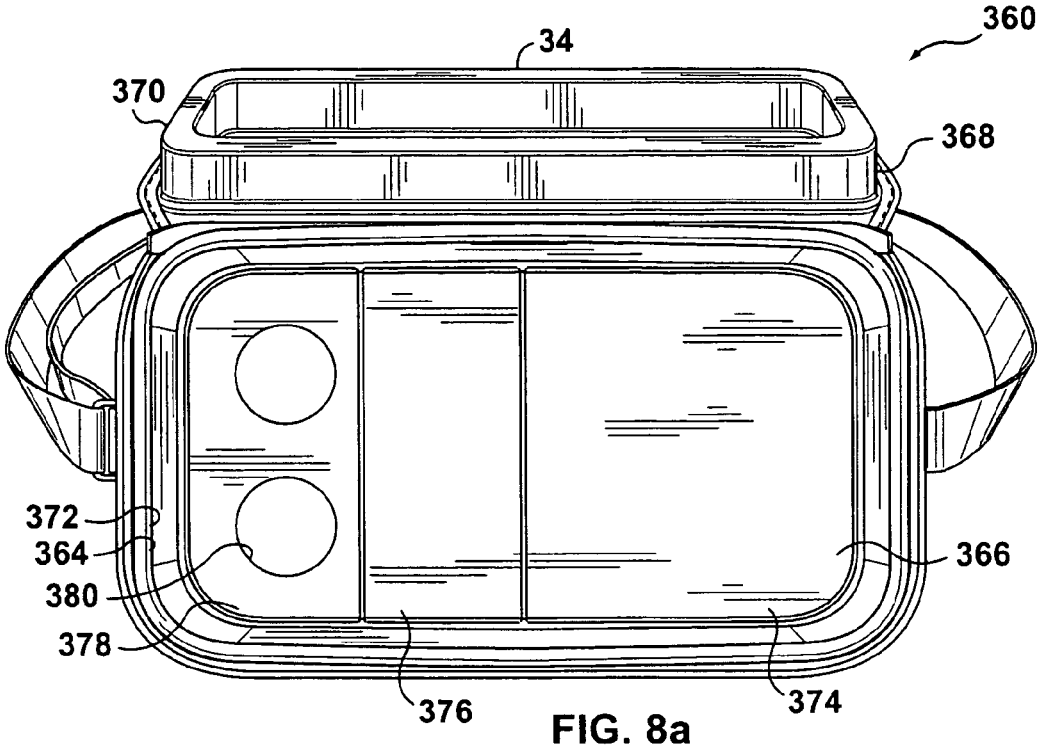
FIG. 8*a* is a top view of the container assembly of FIG. 7*a* in an open position.
Figure 8C:
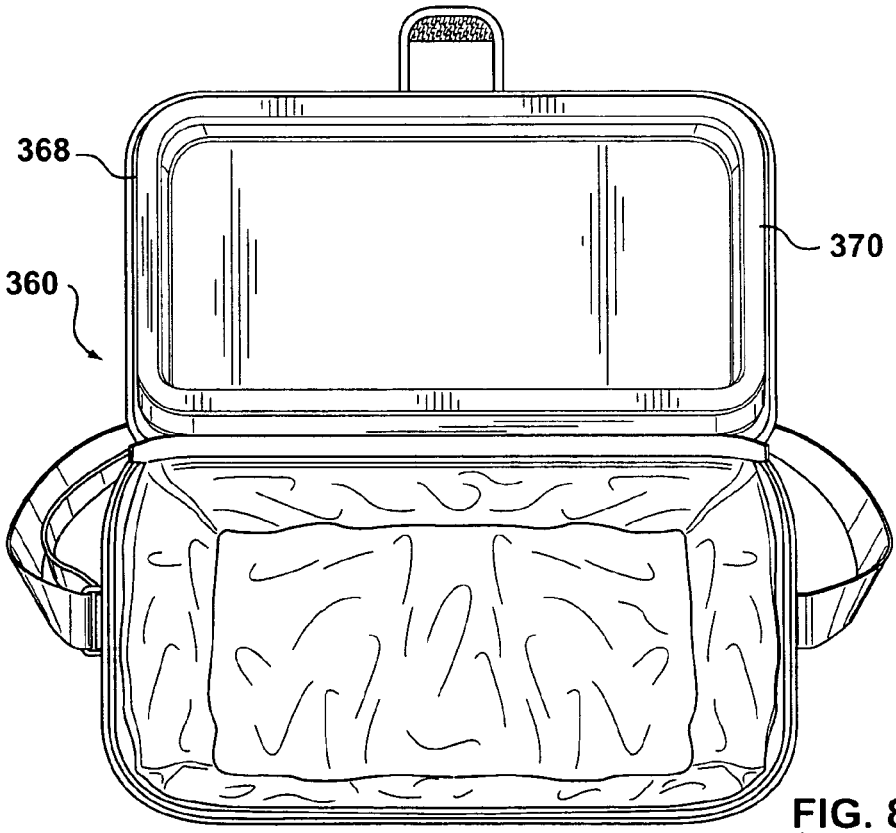
FIG. 8*c* is similar to FIG. 8*a*, but with an internal receptacle removed.
Figure 8B:
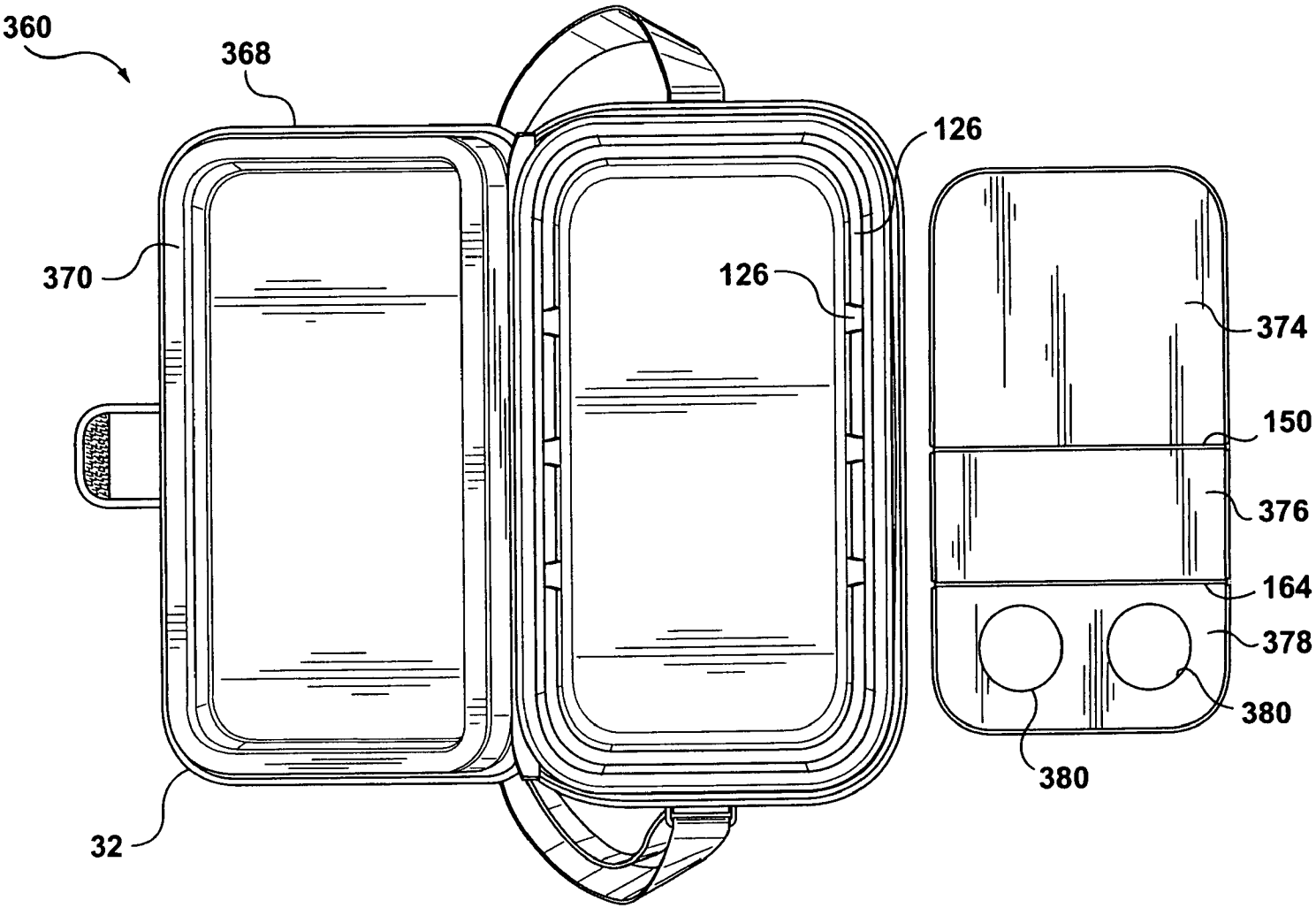
FIG. 8*b* is similar to FIG. 8*a*, but with an internal divider member removed.
Figure 8D:
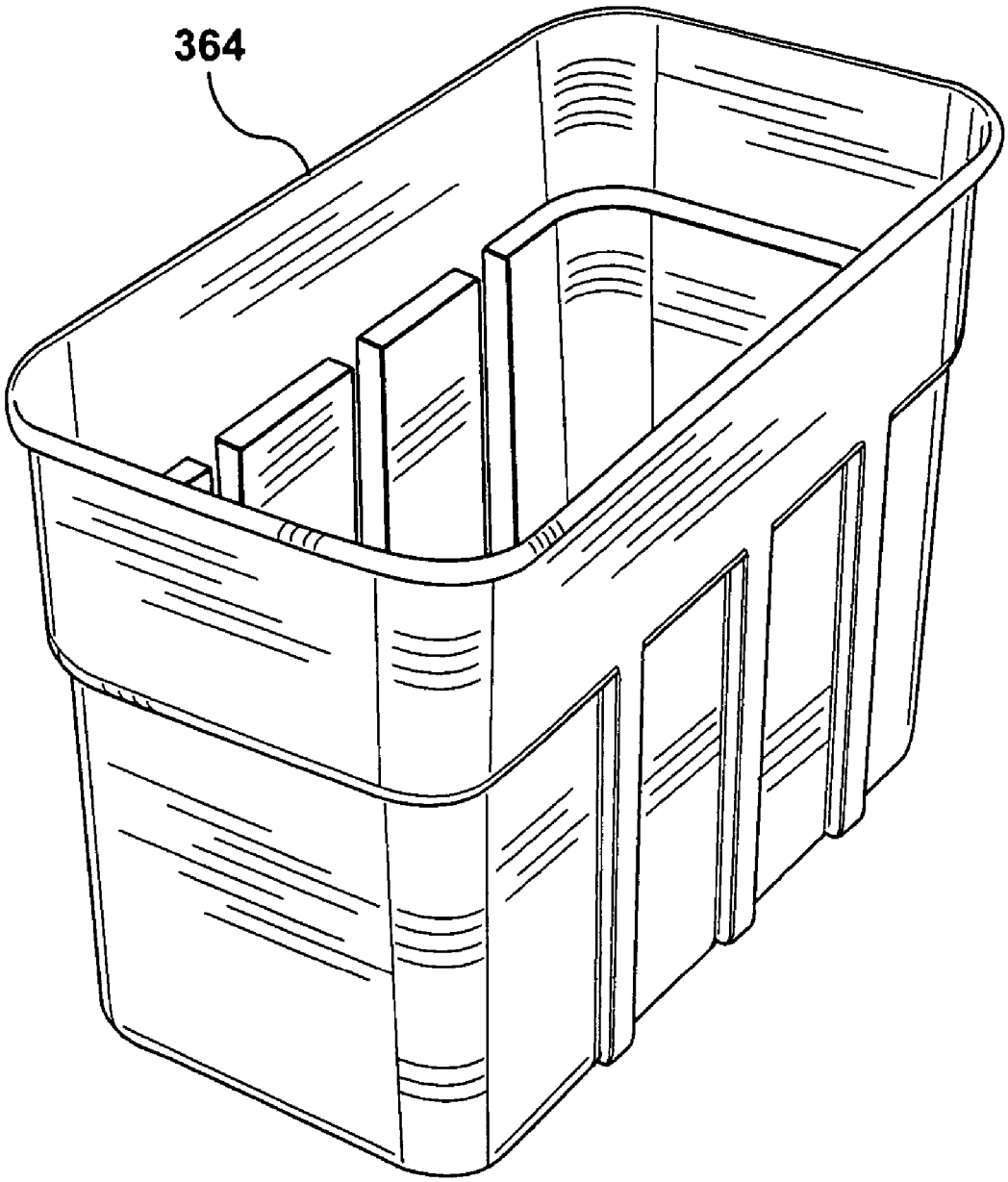
FIG. 8*d* is a perspective view of the internal receptacle of FIG. 8*c;*
Figure 8E:
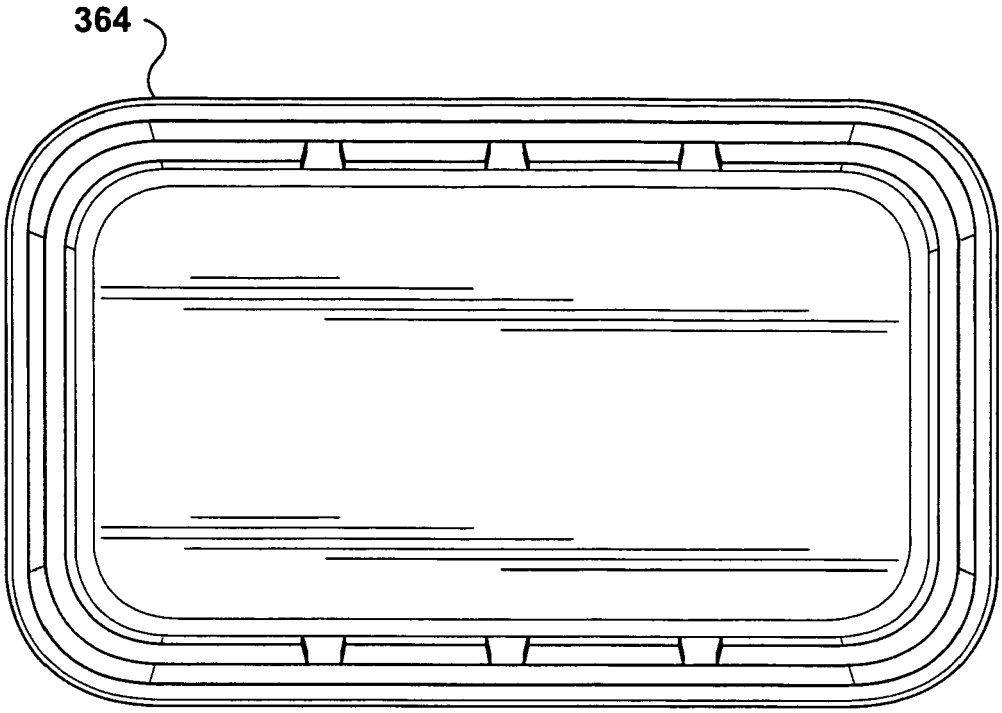
FIG. 8*e* is a top view of the receptacle of FIG. 8*d;*
Figure 8H:
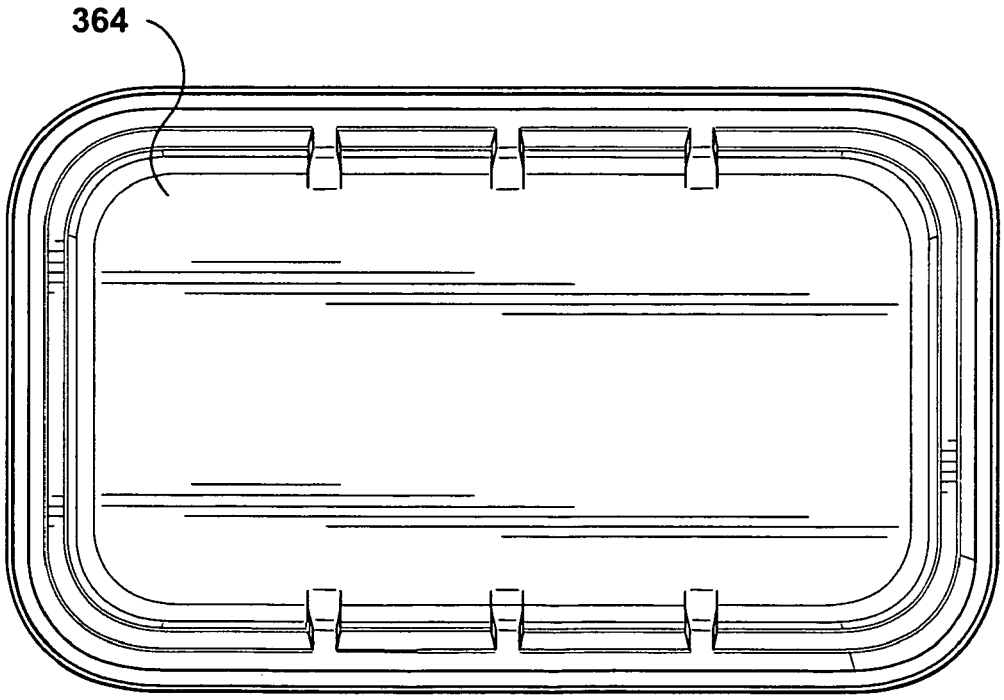
FIG. 8*h* is a bottom view of the receptacle of FIG. 8*d;*
Figure 8G:
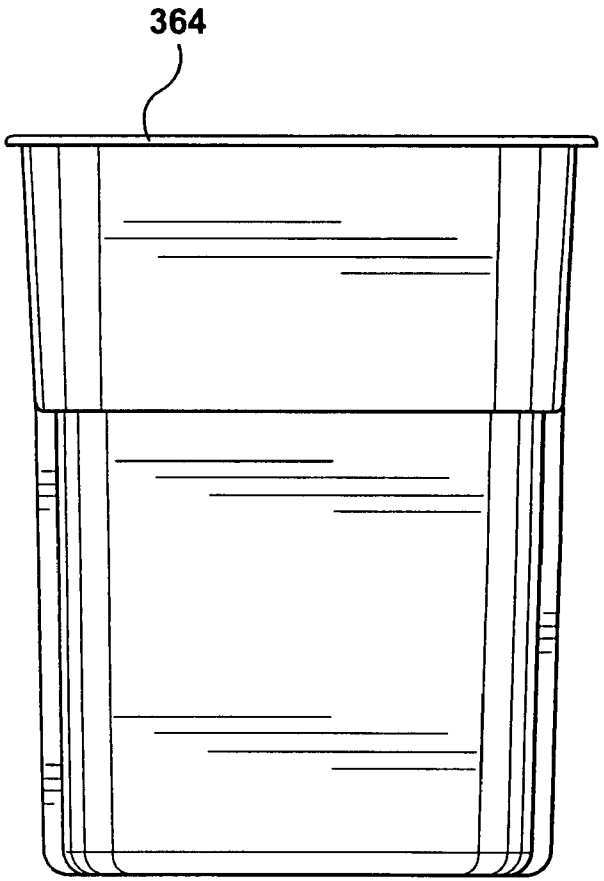
FIG. 8*g* is an end view of the receptacle of FIG. 8*d;*
Figure 8F:
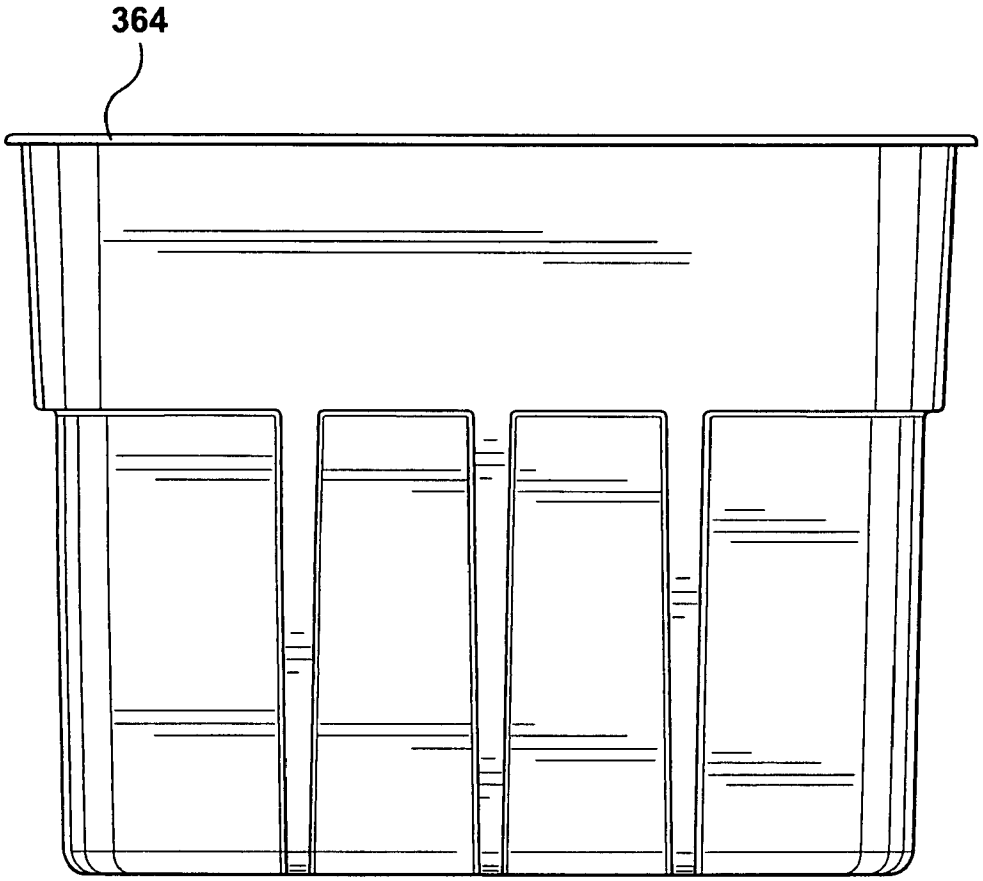
FIG. 8*f* is a side view of the receptacle of FIG. 8*d;*

Referring to FIG. 8*a*, partition 46 may be positioned within receptacle 30 to sub-divide chamber 50 in two different ways, as shown, for example in FIGS. 3*g* to 3*n*. By sub-dividing chamber 50, the movement of items stored within chamber 50 may be inhibited, which may limit the extent to which they come into damaging contact with one another, and with walls 100, 102, 104, 106 and bottom 98, when container assembly 20 is transported or moved. Partition 46 may be made of a substantially rigid material so that it may tend to resist deformation when contacted by items stored in receptacle 30. As discussed in further detail below, one or more guides 128, and shoulder 126, or both, may co-operate with partition 46 to inhibit its movement within receptacle 30 when it is located to sub-divide chamber 50.

Positioning and configuring of partition 46 may be facilitated by providing partition 46 with a first hinged connection 150 therein. Hinged connection 150 separates partition 46 into at least a first partition portion 152 and a second partition portion 154. First and second portions 152 and 154 are joined to one another along hinged connection 150, and are movable relative to one another about hinge 150.

A portion of partition 46, which traverses partition 46 between first and second portions 152 and 154, preferably defines a living plastic hinge 156. Hinge 156 may have a thickness that is less than the thickness of the web of either or both of the first and second portions 152 and 154. The peripheral flange, or edge 158, standing perpendicular to the general plane of the intermediate, transversely extending webs, is relieved, (by being chamfered, or bevelled down) in the region of the hinge. If partition 46 is moulded from a plastic, then hinge 156 may be integrally formed therein. Hinge 156 may alternatively be formed using a flexible joining member such as an adhesive tape attached to both first and second partition portions 152 and 154 (not shown). Alternatively, hinge 156 may be formed by laterally inserting a pivot member such as a pin through one or more projections extending from each of first and second partition portions 152 and 154, respectively. First and second partition portions 152 and 154 may then rotate about the pin connecting them.

In one embodiment, first and second partition portions 152 and 154 may be generally planar, and may be connected or mounted along adjacent edges thereof. In this configuration, the angular displacement of first and second portions 152 and 154 relative to one another about hinge 156 may be varied. For example, partition 46 may be configured to be generally planar when first and second portions 152 and 154 are co-planar (see FIG. 3*i*), and may be configured to be generally L-shaped when first and second portions 152 and 154 are generally at right angles relative to each other (see FIG. 3*n*).

In one embodiment, partition 46 has a third partition portion 160 attached to second partition portion 154, and fourth partition portion 162 attached to third partition portion 160 as shown in FIG. 3*h*. Portions 160 and 162 may be attached using second and third hinges 164, 166 which may be configured in a manner similar to hinge 156, as described above. Hinges 156, 164 and 166 are preferably parallel to one another, permitting multi-position partition 46 to be placed in a variety of different configurations: generally planar when portions 152, 154 and 160 and 162 are co-planar (see FIG. 3*h*); generally L-shaped (FIG. 3*g*) when one or two of portions 152 or 154, 160 or 162 is (or are) rotated about one of the hinges (156, 164 or 166) to be generally perpendicular to the remaining two portions (see FIGS. 3*g*, 3*i*, 3*j*, 3*l*, and 3*n*); and generally U-shaped when portions 152 and 162 are rotated towards each other about hinges 156 and 166, respectively, until they are generally perpendicular to intermediate portion 154 and 160. (See FIGS. 3*k* and 3*m*). A number of permutations are possible, and may be employed according to the needs of the user.

Referring to FIG. 3*h*, when in a generally horizontal planar orientation, the plan form of partition 46 is preferably congruent to a shape defined by an intersection of support surface 140 and receptacle interior surface 108. That is, the periphery of the divider is generally similar in plan form to the plan form of the shelf defined by the shoulder at the transition of section of the wall structure of receptacle 30. This permits partition 46 to lie within receptacle 30 and to be supported about its margin by shoulder 126. In this configuration, partition 46 divides chamber 50 into a first sub-chamber 168 adjacent bottom 98, and a second sub-chamber 170 adjacent opening 120 (best seen in FIG. 2*g*). Items stored within each sub-chamber 168 and 170 may be kept separate by first placing one or more items into sub-chamber 168, placing partition 46 onto shoulder 126, and then placing one or more additional items onto partition 46 for storage within sub-chamber 170. Alternatively, or additionally, a thermal storage element, such as a hot pack or an ice pack, or such as discussed more fully below, can also be located upon partition 46 amidst the objects contained in container assembly 20.

Access to items in sub-chamber 168 may be obtained by moving, e.g., pivoting or lifting, one or more of panels 152, 154, 160 and 162 away from sub-chamber 168. To move panels of partition 46, partition 46 may be grasped through one or more holes therein, as described below.

Referring to FIGS. 3*g* to 3*n*, partition 46 may also be configured to partially sub-divide chamber 50 when partition 46 has a general L-shape. In this configuration, the peripheral edges of one portion, for example portion 152, may be placed in, or slidingly engaged with, a pair of opposed guides 128. The remaining portions 154, 160 and 162, lying perpendicular to portion 152, may be supported by shoulder 126. Items stored between partition 46 and bottom 98 may be separated from items placed onto portions 154, 160 and 162. Items may additionally be placed on a portion of bottom 98 that is exposed even when partition 46 is in place. If the distance between partition portions 154, 160 and 162 and bottom 98 is substantially the same as the width of portion 152, then items placed on bottom portion 162 may be separated by portion 152 from items placed on the portion of bottom 98 that is enclosed by partition 46. In one embodiment, portions 152, 154, 160 and 162 may all have substantially the same width, and shoulder 126 may be spaced from bottom 98 by a distance that may be roughly equal to two times the width of one of these portions. Although, they be roughly equal quarters, portions 152, 154, 160 and 162 may alternatively have substantially different widths. The distance between bottom 98 and shoulder 126 may vary between embodiments. For example, a greater distance may be used when constructing a receptacle 30 for containing wine bottles than when constructing a receptacle 30 for containing beer bottles.

Edges of portion 160, 162 and portion 154, may be inserted into respective opposed guides. Once so inserted, portion 152 may be pivoted about hinge 156 to be supported by shoulder 126, and to provide an alternate division of chamber 50. In this configuration, the distal end 168 of portion 162 is located adjacent bottom 98. Many alternate positions are possible as illustrated in the Figures. These different configurations of partition 46 may permit items of various dimensions to be stored within receptacle 30. If a different configuration of partition 46 is required, partition 46 may be manually removed, reconfigured and repositioned, as needed. Partition 46 may have a stiffener in the nature of a rim or flange 158. Flange 158 extend about a portion or all of the periphery of partition 46. Flange 158 may project generally perpendicularly to the transverse web 172 of partition 46, to form either an L-section (an angle) or as a T-section. A T-section is shown in FIG. 21. Flange 158 is preferably relieved adjacent all hinges. Partition 46 may additionally have a bore, formed opening, or aperture, or apertures, such as may be in the nature of a circular holes 176, passing through at least one of portions 152, 154, 160, and 162. Holes 176 may permit partition 46 to be grasped for removal or relocation.

Referring to FIG. 2*g*, hole 176 may additionally be sized to receive an item such as a vessel, for example the neck of bottle 58, that is placed within chamber 50. Hole 176 may be preferably of the order of 1½ to 2 inches in diameter, and perhaps about 1¾ inches to accommodate the neck of a wine bottle, or pop-bottle or beer bottle, and so on, while being smaller than a cross-sectional dimension of the body of the bottle. Because hole 176 is preferably as large as the bottle neck cross-sectional dimension, lateral movement of the bottle neck within hole may be inhibited, for example, when container assembly 20 is carried, jostled or bumped. By inhibiting movement of the bottle neck, bottle 58 may be discouraged from toppling and spilling its contents, or coming into undesired contact with other items stored within receptacle 30. An array of holes 176 may be located in a partition portion, such as portion 152 or 162, to position a bottle body adjacent one of the wall portions, when bottle 58 is supported by bottom 98, portion 152 is supported by support surface 140, and the bottle neck extends through hole 176.

Figure 2I:
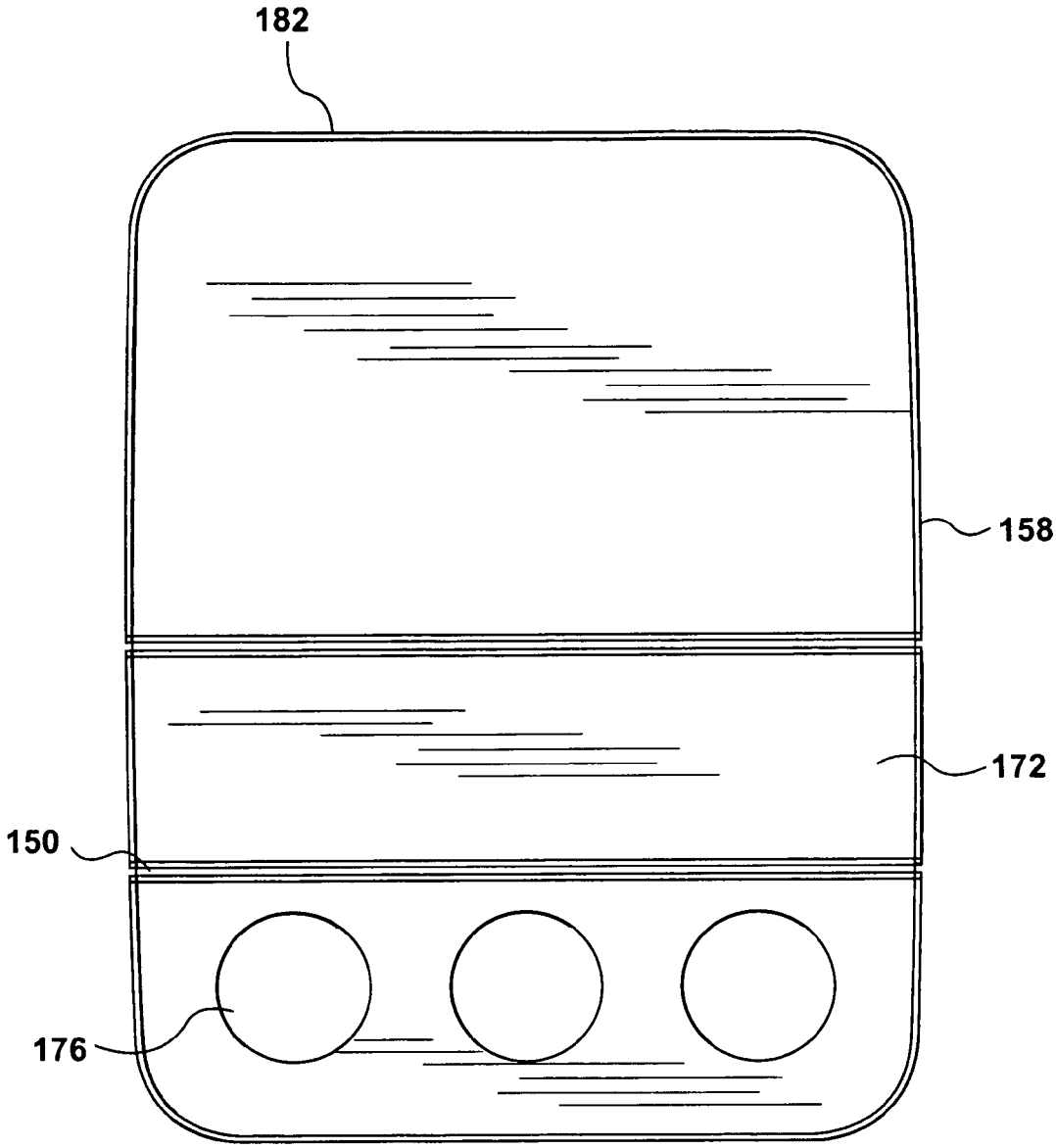
FIG. 2*i* shows an alternate three-panel, two fold, multi-partition dividing partition for the container assembly of FIG. 1*a;*
Figure 2J:
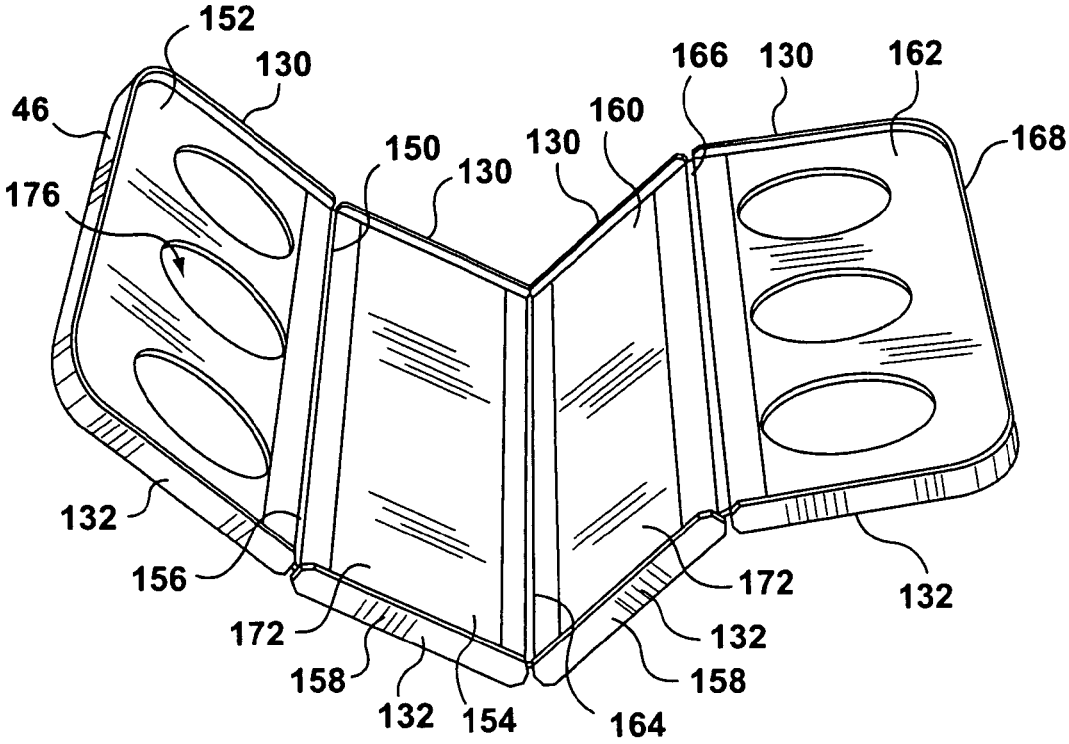
FIG. 2*j* is a perspective view of the multi-position dividing partition of FIG. 1*b;*
Figure 2L:
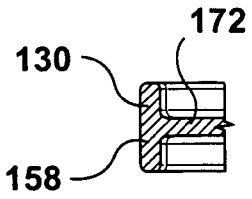
FIG. 2*l* is a cross-sectional detail taken on arrow '2*l*' of FIG. 2*k;*
Figure 2K:
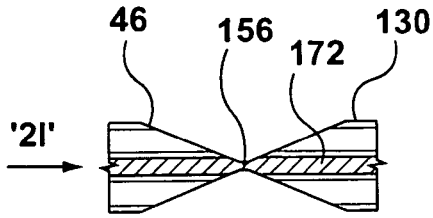
FIG. 2*k* is a hinge detail of the dividing partition of FIG. 2*j;*

While one embodiment may have three holes 176 located in each of the end quarter panel portions of partition portion 152, 162, one, two, or more holes may be placed in any portion, as in the alternative configurations of partitions 180 and 182 in FIGS. 2*h* and 2*i*. Partition 180 is a double fold, three portion partition (the portions being roughly equal in longitudinal extent) with two holes 176 in one of the end portions (see FIG. 2*h*). Partition 182 is a double fold, three portion partition, in which one portion is substantially larger and three holes 176 is in one of the end portions (see FIG. 2*i*).

Internal Structural Member 34

Figure 4B:
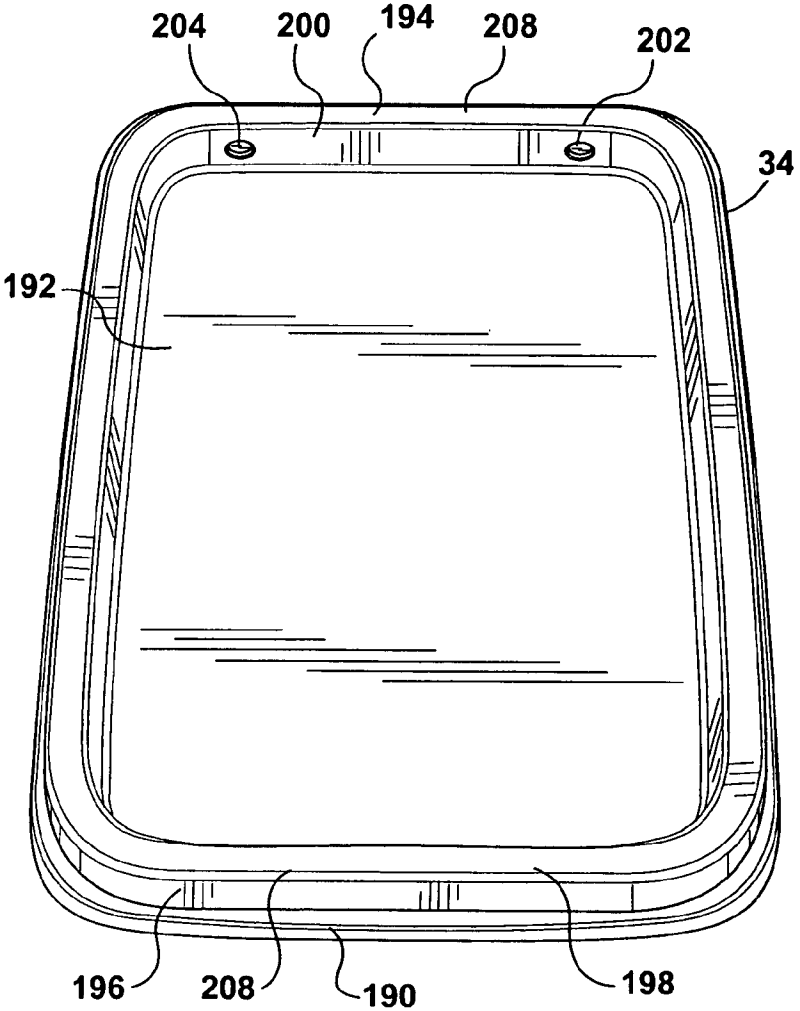
FIG. 4*b* shows a view from above of the lid structural member of FIG. 4*a;*
Figure 4A:
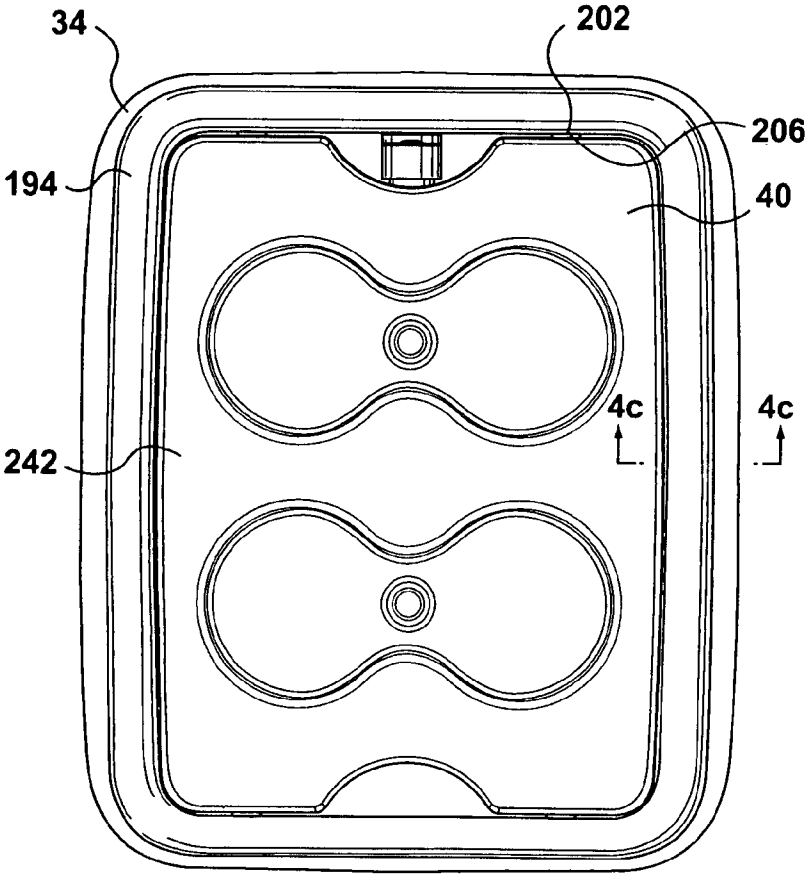
FIG. 4*a* shows a top view of a lid structural member and thermal storage element subassembly of the container assembly of FIG. 1*a;*
Figure 4C:
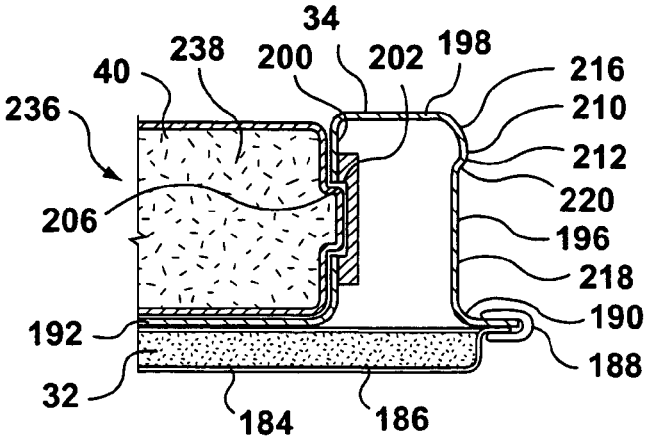
FIG. 4*c* shows a scab cross-section of FIG. 4*a* on section '4*c*-4*c*'.

Lid 32 may include internal structural member 34. The general cross-sectional structure of lid 32 may be generally as shown in FIG. 4*c*, in which lid 32 has an outer skin 184, an intermediate layer of thermal insulating material 186, such as may be a layer of closed cell foam, and an inner wall, or skin, provided by internal structural member 34. A heavy fabric strip 188 is folded over the combined edges of the fabric outer skin 184 and the external lip 190 of structure member 34 and the laminate so formed is then sewn together, the stitches passing through lip 190. In this way a thermally insulative sandwich structure is formed.

In one embodiment, internal structural member 34 may include a substantially planar medial web portion, 192, that is generally rectangular in plan view (reflecting the generally rectangular plan form of container 20, more generally). An integrally formed bezel, or surround member 194 extends peripherally, and continuously, about web portion 192, much in the manner of a picture frame, or peripheral flange. Surround member 194 is generally rectangular in plan view, and interacts with the similarly rectangular plan view outline of the mouth of receptacle 30. If receptacle 30 were circular, or elliptical, or oblong, surround member 194 would also tend to be correspondingly circular, or elliptical, or oblong to permit satisfactory mating engagement, as described below. The peripherally outermost portion, or extremity, of surround member 194, is peripheral lip 190. Lip 190 lies in the plane of web portion 192 (although it need not do). Inwardly, of lip 190 is an upstanding (in the view of FIG. 4*c*), outwardly facing wall member 196. Wall member 196 terminates at an end wall portion 198 that extends in a plane generally parallel to the plane of web portion 192 (although end wall portion 198 could be a continuously radiused portion, or could be bevelled, as may be).

Lying peripherally inwardly spaced from outwardly facing wall member 196, is a generally inwardly facing wall member 200, that extends between the peripheral margin of web portion 192 and the inward margin of end wall portion 198. Inwardly facing wall member 200 has a number of sockets, or female engagement fittings 202 in the nature of round holes 204 formed therein for receiving protruding male engagement fittings 206 of thermal storage member 40. Two such female engagement fittings 202 are located in each of the side portions 208 of inwardly facing wall portion 200 to provide generally opposed engagement points for releasable retention of thermal storage member 40 in a nested position snug against lid 32 as indicated in FIG. 4*c*. It is preferred that holes 204 be blind, or capped to form sealed sockets.

Outwardly facing wall member 196 includes a seal member, or sealing fitting, 210, in the nature of an externally oriented bead 212 of marginally greater peripheral dimension then the land region 214 of an opposing wall of receptacle 30 at the mouth thereof with which bead 212 engages in an interference fit when lid 32 is moved to a closed position relative to chamber 50. As such, bead 212 provides a sealing means for discouraging leakage from receptacle 30 in the event of mishandling. That is, bead 212 engages the distal portion, or bead engaging land region 214 of a peripheral wall of receptacle 30 in an interference fit. The general structure of surround member 194 is somewhat resilient, and, by being formed in the bent shape illustrated, is somewhat like a spring when deflected, thus providing biasing against the tendency of bead 212 to be deflected by the rim, or flange, 118, of receptacle 30 when engaged in an interference fit. This may tend to provide a reasonable tendency to maintain a seal, without being unduly resistive to the opening of lid 32.

As noted above, lid 32 has a handle, or draw, or release member, namely handle 82, that is attached externally to lid 32, and that has a hook and eye fastening member (e.g., Velcro, t.m.) mounted on the inside of the tip thereof for engaging a mating hook-and-eye securement fitting 84 mounted to the forward facing region of front panel 62 below the upper margin thereof. When secured, the release member 82 may tend to secure, or lock, lid 32 in place. When lifted, the release member 82 may tend to aid in disengaging lid 32 from receptacle 30.

It may be noted that bead 212 is formed by having a cross section or a continuously radiused outer quarter round 216, that terminates at the straight portion 218 of outwardly facing wall portion 196 at a jog, or dog-leg 220. An alternative style of seal member is shown in FIG. 4*e*, where the straight portion 222 of an outwardly facing peripheral wall member 224 has an outwardly protruding, half round bead 226 of smaller radius than quarter round 216, inset a distance 8 from end wall 228. Once again, introduction or the surround member into the mourn of receptacle 30 will tend to cause bead 226 to be squeezed, thus tending to make a seal.

Figure 4D:
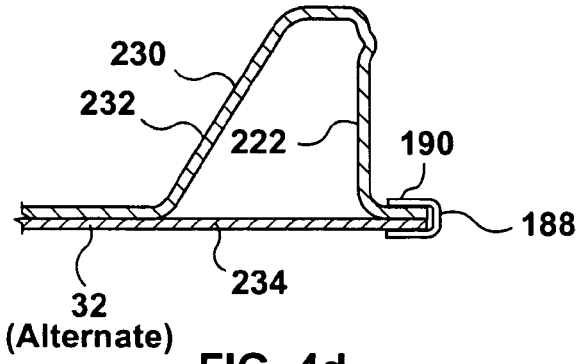
FIG. 4*d* shows an alternate cross-section to that of FIG. 4*c;*
Figure 4E:
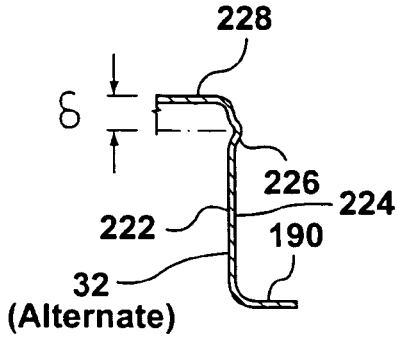
FIG. 4*e* shows an alternate cross-section of a sealing portion for the cross section of FIG. 4*c* or FIG. 4*d;*
Figure 5E:
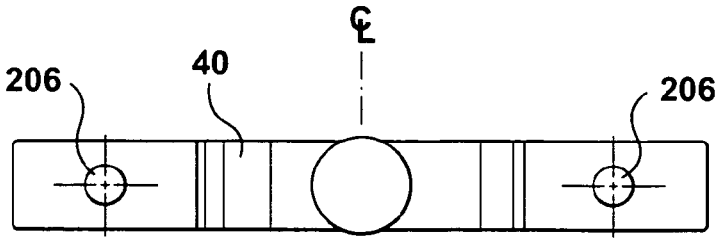
FIG. 5*e* is a filler end view of the thermal storage element of FIG. 5*a;*
Figure 5F:
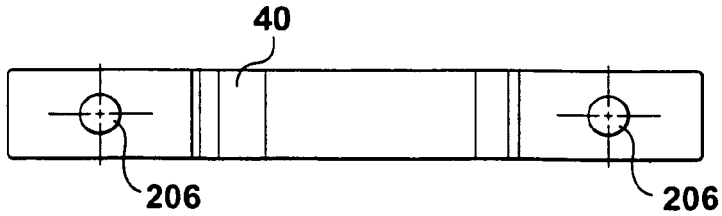
FIG. 5*f* is an opposite end view to that of FIG. 5*e;*
Figure 4F:
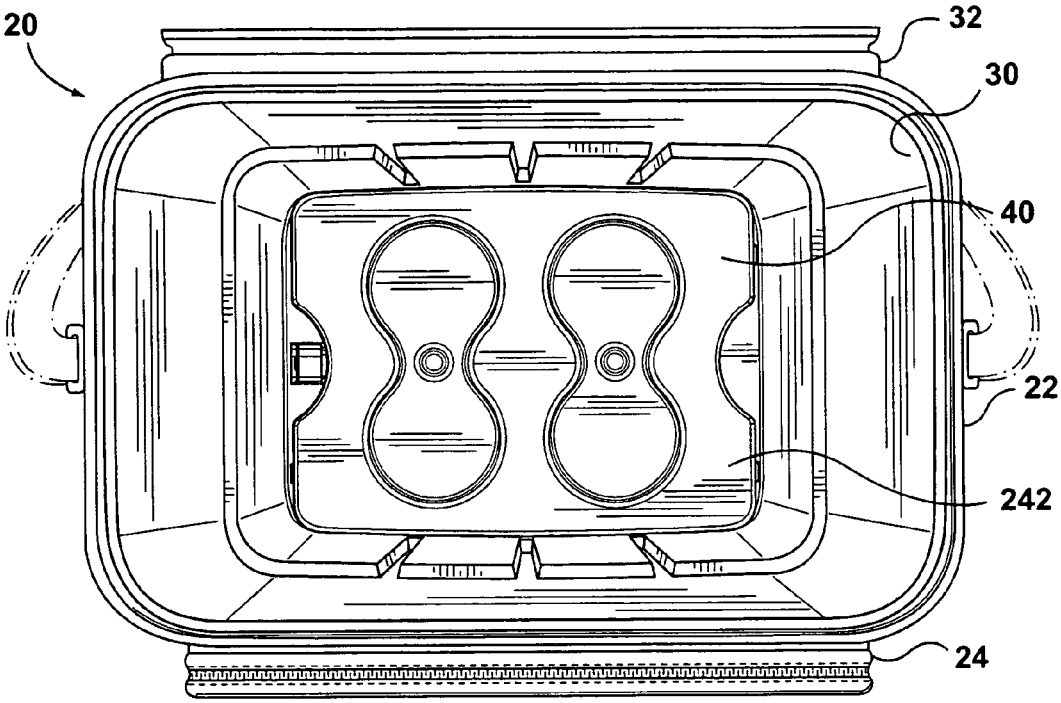
FIG. 4*f* shows an alternate installation of thermal storage member in the receptacle of the container assembly of FIG. 1*a;*

Further, where no internal thermal storage medium space is provided in lid 32, a different surround member 230 may be used as shown in FIG. 4*d*. In this instance, surround member 230 has an inclined inwardly facing wall member 232, in place of the straight wall, 200. In this example, as well, lid 32 is not provided with a thermally insulative layer such as insulating material 186, but rather, merely has an external fabric layer 234. That is, lid 32 may be insulated as in FIG. 4*c*, or uninsulated as in FIG. 4*d*. Lid 32 may have a surround member as in FIG. 4*c*, and no insulation, or, alternatively, lid 32 may have a surround member as in FIG. 4*d* with insulation.

In use, advancement of internal structural member 34 toward receptacle 30, as by pivoting motion about the fabric hinge joining lid 32 to rear panel 64, may tend to cause the progressive introduction of internal structural member 34, and most particularly, of peripherally extending seal fitting 210, into an interference fit engagement with the land region, 214, of the mouth of receptacle 30, just inside lip 118. As lid 32 is pushed further, more of seal fitting 210 engages land region 214, until there is, ideally, contact about the entire periphery of land region 214 and the entire periphery of internal structural member 34 at the contact interface of seal fitting 210 with land region 214.

When this occurs, bead 212 may tend to want to compress, and in so doing, a hoop stress may be generated in each of land region 214 and the outer wall 196 of internal structural member. This hoop stress, or peripheral, or circumferential stress, may tend to be a tensile stress in land region 214, and a compressive stress in outer wall 196, running in the peripheral direction. In an alternate embodiment, receptacle 30 may have a lip that engages a structural member of an alternate lid, otherwise generally similar to lid 32, on an inside, or inwardly facing peripherally extending wall, such that the land region of the receptacle would be in peripheral compression, and the engaging region of the lid would be in peripheral tension. It may also be noted that the surround portion of internal structural member 34 is, in effect, a short cantilevered beam extending perpendicularly to the plane of web 192 of lid 32 generally. Lateral external compression of bead 212 may tend to generate a resistive restoring moment couple in outer wall 196 (in tension in a direction perpendicular to web 192), and in corresponding compression in inner wall 200. As may be noted, the interface of seal fitting 210 with land region 214 is intended to be sufficiently tight that it may tend to resist re-opening. To that extent, the interface between lid 32 and the lower portion 22 of container assembly 20 may tend not to require a zipper, and may be zipperless, that is, free of any peripheral tracked fastener.

Thermal Storage Element 40

Thermal storage element 40 is shown in FIGS. 5*a* to 5*f*. Thermal storage element 40 has a first, generally planar main side 240, and an opposed, spaced apart, generally parallel opposite main side 242. The margins of sides 240 and 242 are peripherally joined by side edge walls 244, 246, and end walls 248 and 250, these elements co-operating to form a hollow container having a space 236 therein for containing a thermal storage medium 238. This thermal storage medium 238 may be water, whether hot, cooled, or frozen.

End wall 248 is a "filler end" wall, having a rebate, or relief in the nature of a cusp 252 of constant circular arcuate shape formed inwardly therein, and a threaded spout 254 moulded centrally in cusp 252, with a removable matingly engageable threaded cap 256 mounted on the spout. A user is thus able to fill thermal storage element 40 with water (or, indeed, with any other suitable thermal storage medium), to put thermal storage element in the freezer to freeze (or, alternatively, to put hot water, or other suitable heated thermal storage medium therein), and then, with cap 256 securely in place, to put thermal storage element 40 in container assembly 20. A similar cusp 258 is formed in end wall 250 directly opposite cusp 252, and provides a ready hand engagement point, or hand hold, or grip, for disengaging thermal storage element 40 from internal structural member 34. As noted above, end walls 248 and 250 also have externally protruding nubbinses, or blisters, detents or stubs in the nature of male retention fittings 206 for engaging the corresponding female retention, or engagement fitting 202 of surround member 194. It will be understood that the male fittings could be formed on the surround, and the female fittings could be formed on the thermal storage element. As the fit between the male and female engagement fittings is an interference fit, the adjacent portion of the inwardly facing surround wall must be deflected (and against its biasing force), such that the fittings 206 and 202 may tend to snap in place when matingly seated. Removal is by reaching into cusp 258, and disengaging thermal storage element 40.

The obverse face (that is of opposite main side 240) of thermal storage member 40 has a pair of recesses, or depressions 260 and 262 formed therein, the depression having a waist 264 and arcuate end portions 266. Arcuate portions 266 are generally circular arcs, and have a diameter suited to accommodating the bottom of a beverage container, such as a bottle or a drink can. Thermal storage member 40 can act as a seat for drinks either when lid 32 is open, and supported in a generally flat position, or when thermal storage member is supported in some other relatively flat orientation, such as when mounted on the bottom of receptacle 30 or when seated on partition 46 in a generally horizontal shelf configuration. Alternatively, and quite conveniently, thermal storage member 40 can be removed from container assembly 20, and set on a flat surface, such as a table, and drinks placed on it, or, if laid on the other side (with recesses 260 and 262 facing downward) with appetizers or other foods kept warm or cool on top of member 40 as may be suitable.

It is not necessary that container assembly 20 employ thermal storage element 40 in the lid only. On the contrary, thermal storage element 40 may be placed upon partition 46, or upon the bottom of receptacle 30, as may suit the user. Furthermore, container assembly 20 may have two, or three or several thermal storage members, whether supplied with container assembly 20 as part of the kit, or as an additional accessory made separately available at the point of sale.

Figure 4G:
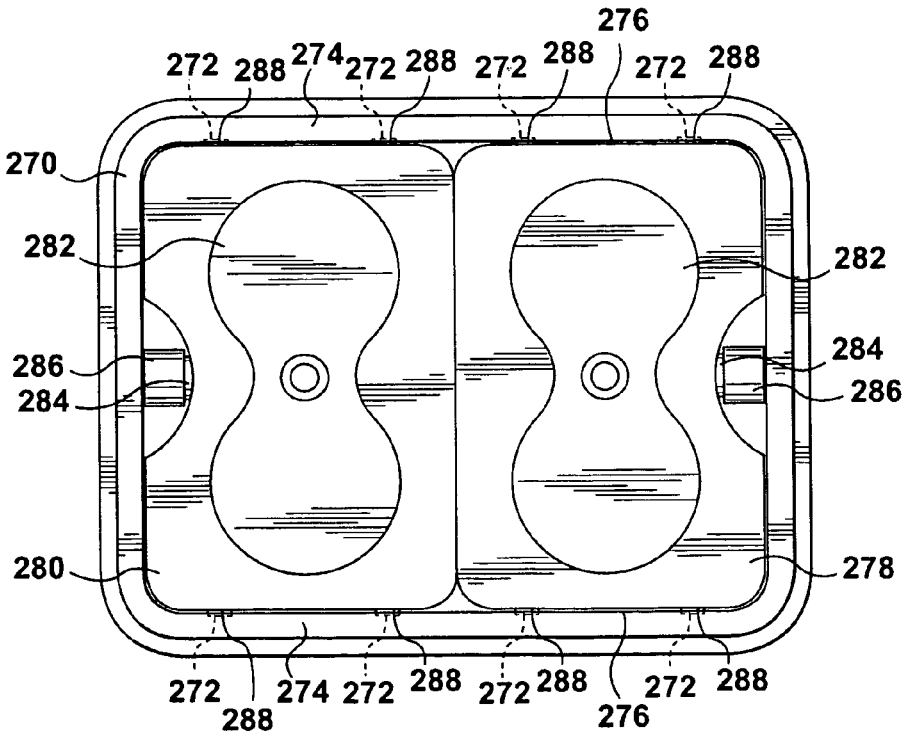
FIG. 4*g* shows an alternate installation of thermal storage members in a lid structural member similar to FIG. 4*a;*
Figure 5A:
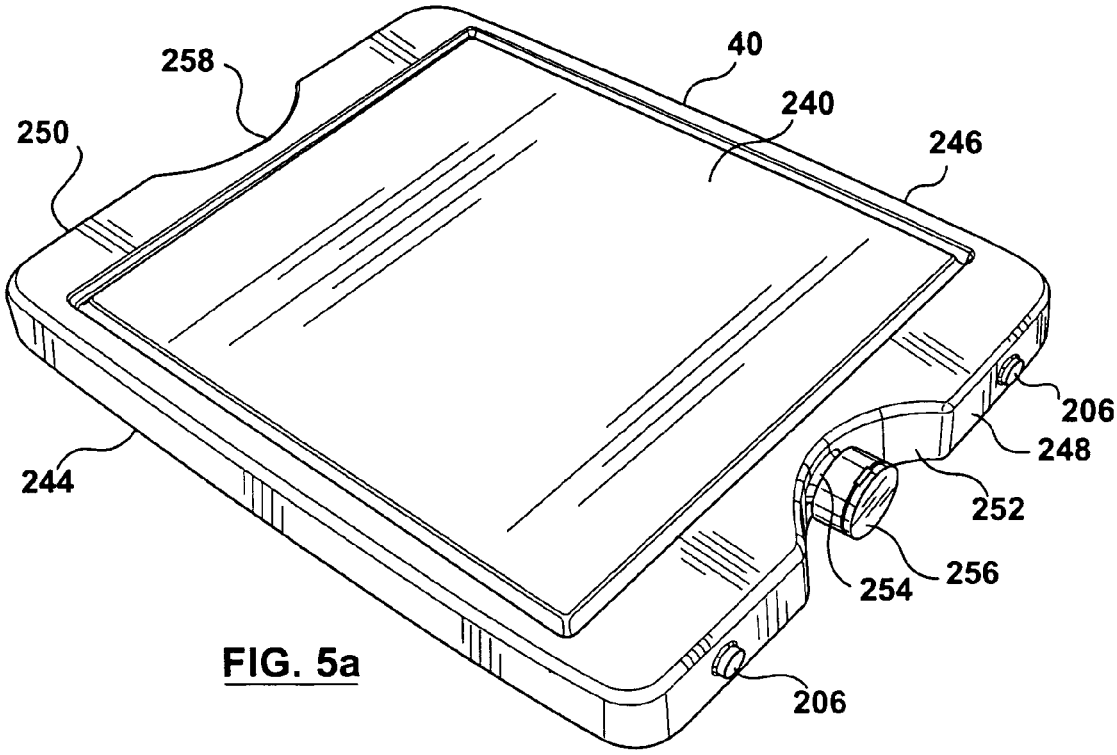
FIG. 5*a* is a diagonal perspective view from one corner of a thermal storage element as shown in FIG. 4*a;*
Figure 5B:
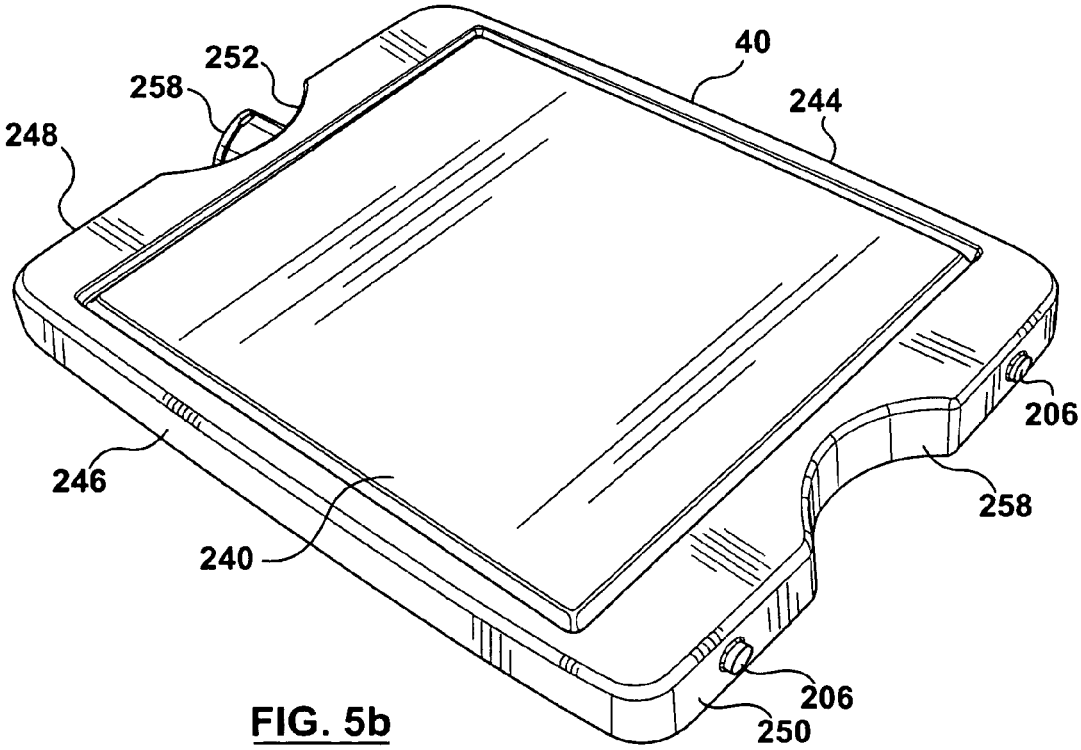
FIG. 5*b* is an opposite diagonal perspective view of the thermal storage member of FIG. 5*a;*
Figure 5C:
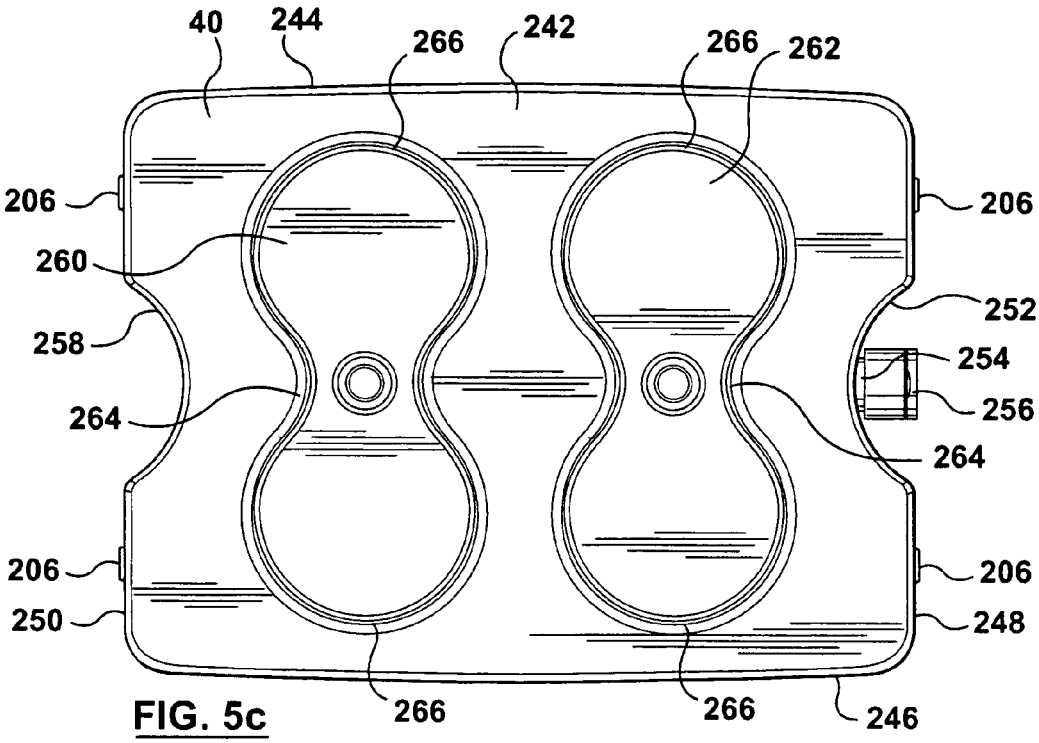
FIG. 5*c* is a top view of the thermal storage member of FIG. 5*a;*
Figure 5D:
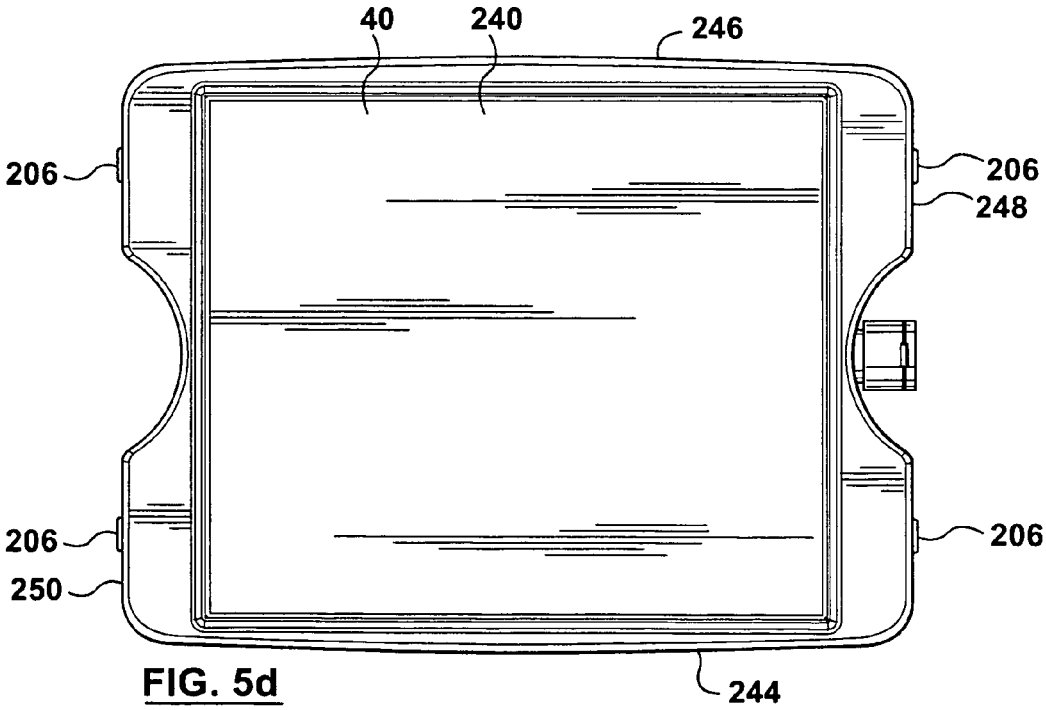
FIG. 5*d* is a bottom view of the thermal storage member of FIG. 5*a;*

An alternate thermal storage member arrangement is shown in FIG. 4*g*, in which an internal structural member 270 for placement in a lid structure, such as lid 32, and otherwise similar to member 34, has female engagement fittings 272 along the long edges 274 of its rectangular, inwardly facing wall portion 276. In this instance two thermal storage members 278, 280 are provided in a snap fit, side-by-side configuration. Thermal storage members 278, 280 are substantially the same as thermal storage member 40 in terms of construction, and the shape and size of recesses 282, threaded filler spouts 284 and caps 286, however with male engagement fittings 288 being mounted transversely as compared to thermal storage element 40. The principle difference is that members 278, 280 are "half size" versions of storage member 40. The use of two thermal storage members permits one, or both, to be used in the lid; one in the lid and one in the bottom of receptacle 30, both in the bottom of receptacle 30, or one or another on a shelf formed by partition member 46. It may thus tend to offer greater flexibility of variable configurations. As with thermal storage element 40, more than two thermal storage elements could be provided.

Auxiliary Wall Structure 24

Auxiliary wall structure 24 includes an outwardly and upwardly extending flap 294, a side wall 296, and a tracked closure member in the nature of a zipper 298 operable to control access to the interior of the space 300 defined between flap 294 and side panel wall 296. Flap 294 has an arcuate, padded lower portion 302 having a first margin attached to front panel 62, near the juncture of front panel 62 with bottom panel 60. Padded lower portion 302 extends upwardly and outwardly from that edge to an arcuate lateral seam 304. A padded, generally planar (when not pulled open) upper portion 306 extends upward from the upper margin of lower portion 302. Upper portion 306 has an external mesh pocket mounted thereto. Side wall 296 is formed in a U-shape, having depending lower portions 308 that are mated to lower portion 302, upwardly extending side portions 310, 312, and a curved central portion 314 extending therebetween, the inner margins of items 310, 312 and 314 being sewn to the front face of front panel 62 of first insulated container portion 22, and the outer margins having one half of a tracked closure member, in the nature of zipper 298 mounted thereto, for co-operation with the other half of zipper 298 that is mounted to the upper margin of flap 294, to whose shape the outer margins of items 310, 312, 314 conform. Upper curved central portion 314 has an eyelet 318, of two overlapping flaps to admit an electronic jack, or plug 320, of a head set such as may be plugged into an entertainment unit, which may be a music playing device, such as device 322, which may be a CD player, a cassette player, a portable radio, or, as in the preferred embodiment, an entertainment unit combining all three capabilities. An internal pouch 324 having an elasticized upper lip 326 is provided for receiving the entertainment unit, and such cassettes or compact discs as may be desired by the user. Alternatively, item 324 may have an internal space 330 suitable for accommodating knives, forks, spoons, napkins, and other items such as may be desired for a picnic. Internal gussets 332 extend between the lateral margins of pouch 324 and the opposed margins of front flap 294 acting to limit the extent to which flap 294 can be opened, and thereby discouraging it from opening to such an extent that objects contained therein may too easily fall out. The termination points of zipper 298 extend to a lower height than the upper margins of gussets 332. A generally triangular lifting lug is mounted to front panel 62 adjacent to eyelet 318. While item 324 is not thermally insulated, flap 294 is fabricated with an internal layer of rubberized padding that is intended to provide a measure of protection against rough handling to such electronic equipment or other objects as may be carried therein.

Alternate Lid Surface

Figure 6A:
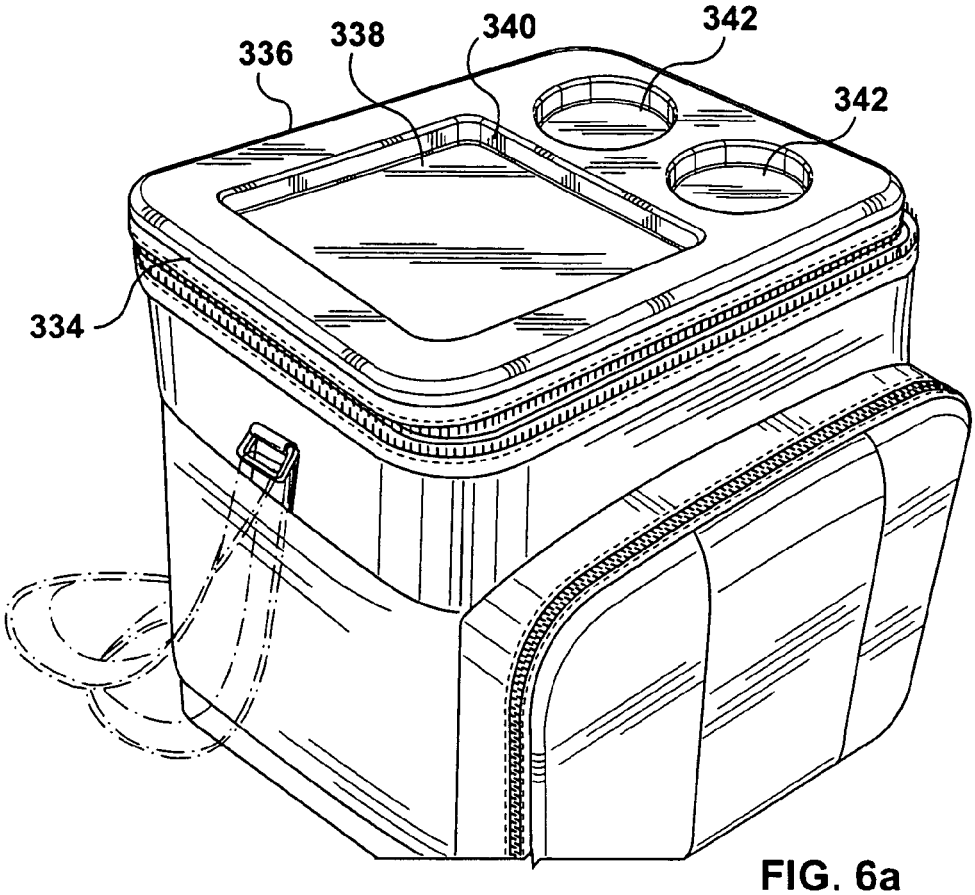
FIG. 6*a* is a view of an alternate foam lid construction for the container assembly of FIG. 1*a;*
Figure 6B:
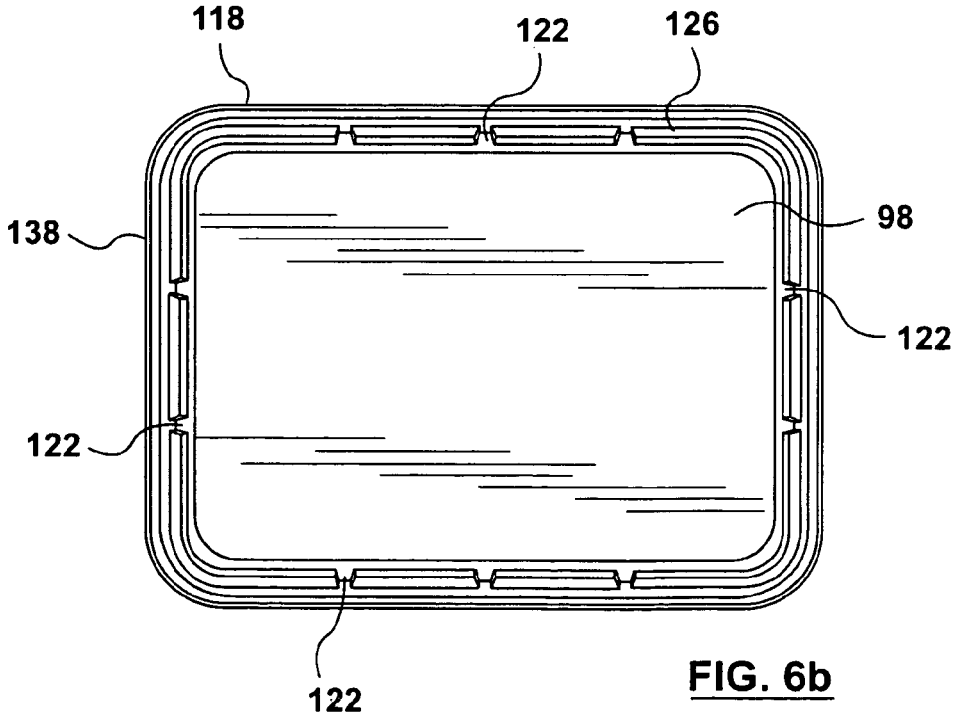
FIG. 6*b* is a top view of an alternate receptacle structure to that of FIG. 3*a.*
Figure 7A:
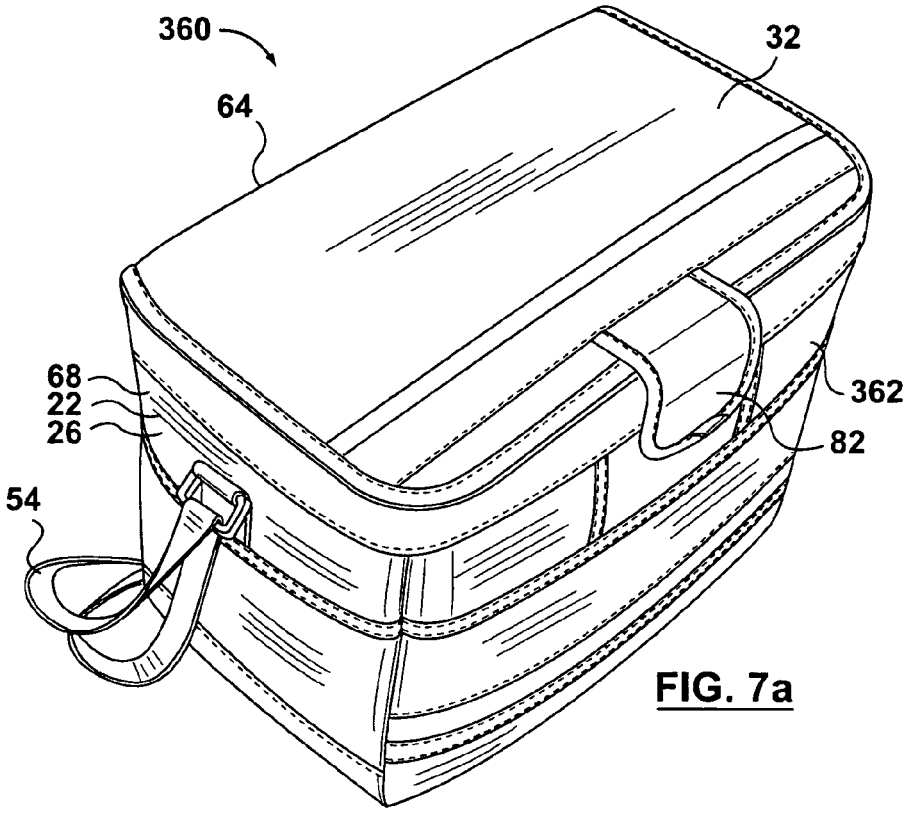
FIG. 7*a* shows a perspective view from above, in front, and to one corner of an alternate embodiment of container assembly to that of FIG. 1*a;*
Figure 7B:
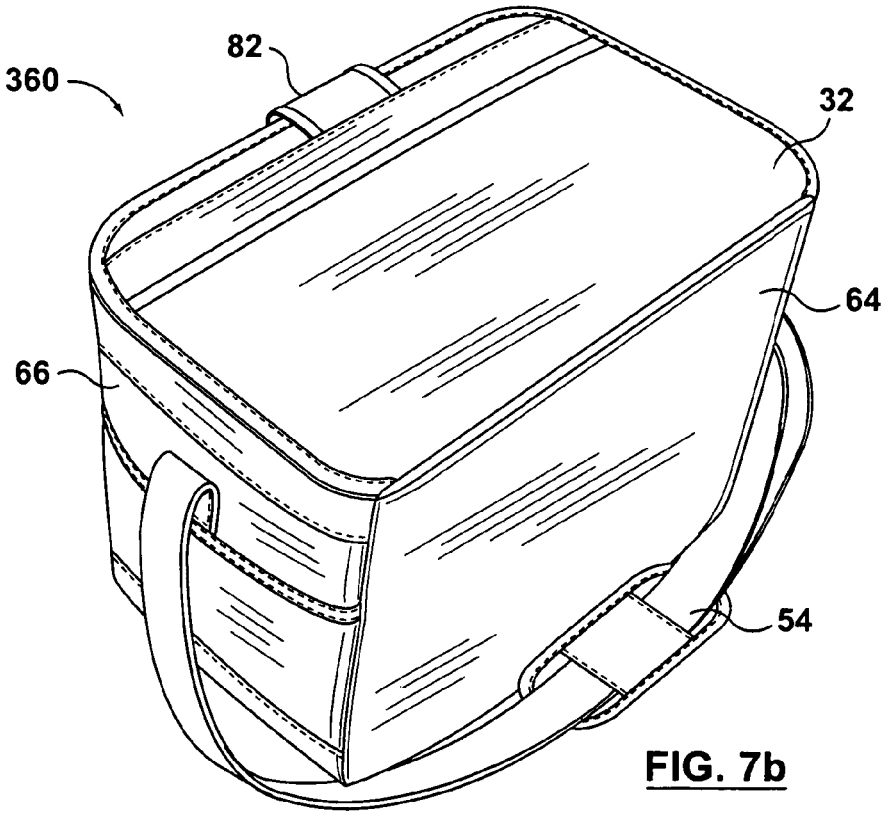
FIG. 7*b* shows a perspective view of the container assembly of FIG. 7*a* taken from the opposite upper diagonal prospect.
Figure 7C:
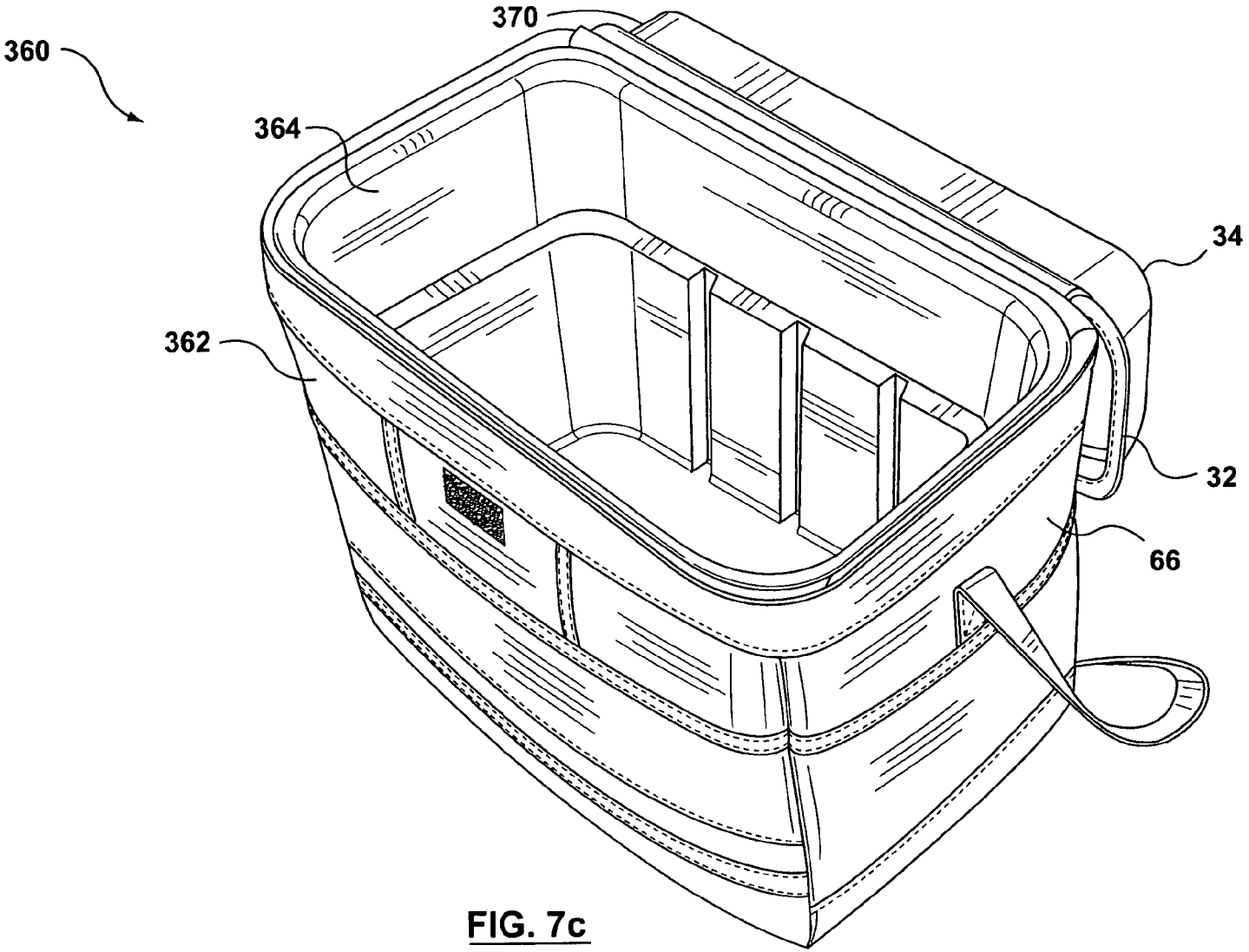
FIG. 7*c* shows a perspective view from the front right corner, and above, of the container assembly of FIG. 7*a* in an open condition.
Figure 7D:
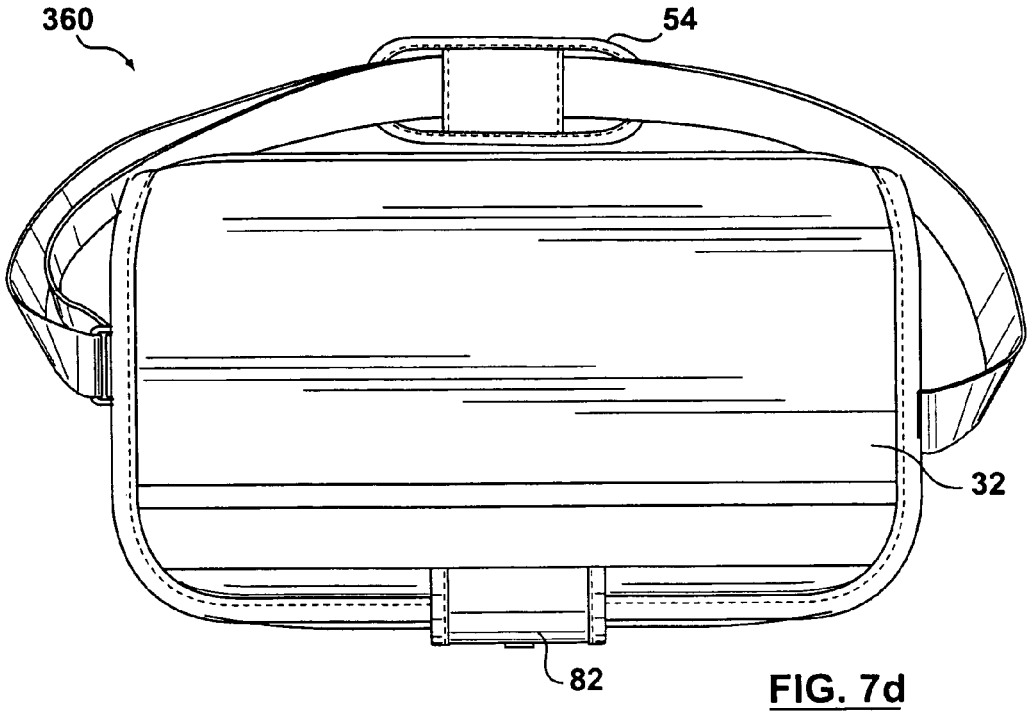
FIG. 7*d* shows a top view of the container assembly of FIG. 7*a;*
Figure 7E:
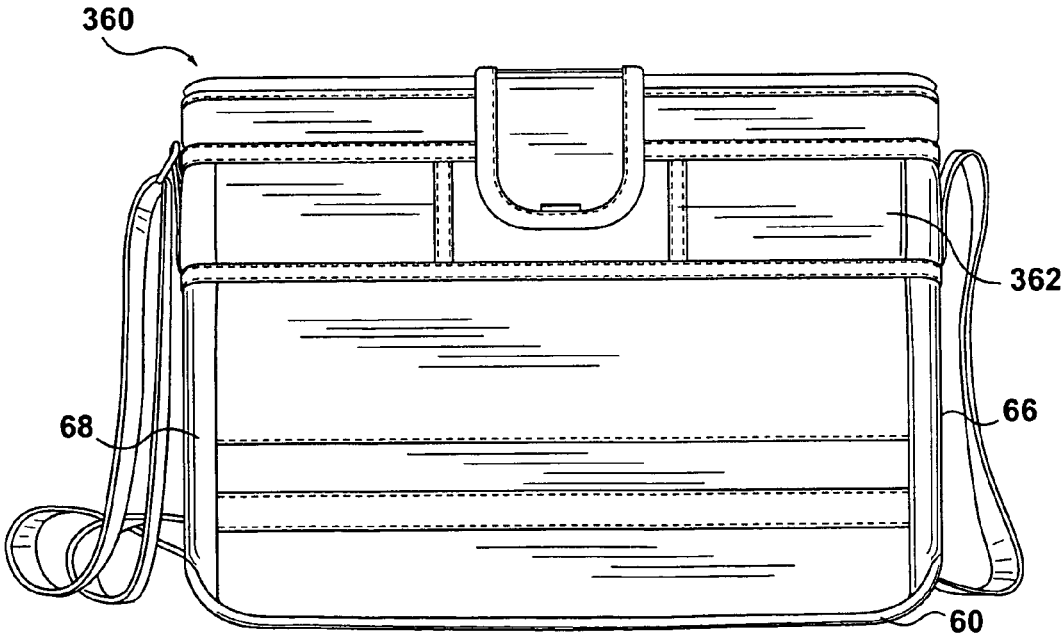
FIG. 7*e* shows a front view of the container assembly of FIG. 7*a;*
Figure 7G:
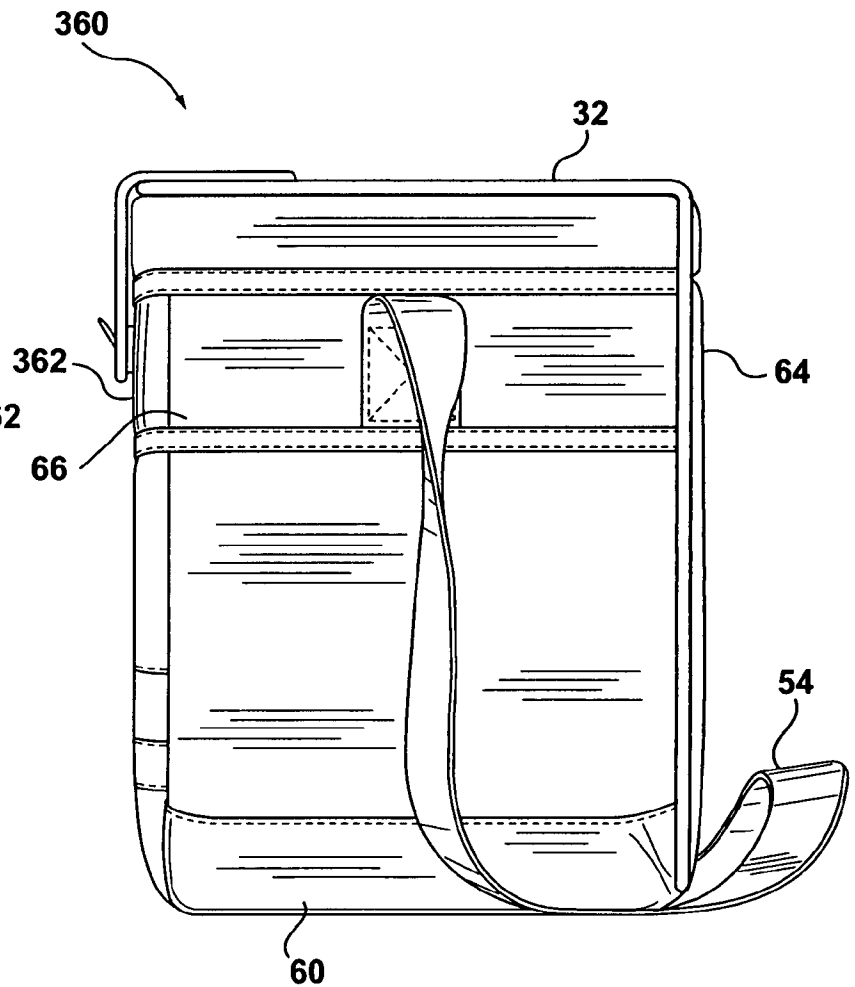
FIG. 7*g* shows a right hand side view of the container of FIG. 7*a;*
Figure 7F:
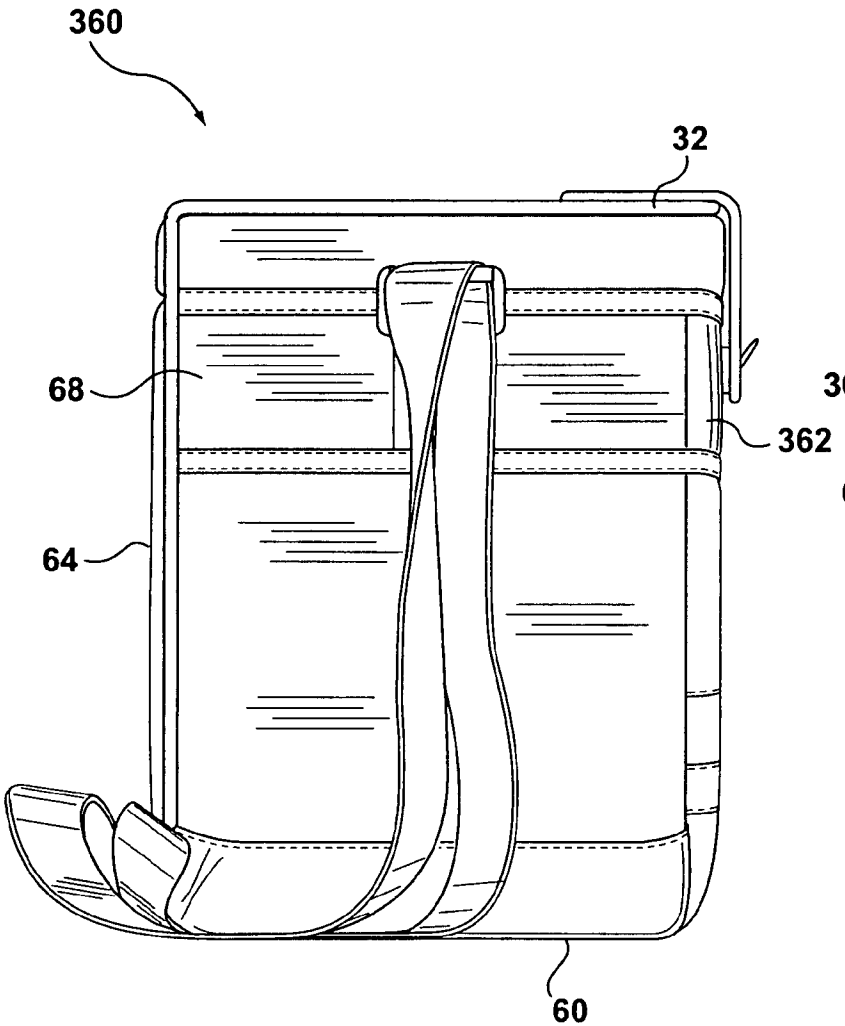
FIG. 7*f* shows a left hand side view of the container assembly of FIG. 7*a;*
Figure 7H:
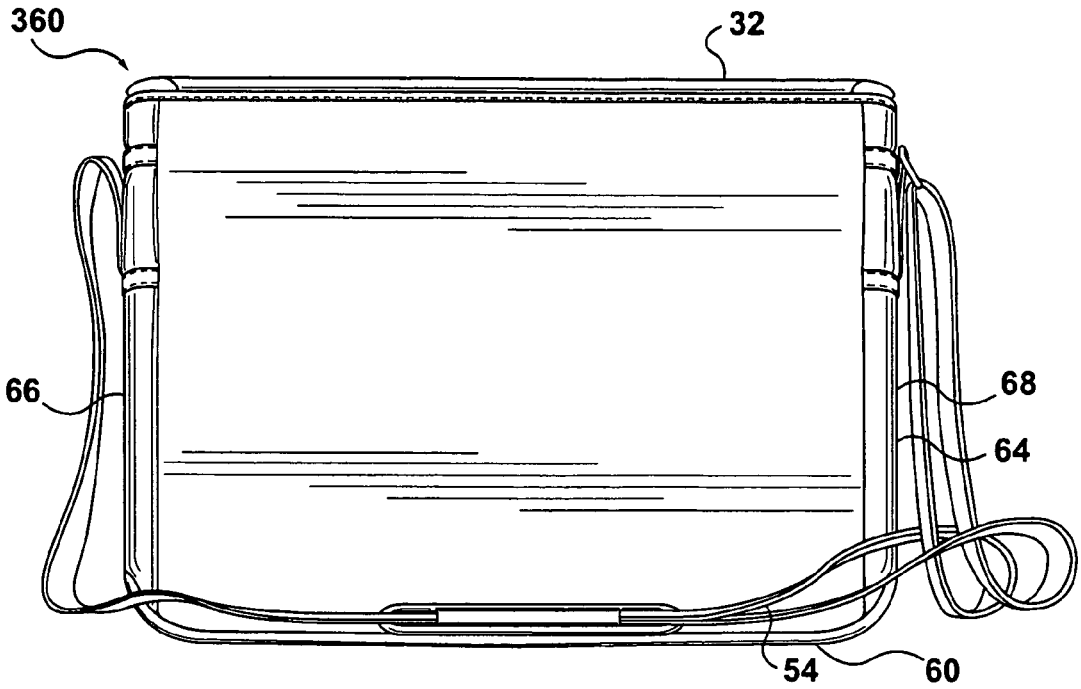
FIG. 7*h* shows a rear view of the container assembly of FIG. 7*a;*
Figure 7I:
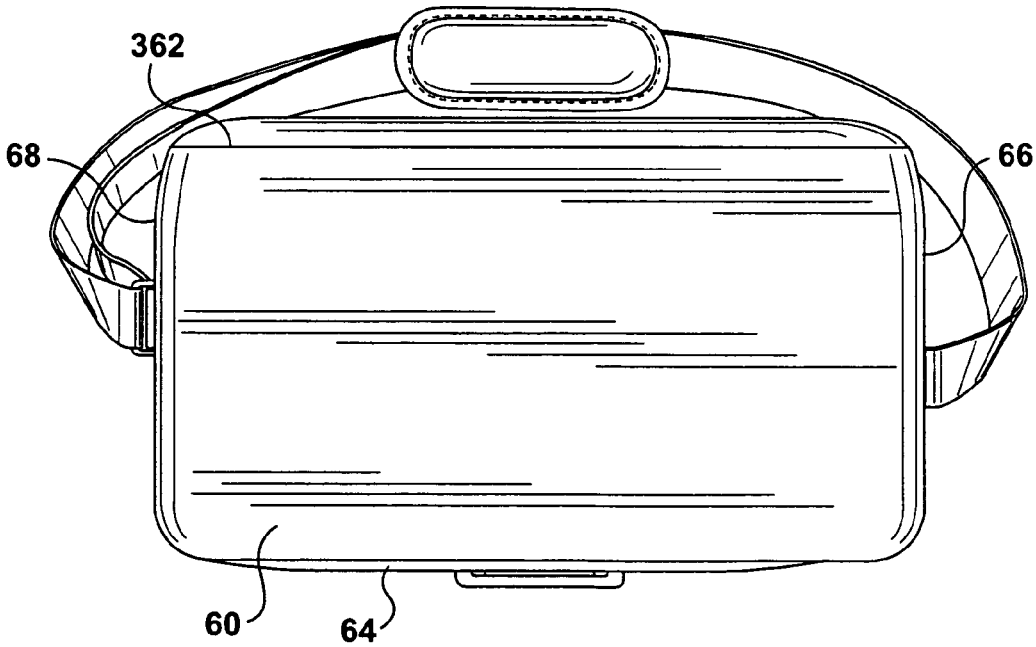
FIG. 7*i* shows a bottom view of the container of FIG. 7*a;*

Lid 32 may have the structure shown in FIG. 4*c* or 4*d*, or some combination thereof, or, alternatively, may have the structure of alternate lid 334 shown in FIG. 6*a*. In this instance, rather than using a relatively low density closed cell foam, as in FIG. 4*c*, a relatively high density, relatively stiff molded foam is used to yield a generally rectangular table top portion 336 in the nature of a recess 338, having a four sided peripheral containment wall 340 such as may tend to discourage objects from sliding away, even if lid 334 is not precisely level, or if container assembly 20 is bumped or jostled, or carried in an automobile. Lid 334 also has a pair of circular recesses, or depressions 342, having annular sidewalls that may, again, tend to serve to steady a beverage placed thereon. Such a lid as 334 may provide a convenient containment surface for foods and beverages at a lunch stop or picnic. In one embodiment, recess 338 may be roughly 6" (+/−) long×6" (+/−) wide by about ½" (+/−) deep, and depressions 342 may be about ⅜" (+/−) deep, and may be sized comfortably to receive a 12 oz (385 mL) drink can.

FIGS. 7*a* to 8*h*

FIGS. 7*a* to 8*h* show views of an alternate embodiment of a container assembly to that of FIG. 1*a*. Container assembly 360 is substantially similar to container assembly 20, and to the extent that they share common features, those features are given common items numbers, although they may differ in size, shape, or aspect ratio. Soft-sided insulated container assembly 360 may differ from container assembly 20 in that container assembly 360 may have a clear front wall panel 362 that does not have an auxiliary wall structure, such as auxiliary pouch 24 mounted thereto. Further, while container assembly 360 may have a receptacle 364, and a multi-position removable pliable divider, identified as partition 366, and a mating lid 368 having a seal member 370 engageable with the land region 372 adjacent to the lip edge of the mouth of receptacle 364, container assembly 360 may not include a removable thermal storage element similar to removable thermal storage element 40 described above.

It may also be noted that container assembly 360 has a different aspect ratio from container assembly 20, being roughly twice as wide along the long face as along the short face when viewed from above. Partition 366 is an asymmetric divider having a first panel portion 374 of roughly half size, a second panel portion 376 hingedly adjacently connected thereto of roughly one quarter size, and a further end portion 378 hingedly connected to portion 376 and having two apertures 380 similar to those described above.

In an alternate embodiment, a thermal storage element of corresponding aspect ratio, otherwise like thermal storage elements 278 or 280, may be installed in removable engagement in lid 368, in a manner analogous to that described above. Whether or not such provision is made, thermal storage elements akin to thermal storage element 40 may be place within container assembly 360, either at the bottom of the receptacle, or mounted on partition 366.

FIGS. 9*a* to 9*l*

A further alternate embodiment of container assembly is shown in FIGS. 9*a* to 9*j*. In this embodiment, a soft sided, insulated container assembly is indicated generally as 400. Container assembly 400 has a base, identified as bottom panel 402, an upstanding sidewall 404 having a front panel 406, a rear panel 408, a right hand side panel 410, a left hand side panel 412, and a top panel functioning as a hingedly attached lid 414. A secondary, or auxiliary wall structure 416 is mounted to front panel 406 in the same general manner as auxiliary wall structure 24. The wall structure of panels 402, 406, 408, 410, and 412 is generally as described above in the context of container assembly 20.

Figure 9B:
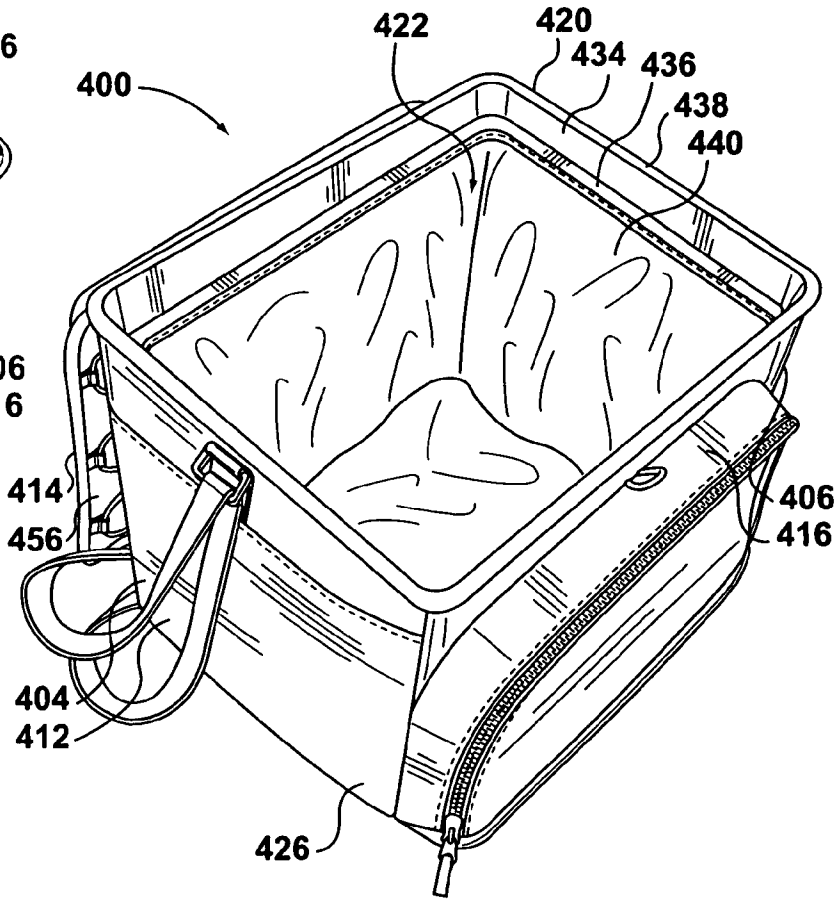
FIG. 9*b* is a perspective view from above, in front, and to one corner of the container assembly of FIG. 9*a* in an open position.
Figure 9A:
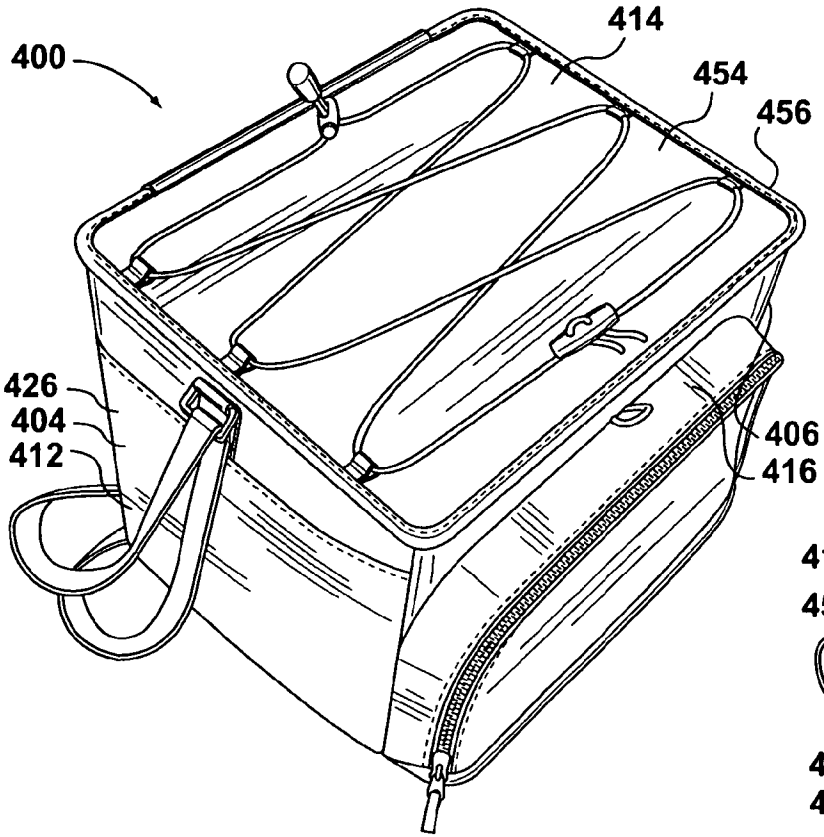
FIG. 9*a* shows a perspective view from above, in front, and to one corner of a further alternate embodiment of container assembly to that of FIG. 1*a;*
Figure 9C:
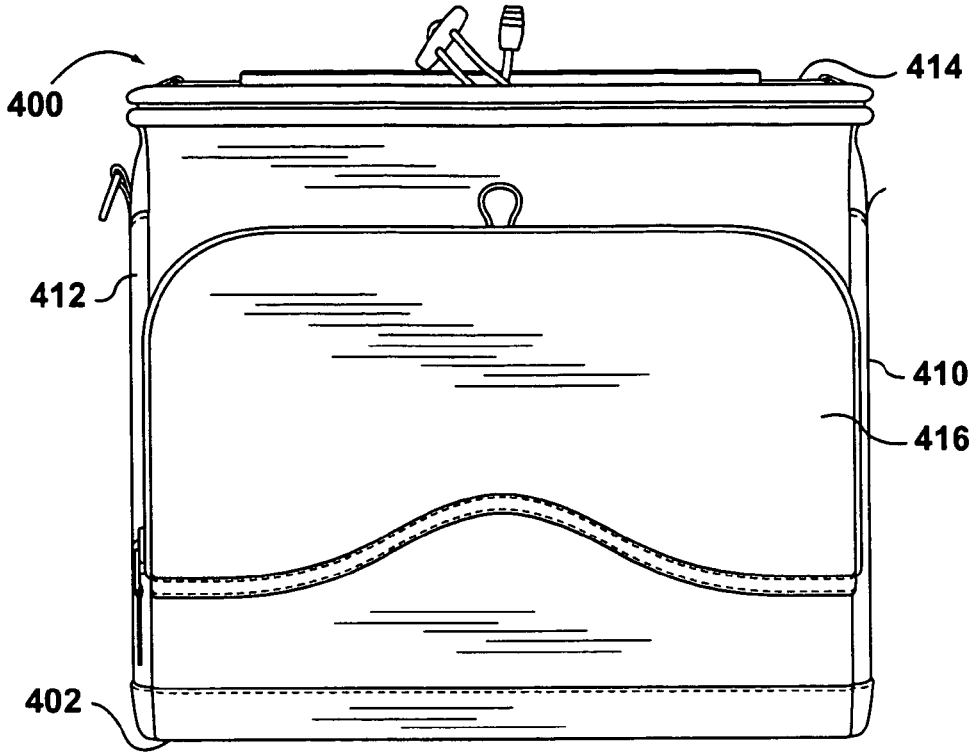
FIG. 9*c* shows a front view of the container assembly of FIG. 9*a;*
Figure 9F:
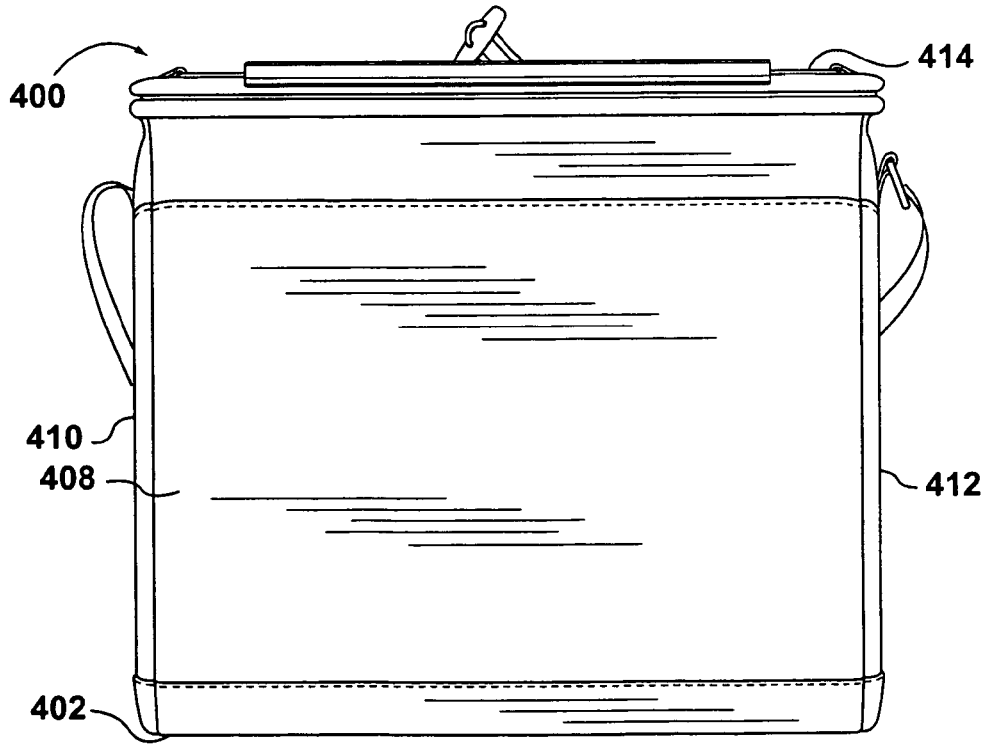
FIG. 9*f* shows a rear view of the container assembly of FIG. 9*a;*
Figure 9E:
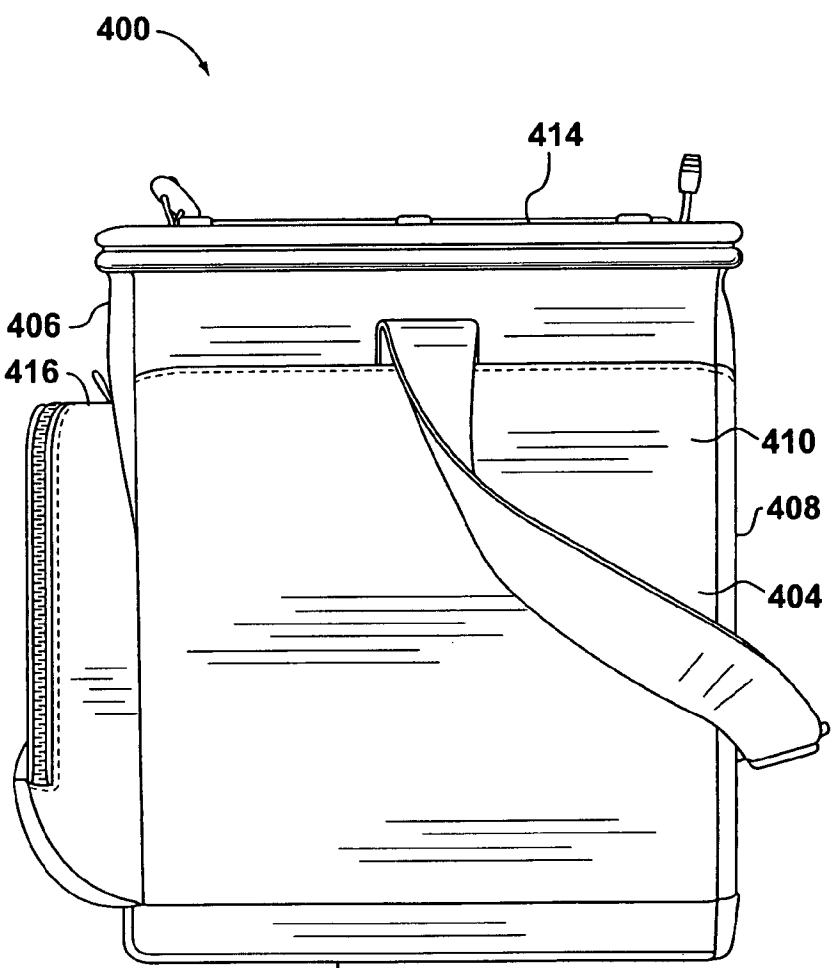
FIG. 9*e* shows a right hand side view of the container of FIG. 9*a;*
Figure 9D:
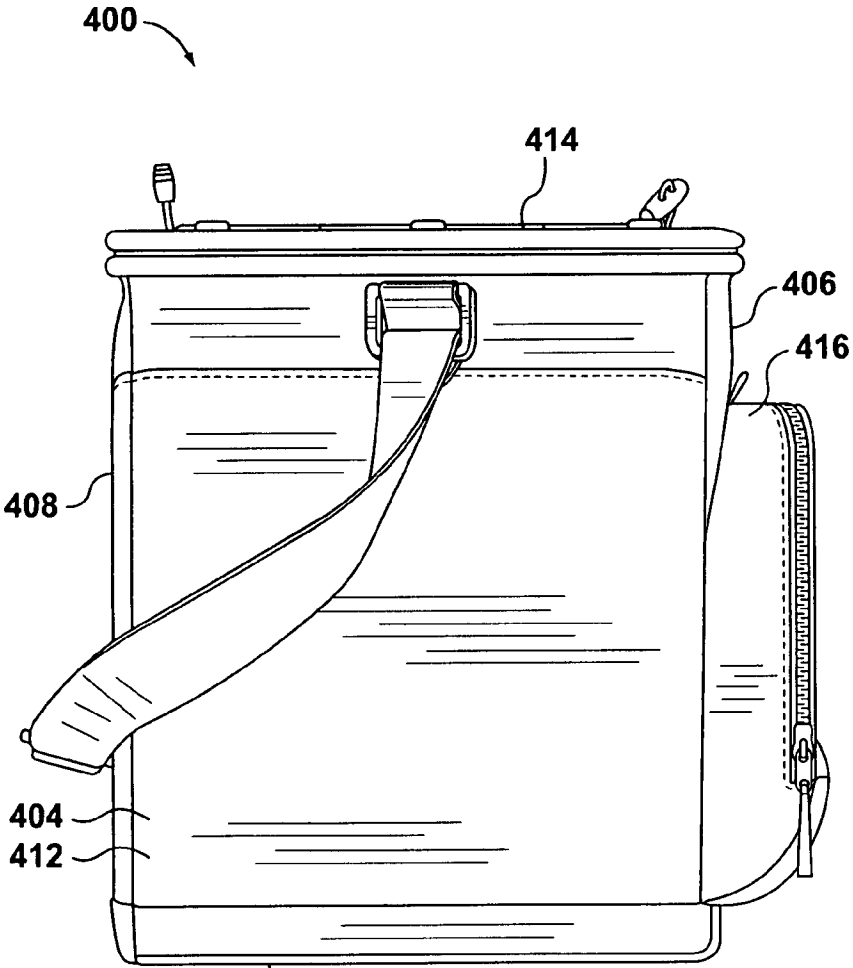
FIG. 9*d* shows a left hand side view of the container assembly of FIG. 9*a;*
Figure 9G:
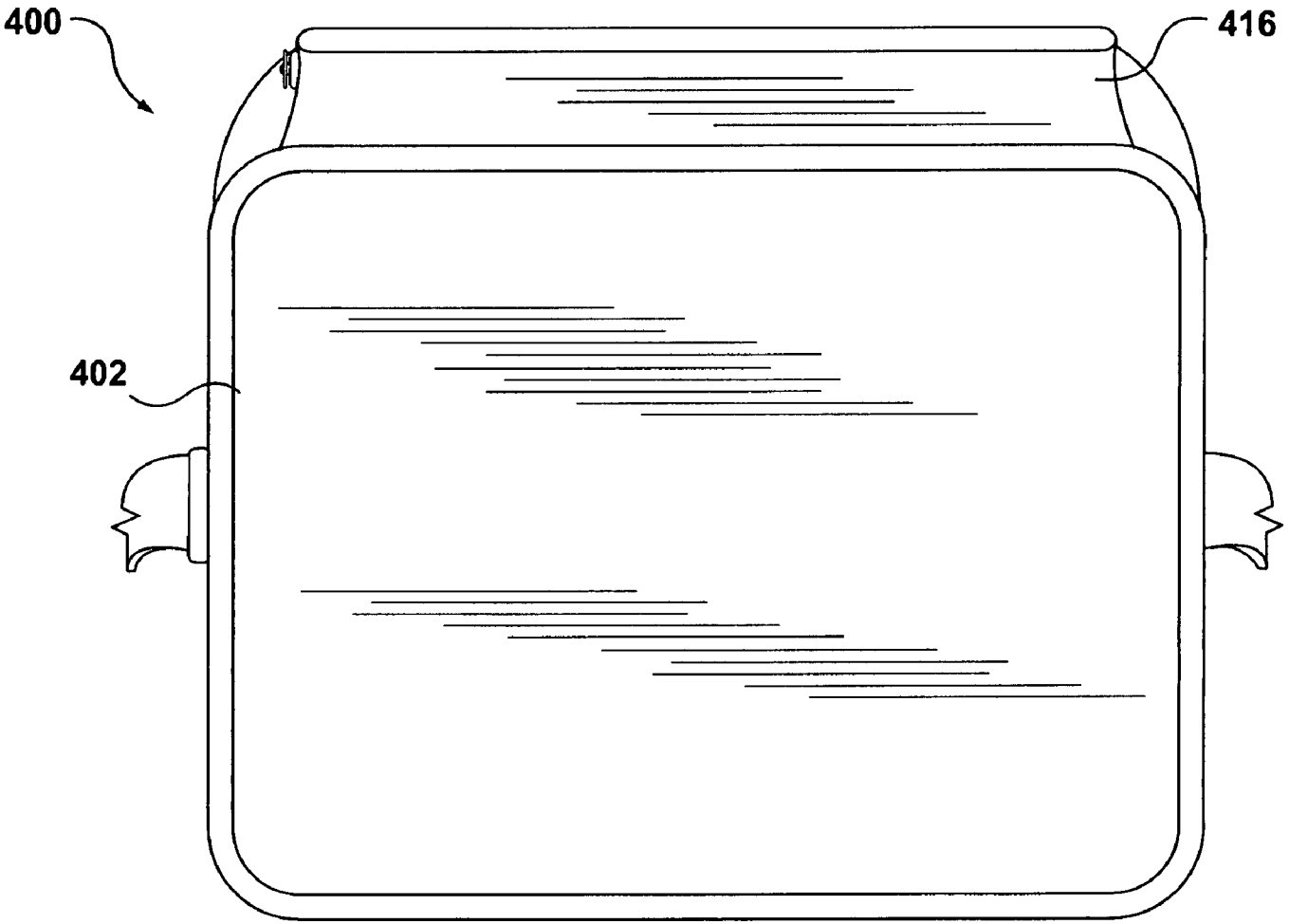
FIG. 9*g* shows a bottom view of the container of FIG. 9*a;*
Figure 9H:
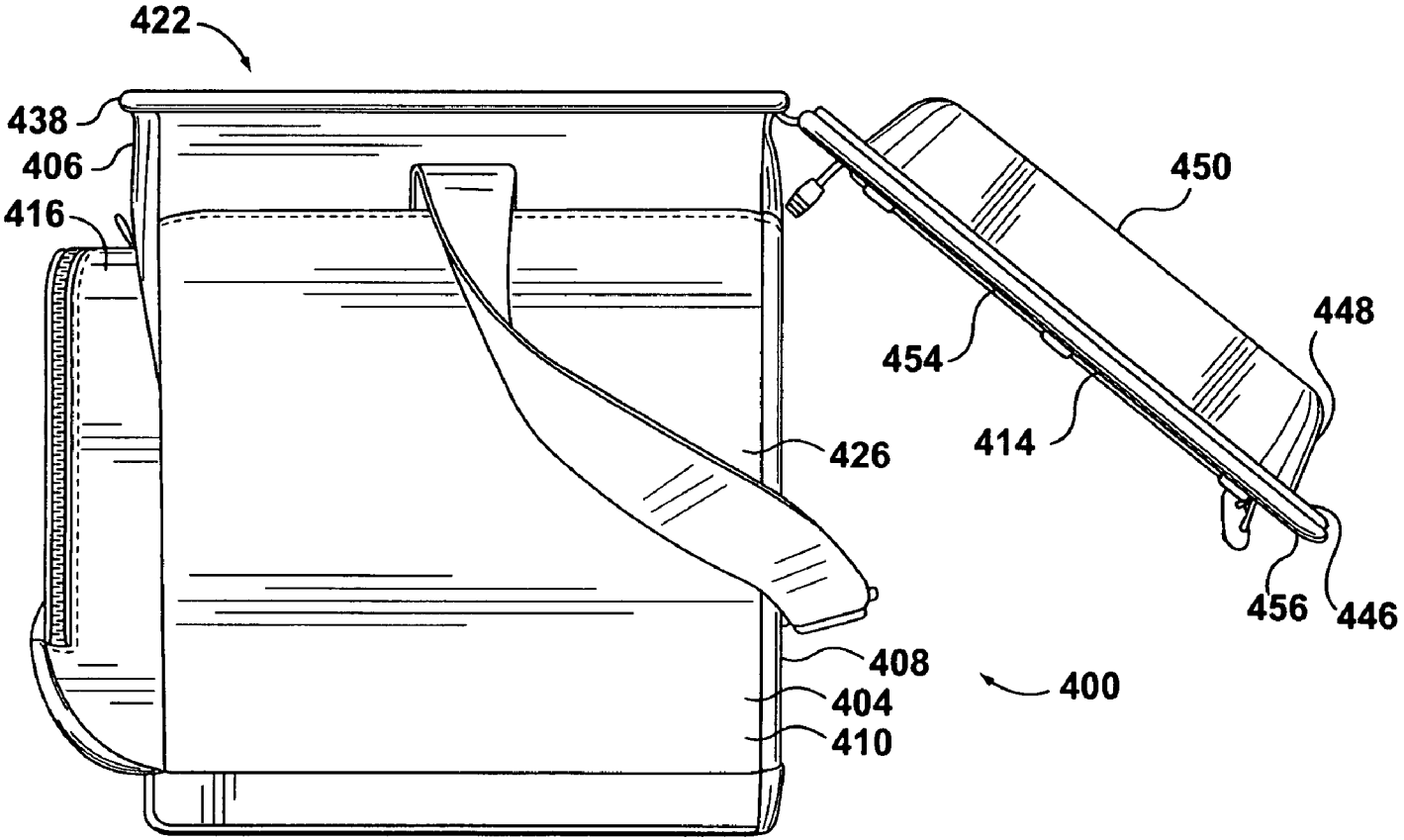
FIG. 9*h* is a side view of the container assembly of FIG. 9*a* in an open position.
Figure 9I:
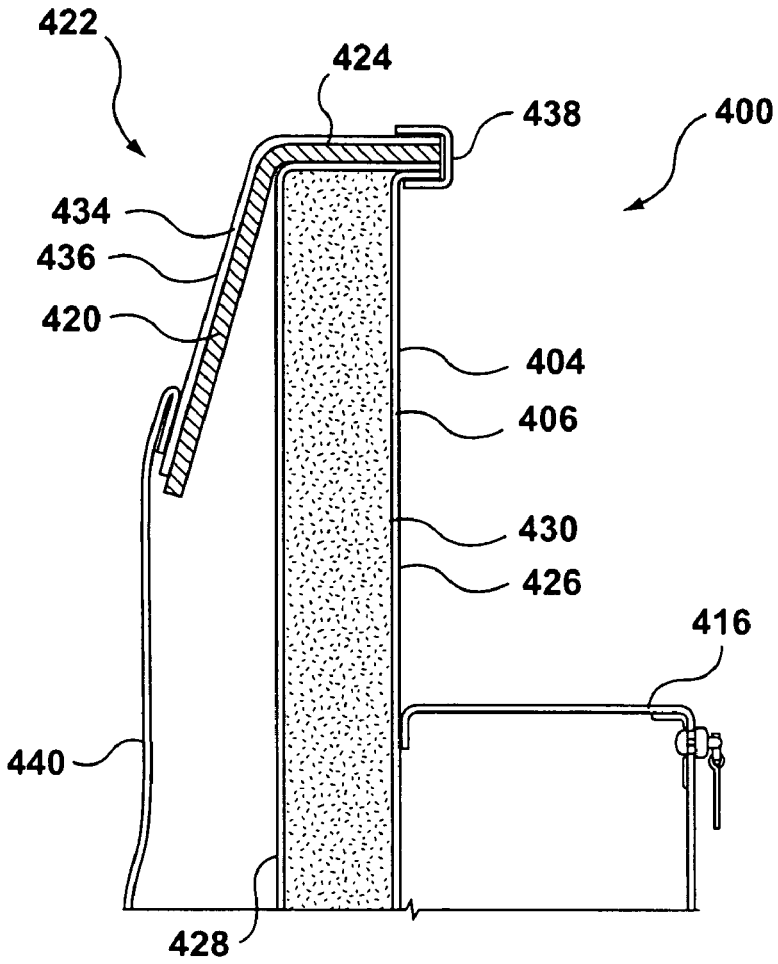
FIG. 9*i* is a scab cross-section of a sidewall portion of the container assembly of FIG. 9*a;*
Figure 9J:
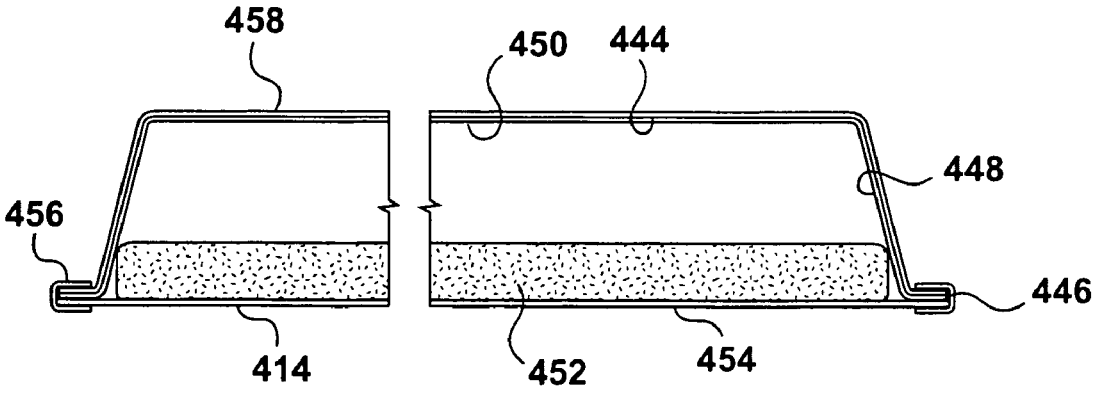
FIG. 9*j* is a cross-section of a lid portion of the container assembly of FIG. 9*a;*

However, rather than having a rigid, molded, water holding internal receptacle, such as might be generally similar to receptacle 30, container assembly 400 has a peripherally running, inwardly extending reinforced cuff 420, that is generally rectangular in plan view to conform to the generally rectangular opening 422 defined by the upper edges of wall panels 406, 408, 410, 412. In cross-section as seen in FIG. 9*i*, cuff 420 has a first, generally horizontal, relatively short leg 424 that surmounts the underlying wall structure, that wall structure having an outer layer, or covering 426, typically of a relatively durable wear resistant woven nylon, an internal layer or covering of vinyl, 428, and a closed cell thermal insulation layer 430 sandwiched between the inner and outer layers. It should be noted that the thicknesses of the various layers are exaggerated in FIG. 9*i* for the purpose of illustration. Cuff 420 also has an inwardly and downwardly extending skirt, or inner leg 432. Leg 432 is relatively long as compared to leg 424. Leg 432 may have a slope of the order of between 4:1 and 10:1 in terms of rise over run, such that a tapered, or convergent opening is formed, defining a peripherally extending land, or land region, 434. Cuff 420 may typically be made of a substantially rigid material, such as molded plastic. A coarsely woven covering 436 is stretched to overlie cuff 420, and is secured about its outer peripheral edge at a seam driven through an external edge trim bead 438, covering 436, the distal margin of leg 424, and the edges of inner and outer layers 426, 428. A flexible, waterproof liner 440 is seamed to covering 436 at a mid-level position, and hangs downwardly over the lower margin of cuff 420, the lower region of liner 440 conforming to the generally rectangular box defined between the sidewall panels, and resting upon base panel 402. Liner 440 may typically be made of relatively thick waterproof vinyl, and covering 436 may tend to be made from a relatively coarse, relatively high friction woven material which may be cotton, or a cotton blend.

Lid 414 includes a molded structural reinforcement member 444 having a generally rectangular form in plan view with a generally planar peripheral edge portion 446, a tapered transition wall portion 448, and a generally planar rectangular central portion 450 that may lie in a plane parallel to the plane of edge portion 446. The resultant shape may tend to resemble a rectangular pan with turned up edges and a peripheral lip. An optional layer of closed cell thermal insulation 452 may be placed inside the pan, and an external covering layer 454, which may typically be of woven nylon, to which the insulation may be mounted, may be stretched over the pan, and secured to edge portion 446 by a seam driven through the edges of peripheral bead 456, layer 454, and edge portion 446. Also secured by bead 456 is a relatively rough, coarsely woven inner lid covering 458, such as may be made of a rough fabric material such as coarse cotton, or a blend thereof.

In use, the corresponding mating tapered faces of transition wall portion and leg 434 may tend to engage in an interference jamming fit, like a wedge, or cork, or stopper, in the mouth of a bottle. This tendency is enhanced by the use of the roughened surface coverings, that are intended to provide a relatively high level of friction between the surfaces and therefore a tendency to resist, somewhat, the tendency to open unduly easily. In this case the land is, as indicated, merely a cuff of suitable size and location to engage the interfering, protruding bull nose of the lid.

In an optional, alternate embodiment, lid 414 may be provided with a formed plastic peripheral bezel member suitable for receiving a removably engageable thermal storage 30 element, such as removable thermal storage member 40, described above.

FIGS. 10*a*-10*l*

In FIGS. 10*a*-10*l*, an alternate embodiment of container assembly is indicated generally as 460. Container assembly 460 has the general form of a six sided box, having a front panel 462, a rear panel 464, a right hand side panel 466, a left hand side panel 468, a top panel 470, and a bottom panel 472. An insulated storage compartment, identified generally as 474 is defined within the six sided box. A secondary wall structure 476 is mounted to front panel 462 and may include a generally 4-sided outstanding wall 478, and a movable panel member 480 that is operable to govern access to the interior of an auxiliary storage compartment 482 defined between panel member 480, panel 462 and outstanding wall 478. Movable panel member 480 may be secured about 3 marginal edges thereof by a releasable tracked fastener, such as zipper 481. The wall structure of the auxiliary storage compartment may be insulated, or may be un-insulated. For the purposes of this description, a single layer of nylon or vinyl may be generally understood not to define an insulated wall. The term insulated wall, or insulated member, may be understood to include a layer of insulating material, such as an open or closed cell foam, as distinct from merely a layer of webbing, an interior liner web, or a covering layer of plastic or woven fabric. Container assembly 460 may also include a lifting or transport member such as may be in the nature of a carrying strap, 484, which may be mounted to a lifting fitting such as a ring mount 486 which may be mounted on opposite side panels as at 488 in the upper regions thereof.

The wall construction and closure of container assembly 460 may differ from the assemblies shown and described above. For example, a cross-section of the front or rear panel, or the sidewall panels, may include an outer covering layer 490, such as may be made of vinyl sheet, woven Nylon, leather, woven polyester, or other suitable fabric or webbing material, and which may include a wear resistant surcoat; and inner covering sheet or lining, or layer 492. A layer of thermally insulating material, indicated generally as 494, is sandwiched between the inner and outer layers 490 and 492. This thermally insulating material may be an open or closed cell foam, or other suitable material tending to discourage heat transfer from objects within container assembly 460 and the outside environment. This thermally insulating material may be substantially non-rigid, and may tend to flex, bend, fold, or stretch relatively easily.

In addition, the wall structure may include a stiffener, or reinforcement, or batten, indicated as stiffening member 496. Stiffening member 496 may be a sheet of relatively high density plastic, such as nylon, polyethylene, PVC, or cardboard, of greater stiffness than the insulating layer, for example, and, in some embodiments, may be in the range of 0-020" to about ⅜" thousandths of an inch in thickness. Stiffening member 496 may be located between outer covering layer 490 and the layer of thermally insulating material, 494. Each of the upstanding sidewall portions, namely panels 462, 464, 466, 468, may have a reinforcement, or backing, in the nature of a stiffening member such as member 496. Such backing member may extend the full height of its respective panel, or may extend along the upper margin of the respective panel, and extend downwardly only a portion of the height. While the skirt may extend the entire lengths or a portion of the length of the sidewalls, in one embodiment, the panels may form a hardened skirt extending about 4 inches (10 cm) from the rim or lip of the opening downward, or, this may alternatively be expressed as ⅕ to ⅓ of the overall height of the sidewall panels.

The various reinforcement members 496 may tend to cooperate to define a peripheral backing extending about substantially all of the rim of opening 500 of the lower portion 502 of container assembly 460. It may be that reinforcement members 496 are held in place by a securement or attachment along one or more edges, such as by having stitching 504 driven through their upper margins, thus fixing them in place relative to the fabric coverings layers or the thermally insulating material or both. It may be that the respective reinforcement members 496 are not joined at their end edges to each other, or that they are mutually hinged, such that they have a rotational degree of freedom one relative to the next, about an axis such as might correspond to the line of intersection of the adjoining margins of the respective pairs of panels 462, 464, 466 and 468, i.e., about the axes of the vertices of the rectangular sidewall wall. It may be that in this way, the substantially continuous peripheral wall is jointed at the edges of the respective panels or reinforcements. It may also be that some of the sidewall panels may have more than one reinforcement member. That is, in some panels, such as, for example, front panel 462 and rear panel 464, the reinforcement member 496 may extend across the majority, if not substantially the entire width, of the panel. In other panels, such as, for example, left and right hand side panels 466 and 468, more than one reinforcement stiffener may be employed. In one embodiment, two such reinforcements may be used, as indicated by phantom lines 506, 508. It may be that, in effect, reinforcements 506 and 508 act as a single stiffener or backing member with an interruption, or hinge or fold in the middle, as indicated at 510. This may give another rotational degree of freedom about an axis that might be considered to extend predominantly along the interruption or break or hinge, indicated as 510.

Figure 10B:
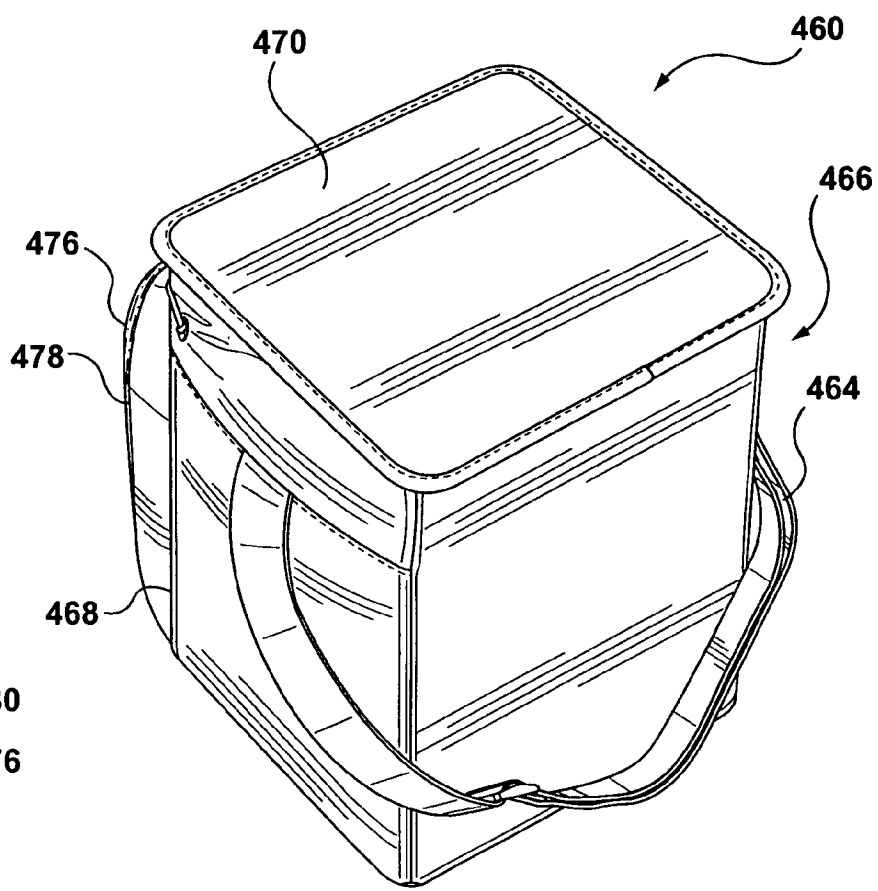
FIG. 10*b* shows a perspective view from above, behind and to the left of the container assembly of FIG. 10*a;*
Figure 10A:
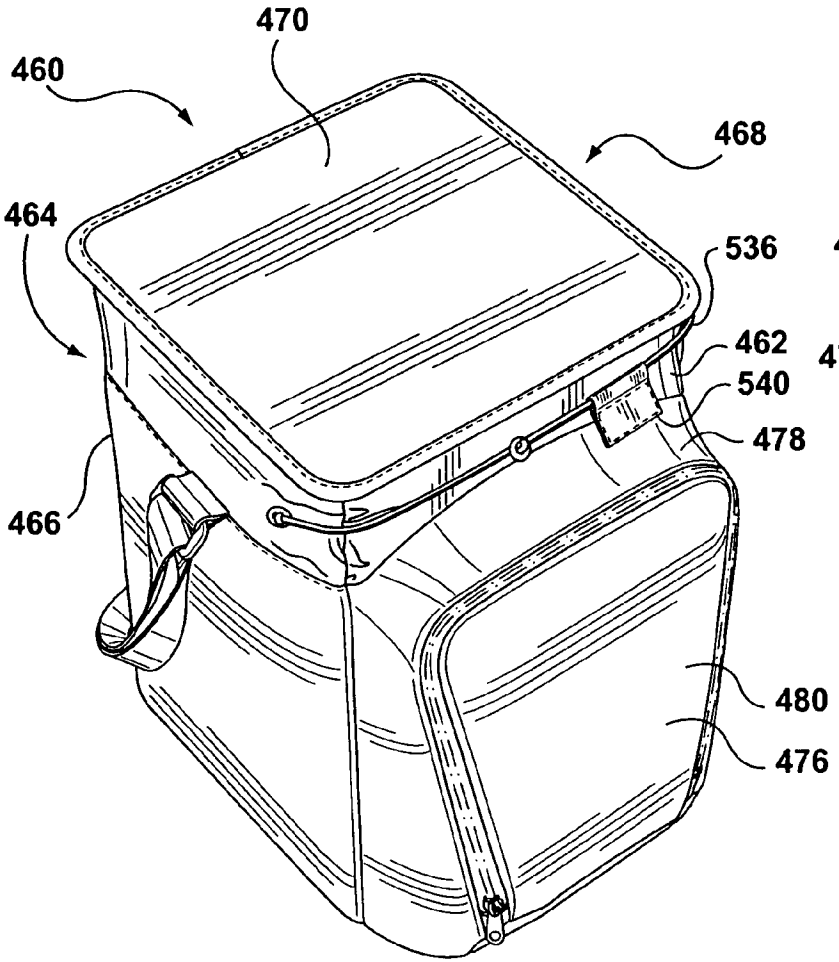
FIG. 10*a* is a perspective view from above, in front, and to the right of a further alternate embodiment of container assembly to that of FIG. 1*a;*
Figure 10D:
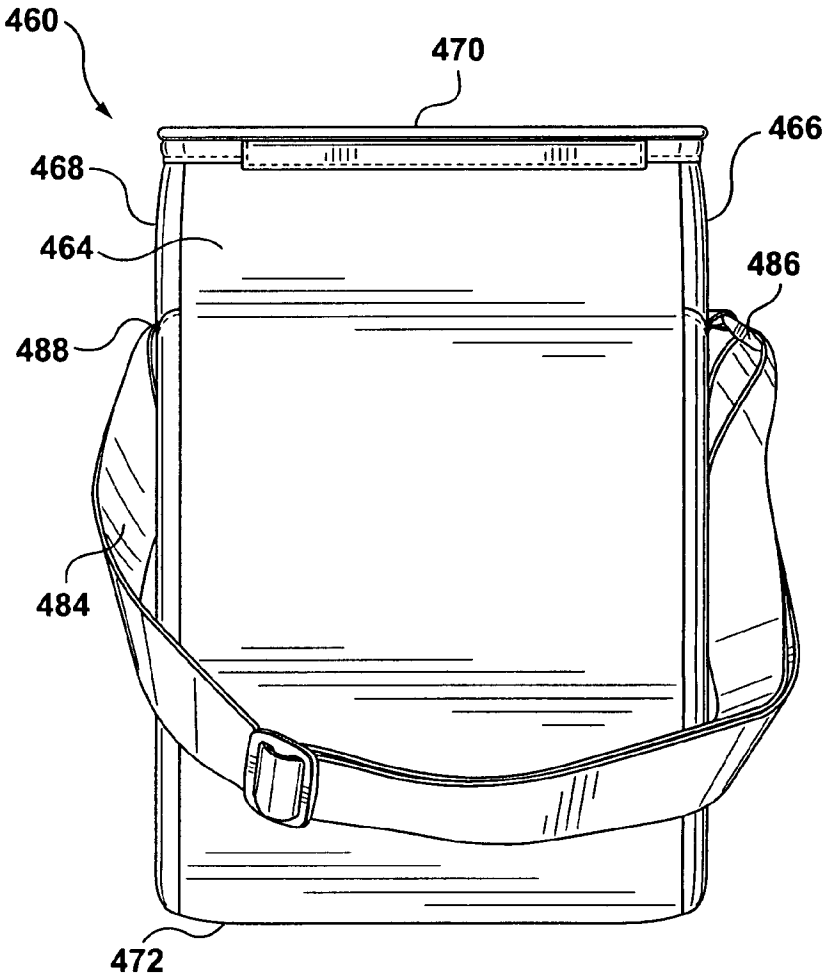
FIG. 10*d* is a rear view the assembly of FIG. 10*a;*
Figure 10C:
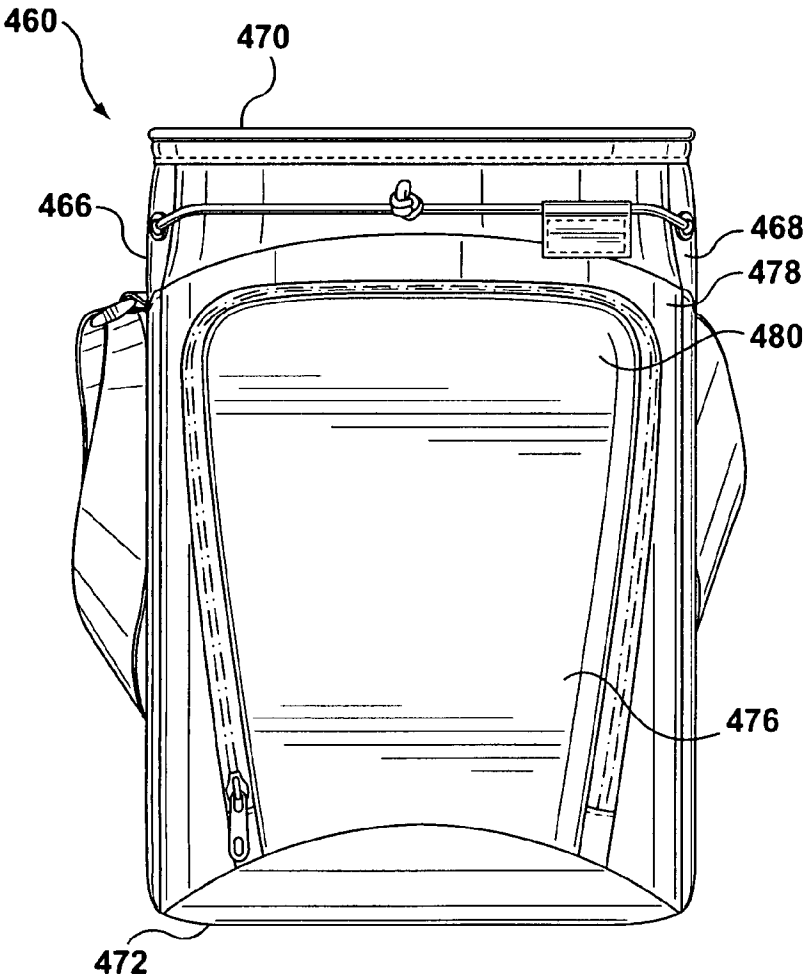
FIG. 10*c* is a front view of the container assembly of FIG. 10*a;*
Figure 10F:
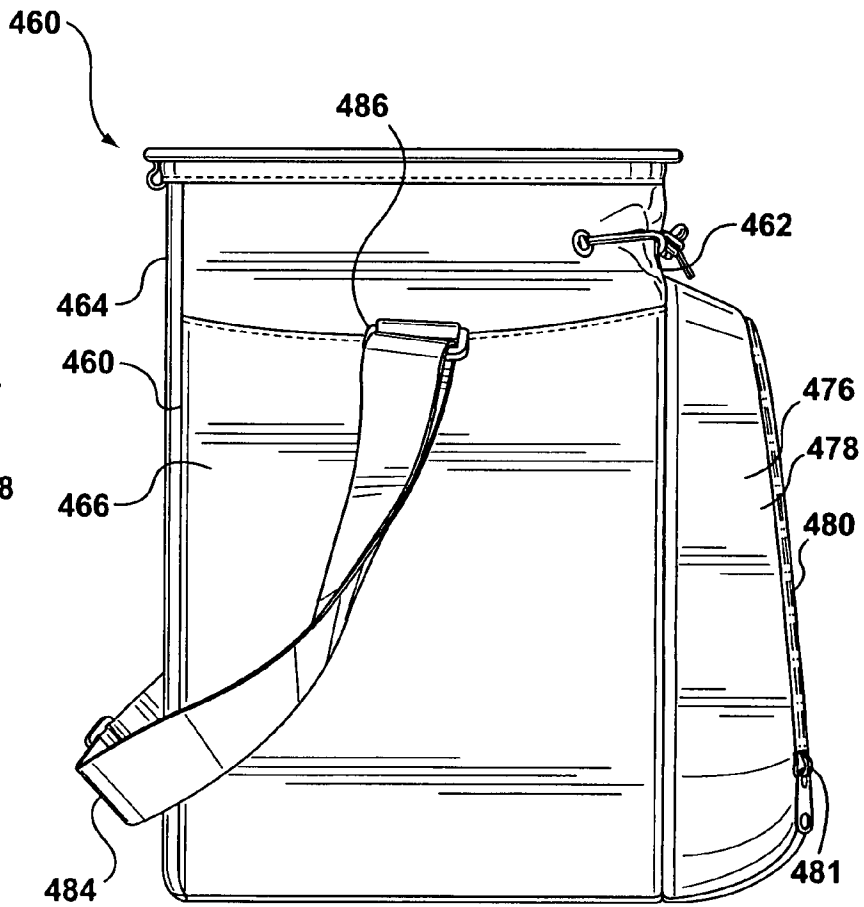
FIG. 10*f* shows a right hand side view of the container of FIG. 10*a;*
Figure 10E:
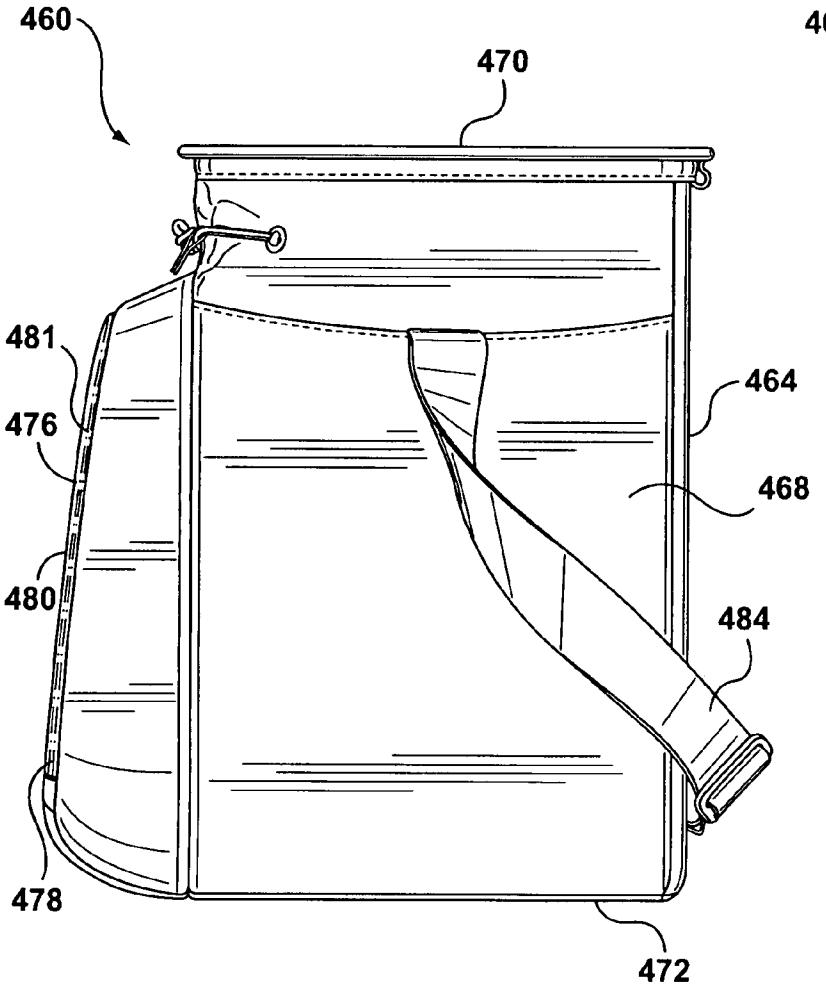
FIG. 10*e* shows a left hand side view of the container assembly of FIG. 10*a;*
Figure 10H:
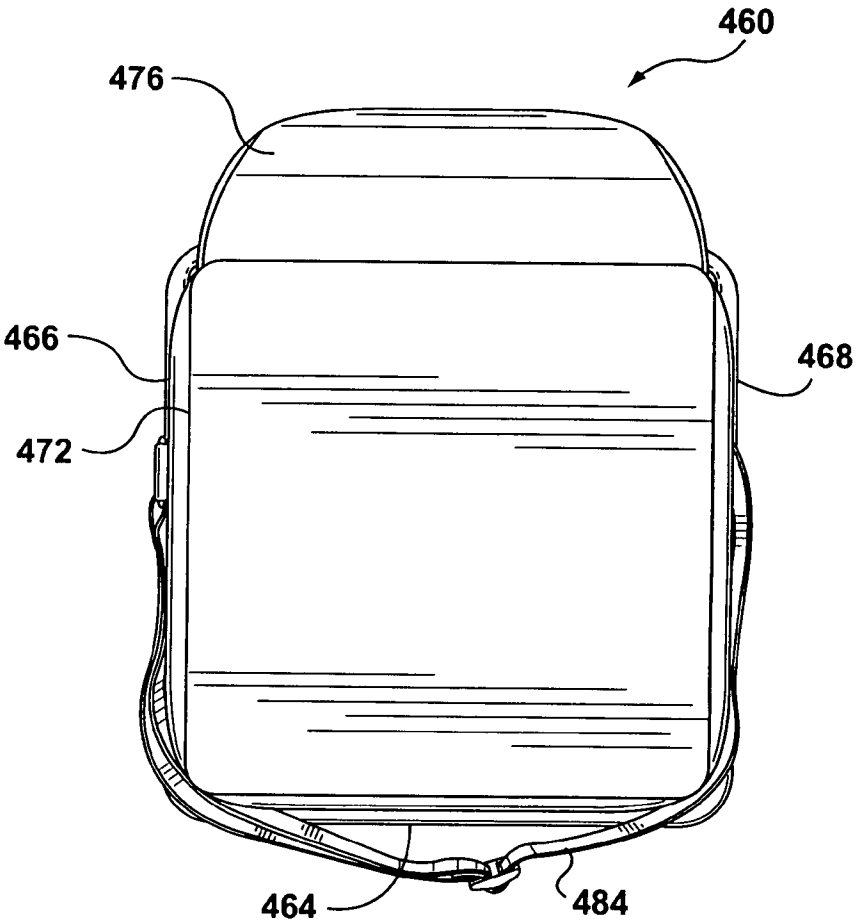
FIG. 10*h* is a bottom view of the assembly of FIG. 10*a;*
Figure 10G:
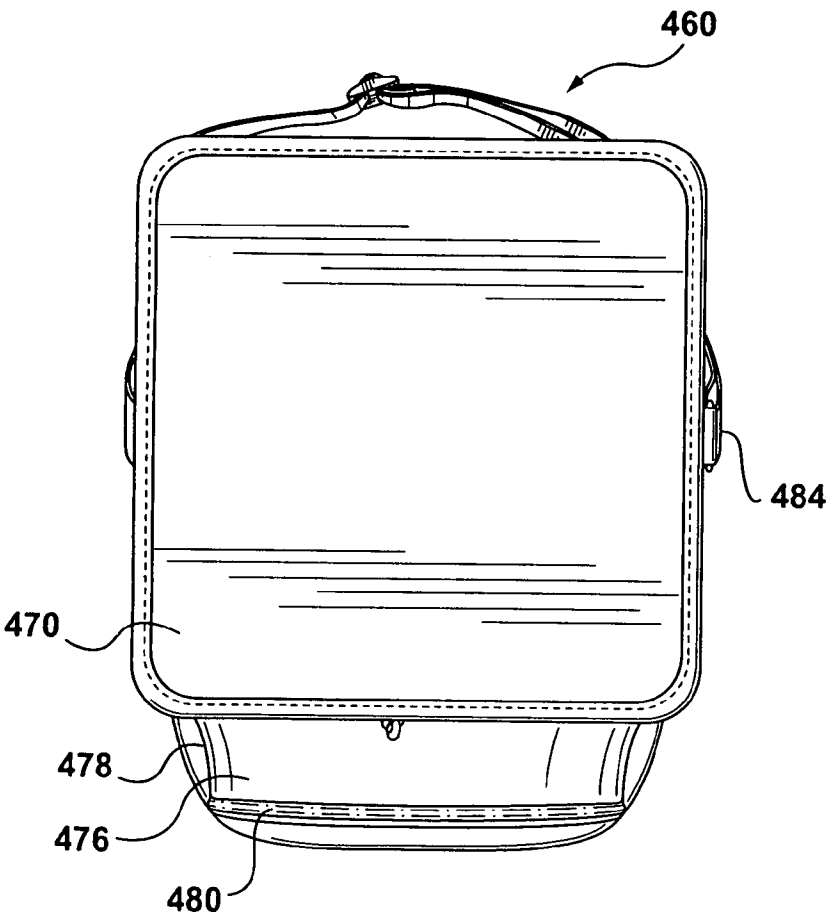
FIG. 10*g* is a top view of the container assembly of FIG. 10*a;*
Figure 10I:
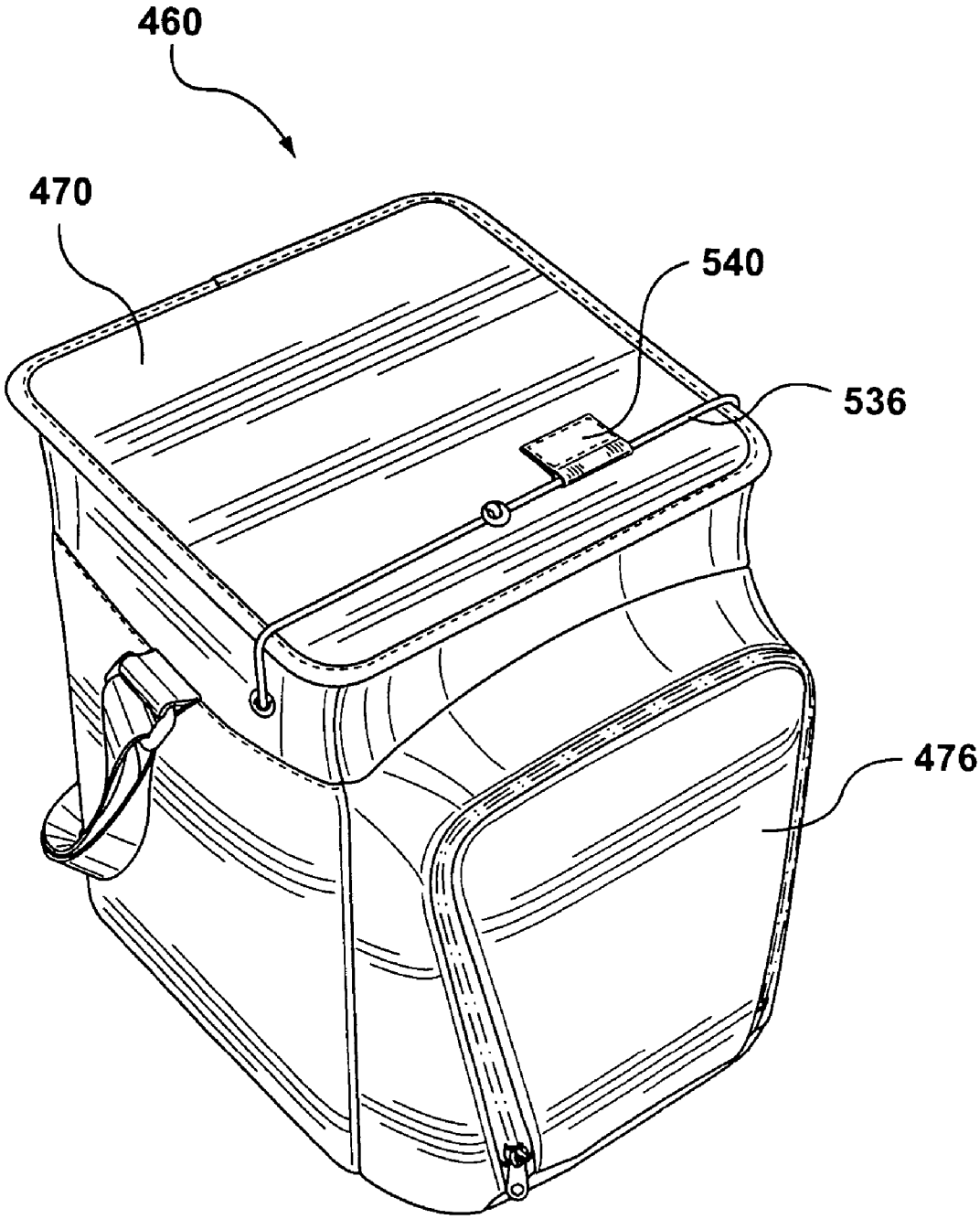
FIG. 10*i* shows the container assembly of FIG. 10*a*, secured in a closed position.
Figure 10J:
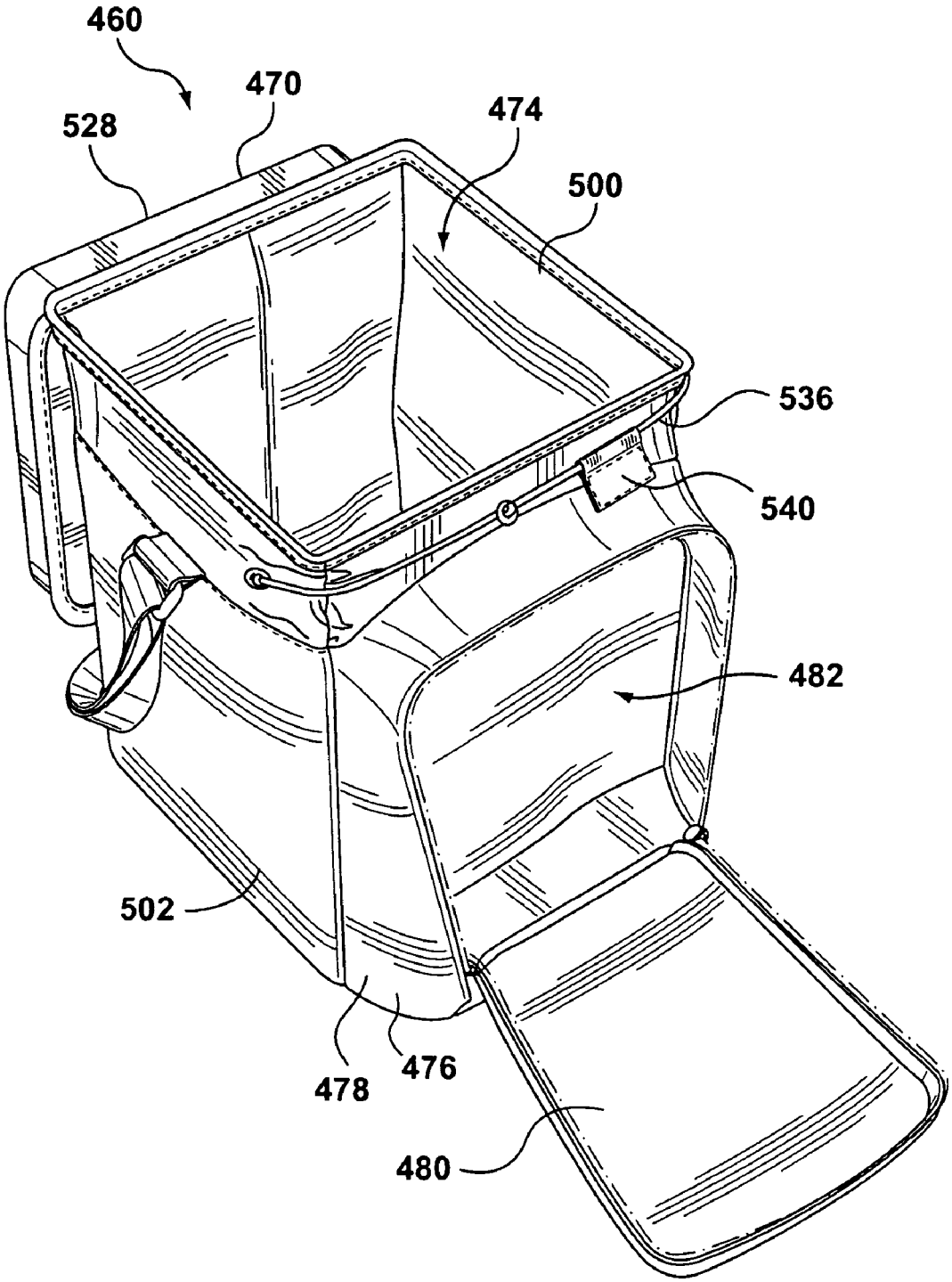
FIG. 10*j* shows the container assembly of FIG. 10*a* in an opened position.
Figure 10L:
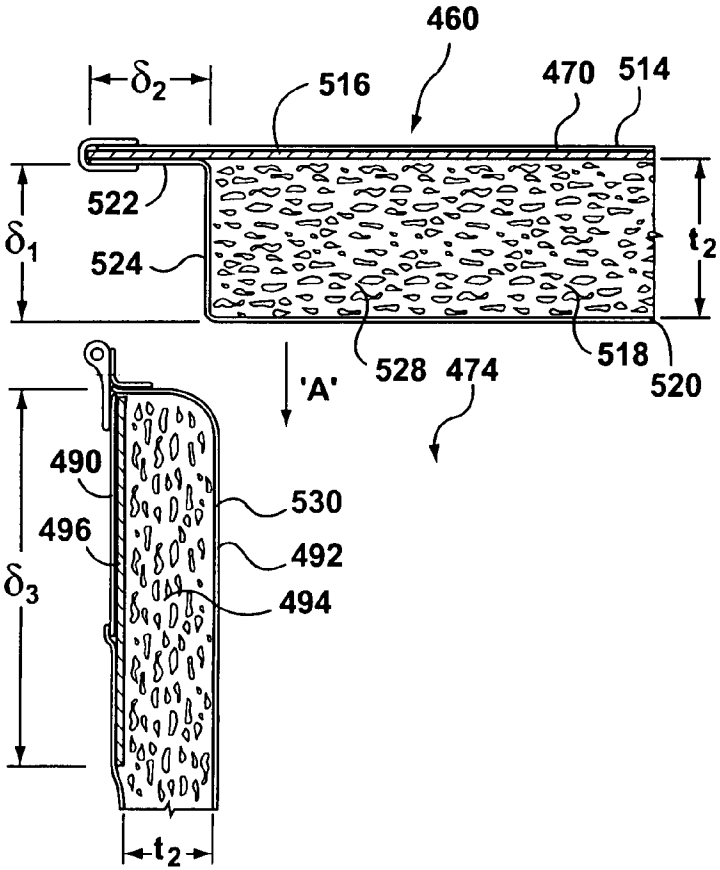
FIG. 10*l* is a partial section of the container assembly of FIG. 10*a* showing a detail of the main closure interface.
Figure 10K:
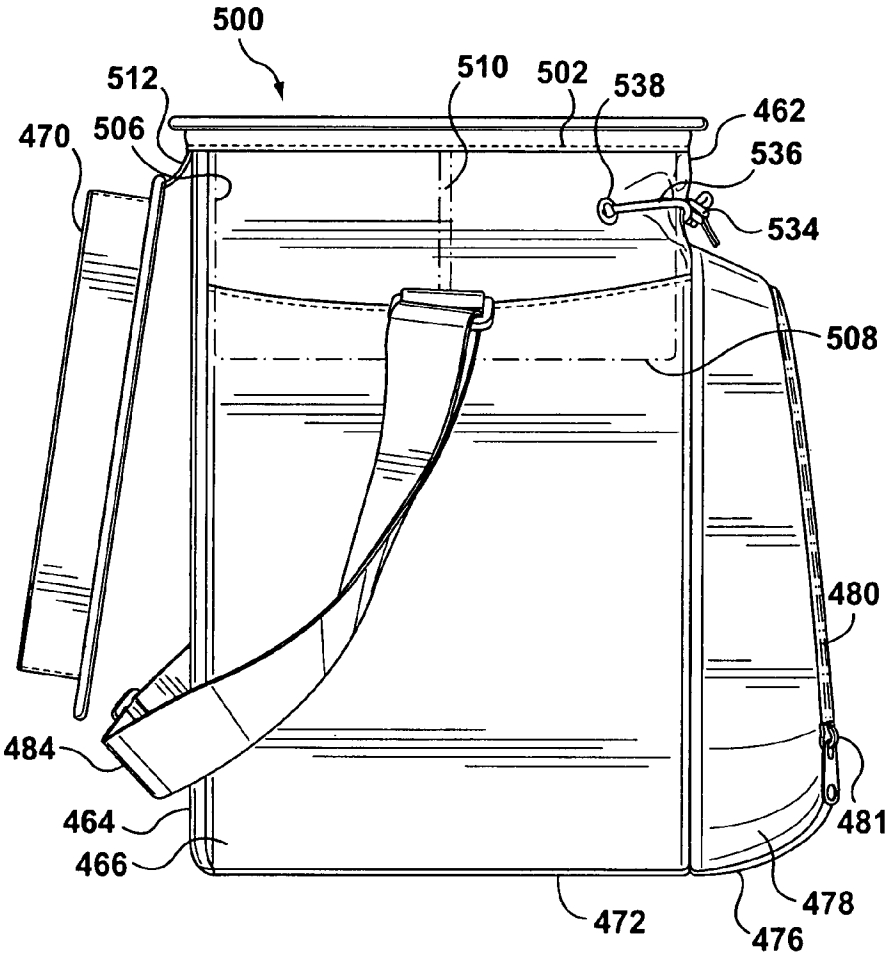
FIG. 10*k* shows the container assembly of FIG. 10*f* in an open position.
Figure 10M:
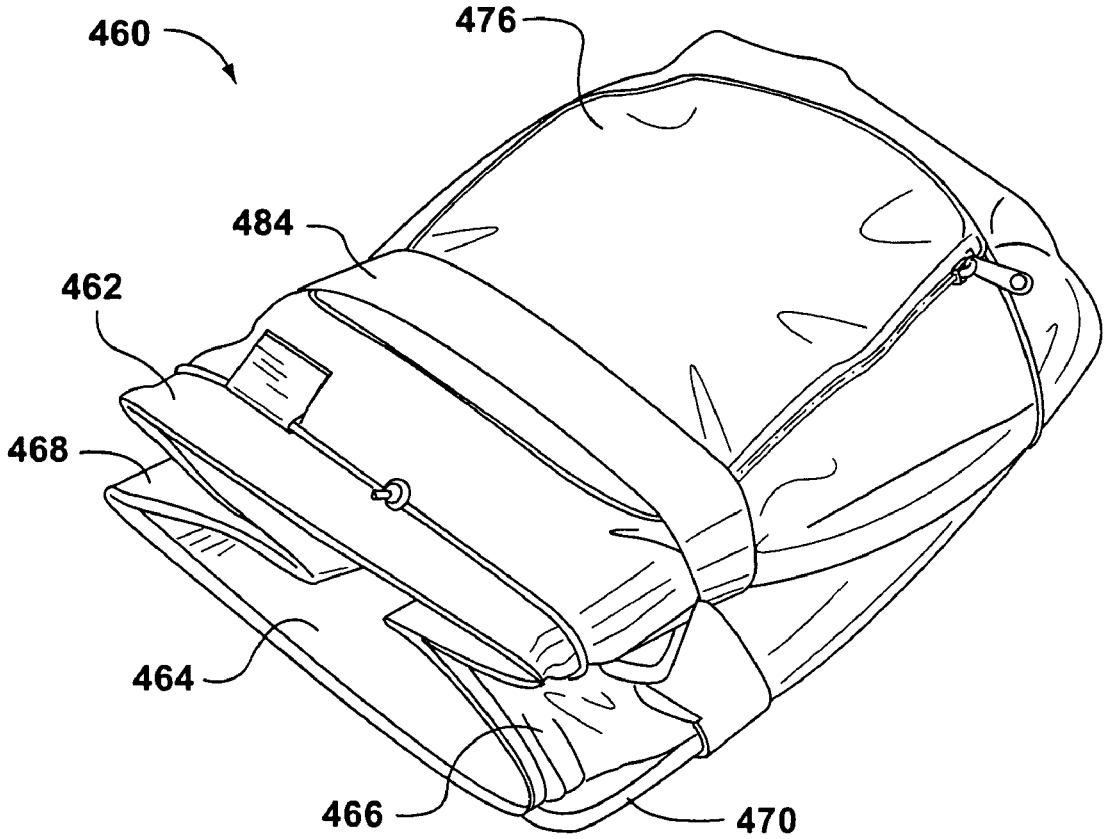
FIG. 10*m* is a view of the container assembly of FIG. 10*a* in a foldable collapsed position
Figure 11A:
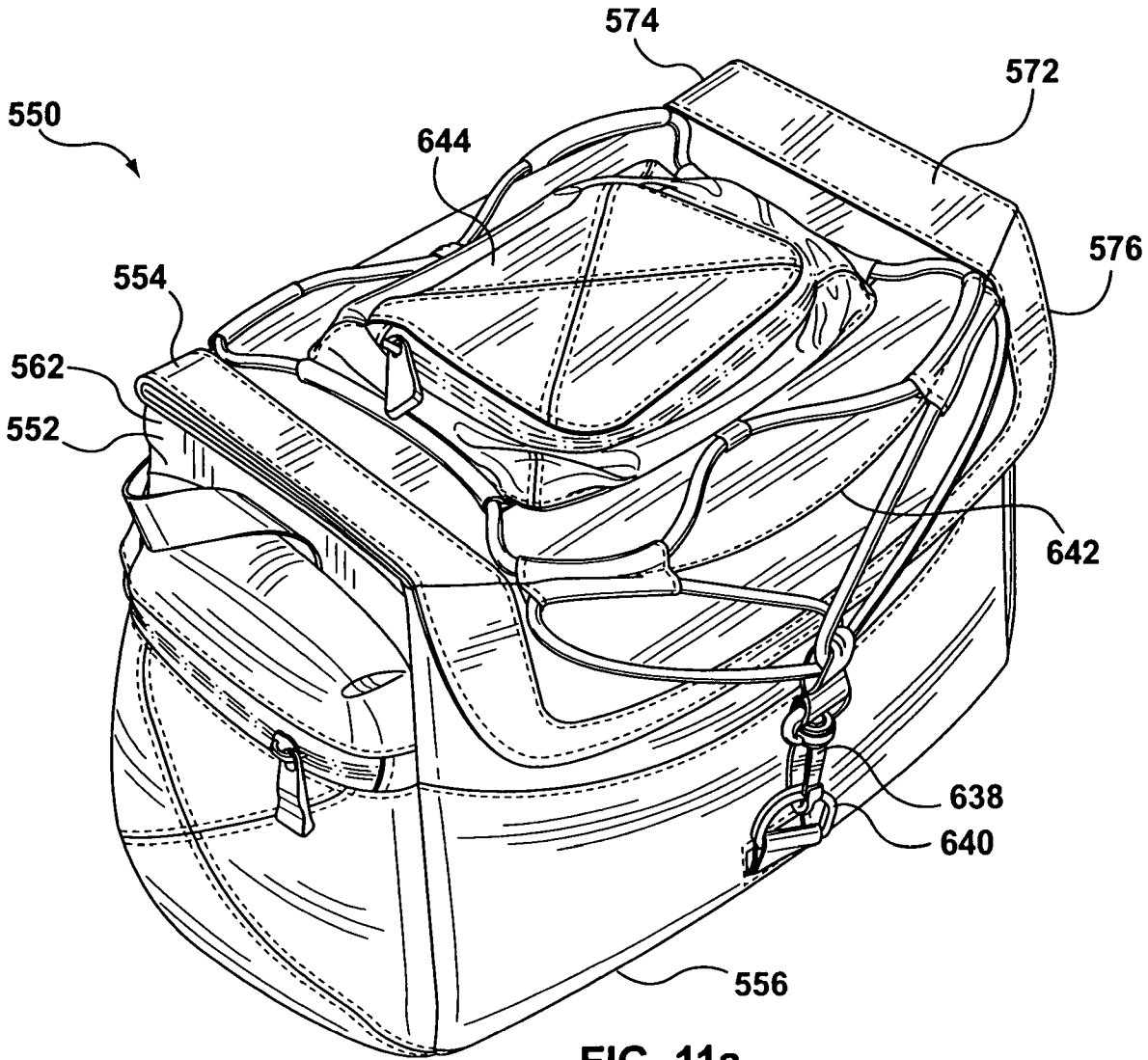
FIG. 11*a* is a perspective view from above, in front, and to the right of a further alternate embodiment of container assembly to that of FIG. 11*a;*
Figure 11B:
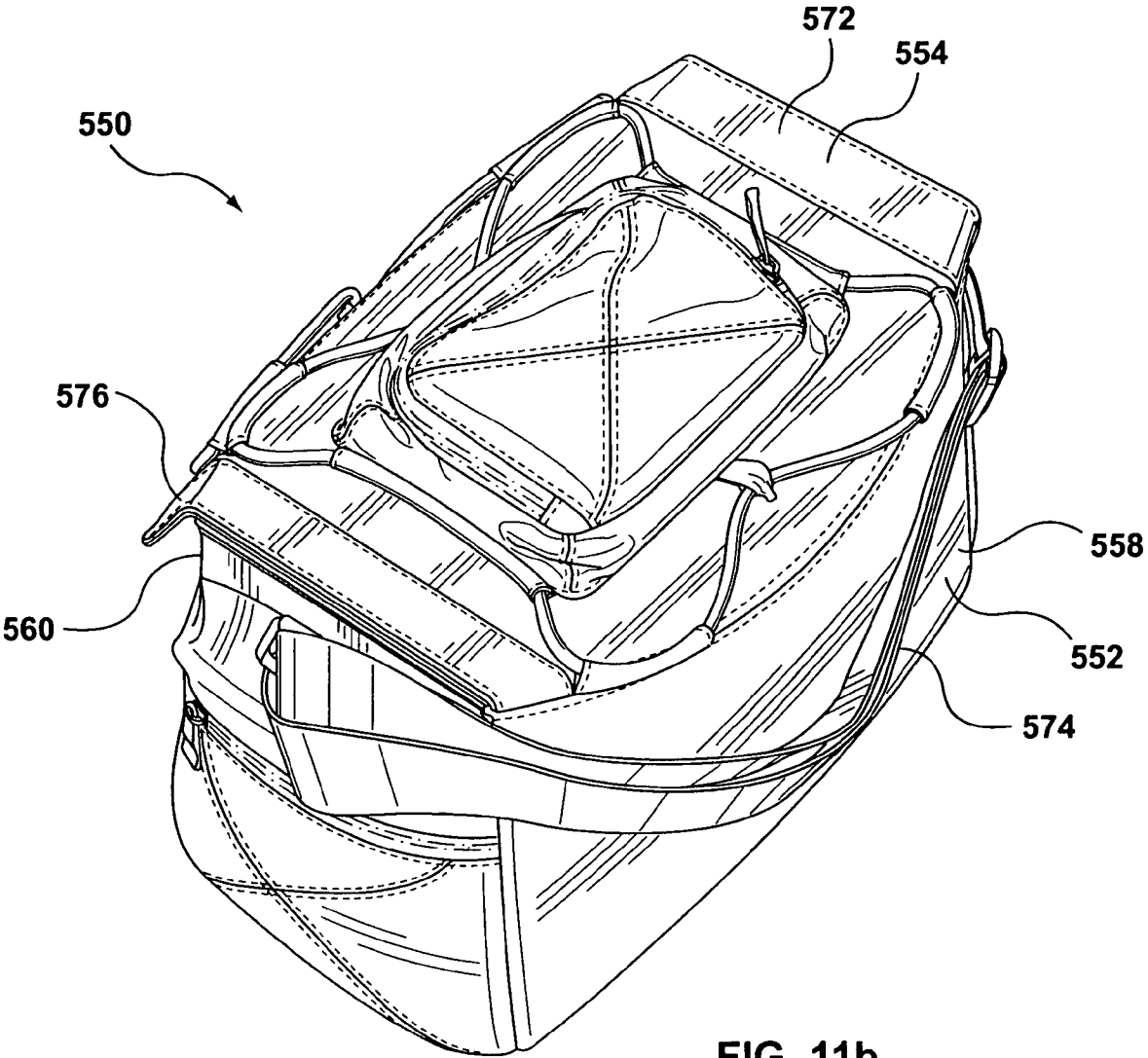
FIG. 11*b* shows a perspective view from above, behind and to the left of the container assembly of FIG. 11*a;*
Figure 11C:
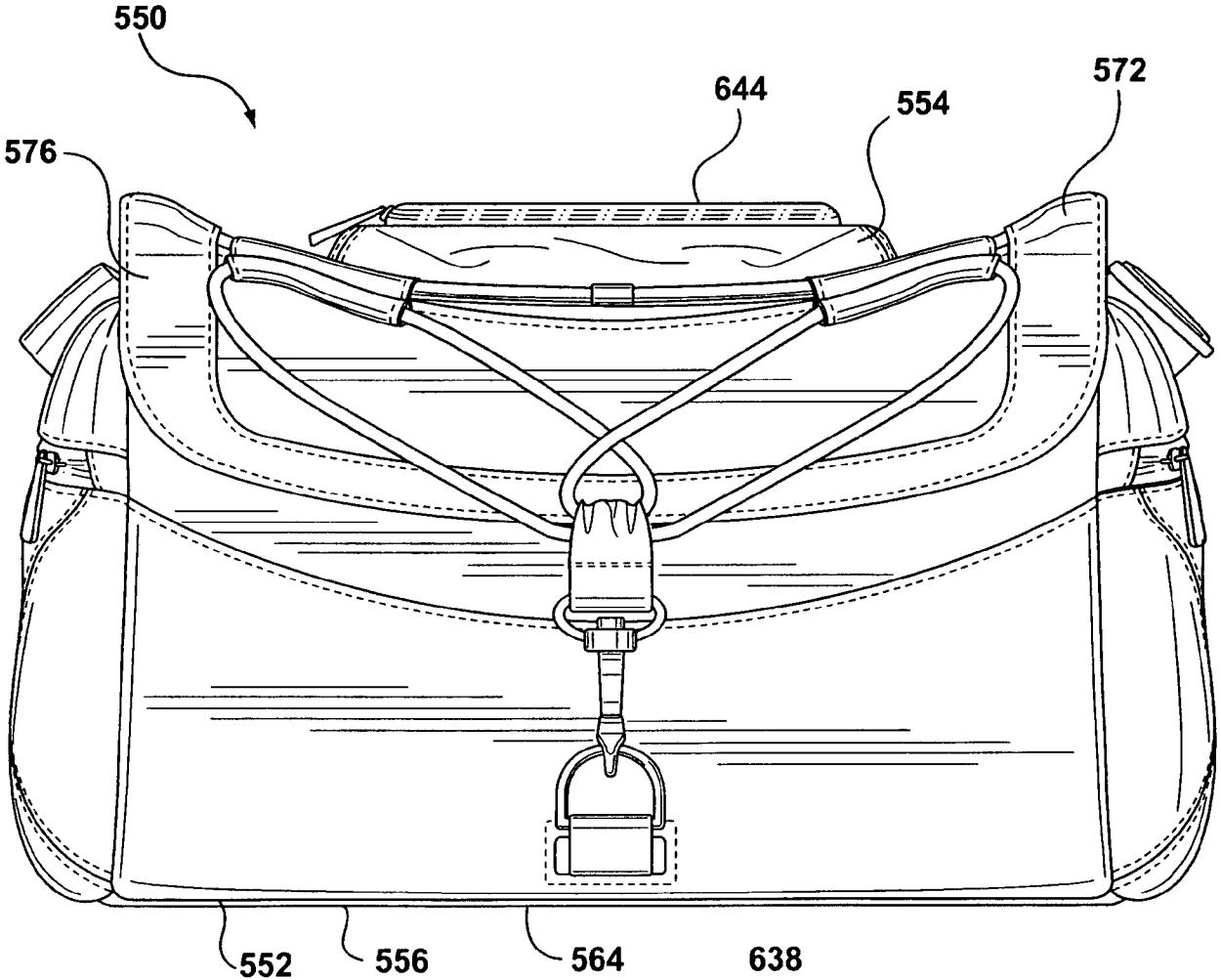
FIG. 11*c* is a front view of the container assembly of FIG. 11*a;*
Figure 11D:
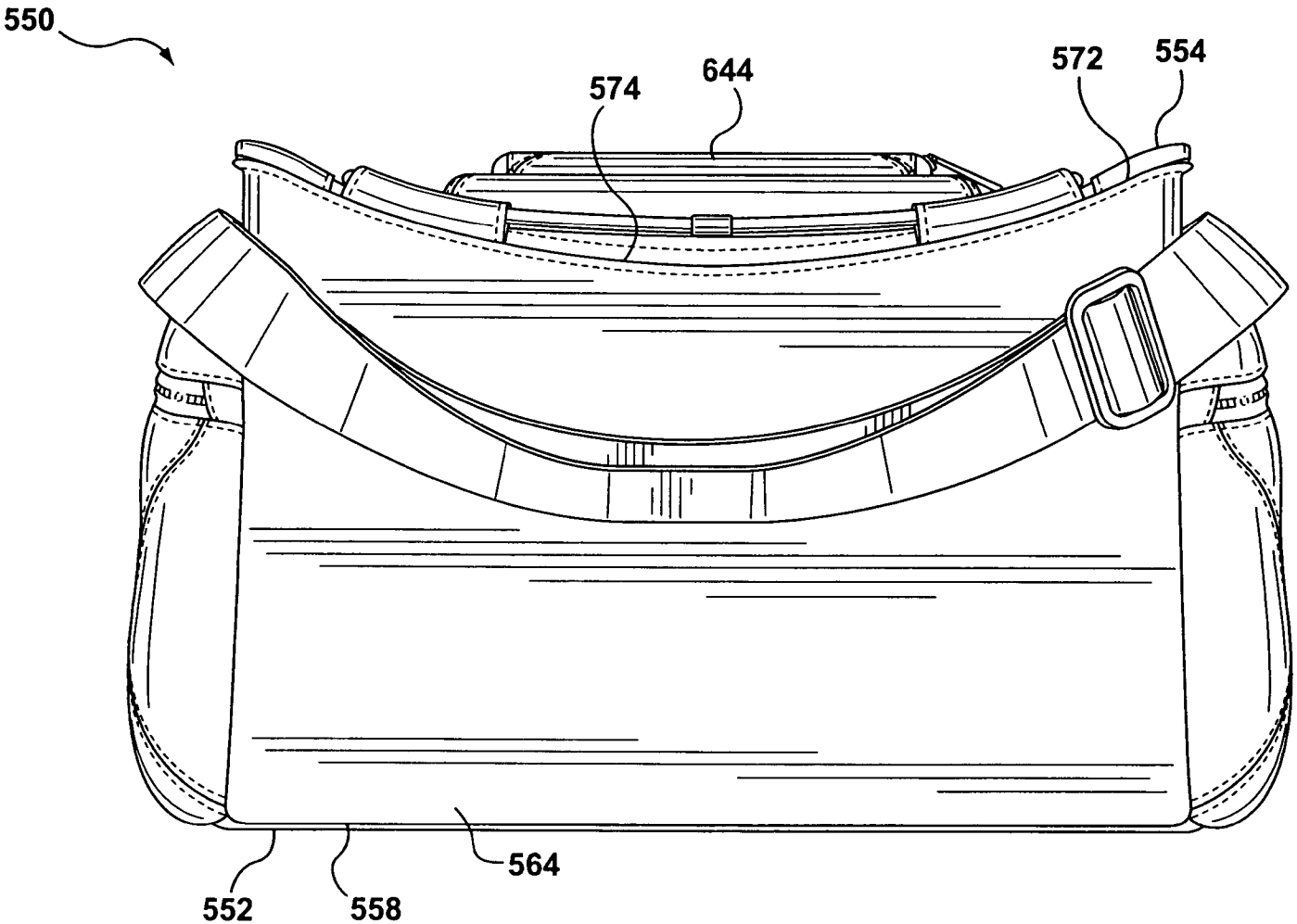
FIG. 11*d* is a rear view the assembly of FIG. 11*a;*
Figure 11E:
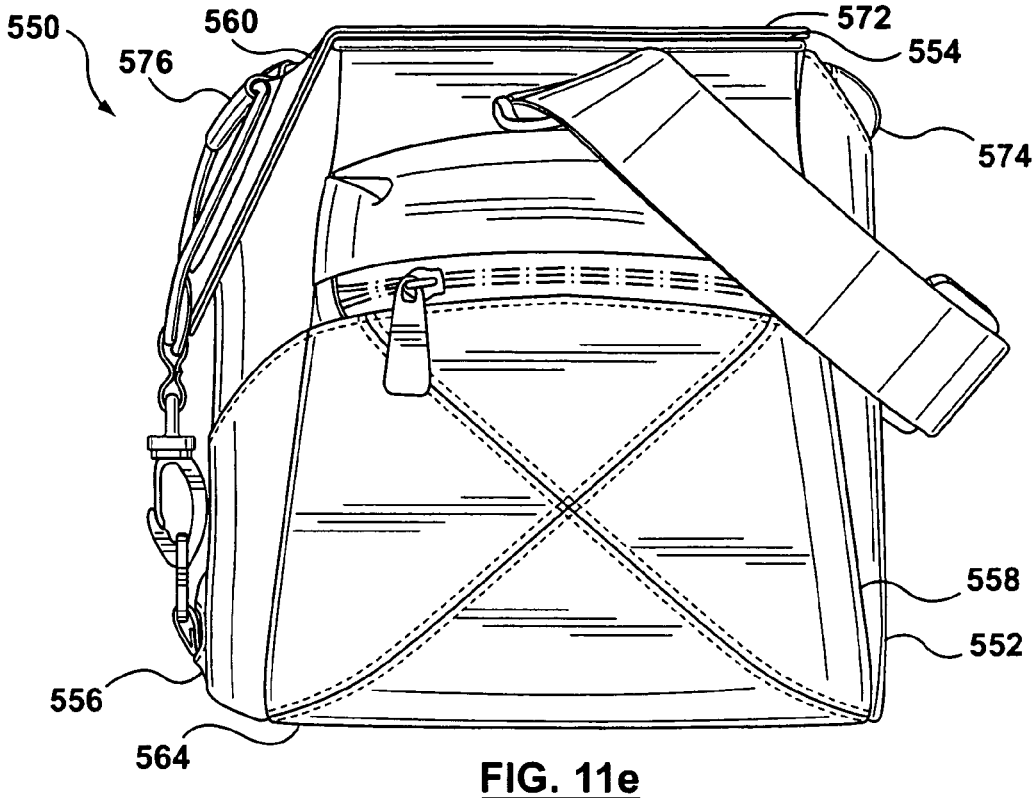
FIG. 11*e* shows a left hand side view of the container assembly of FIG. 1*a;*
Figure 11F:
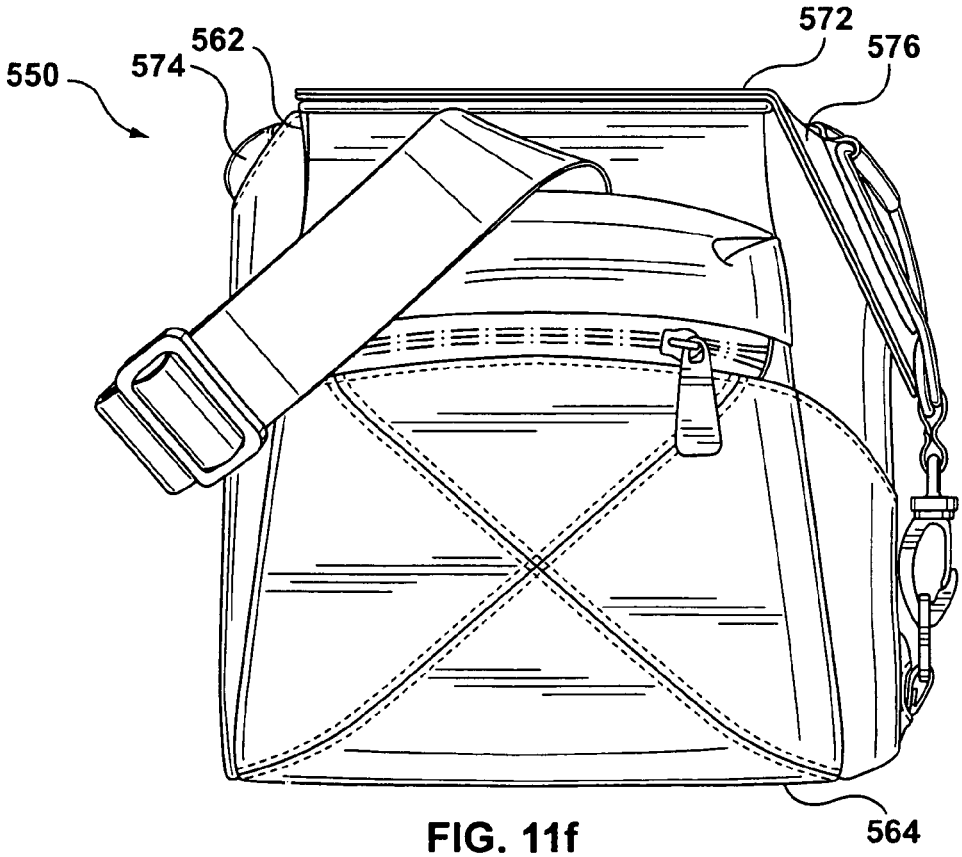
FIG. 11*f* shows a right hand side view of the container of FIG. 11*a;*
Figure 11G:
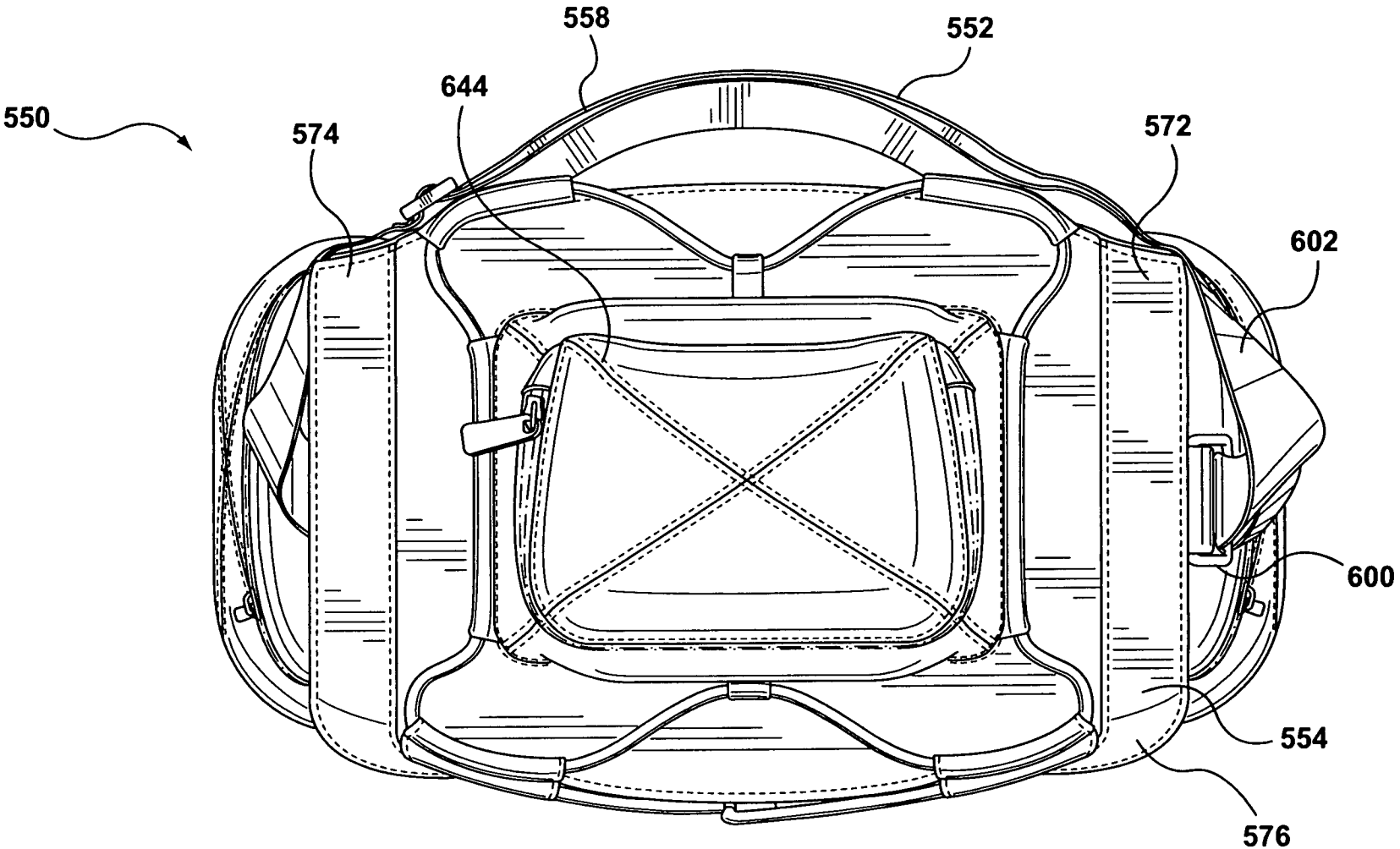
FIG. 11*g* is a top view of the container assembly of FIG. 11*a;*
Figure 11H:
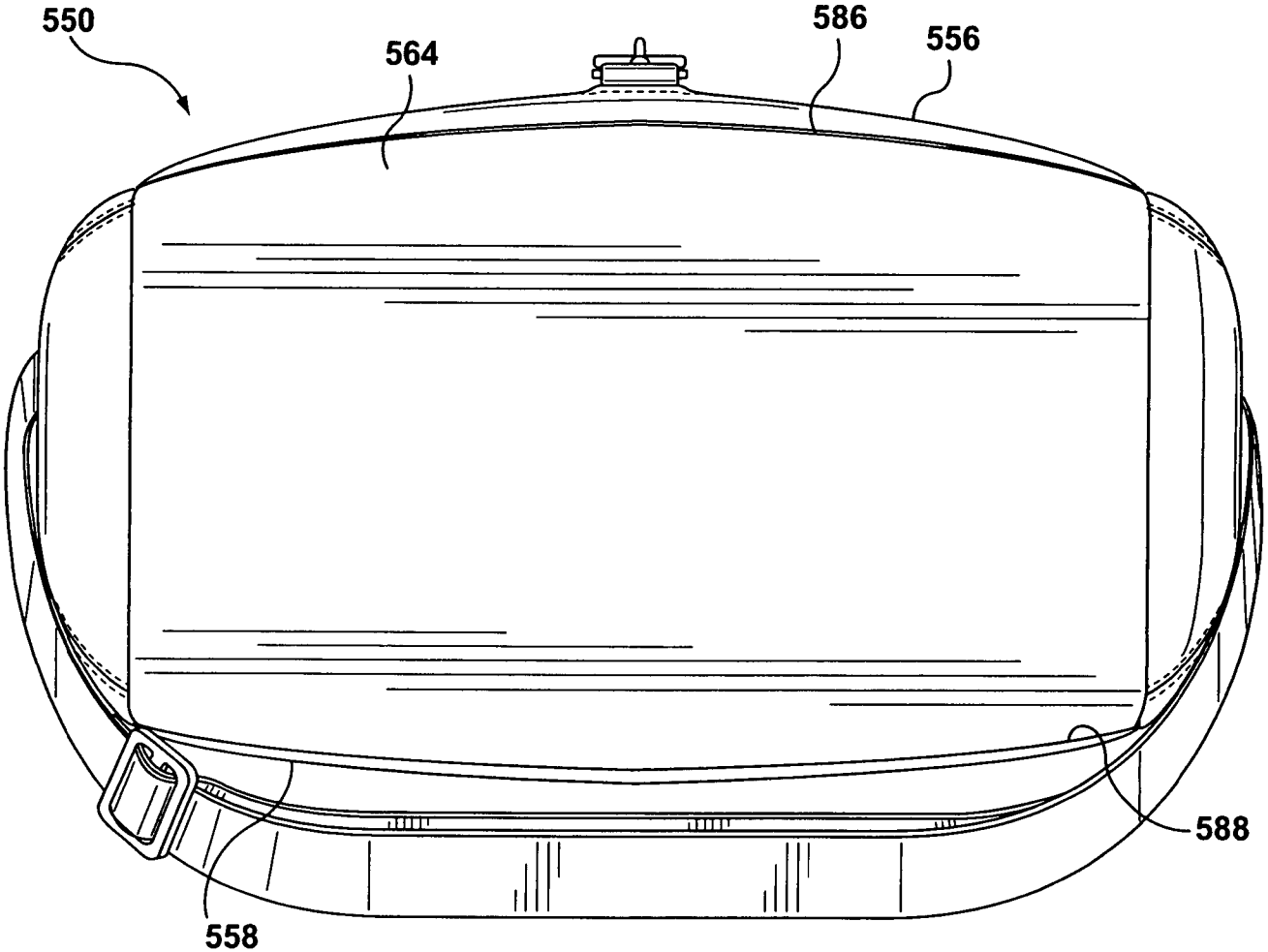
FIG. 11*h* is a bottom view of the assembly of FIG. 11*a;*
Figure 11I:
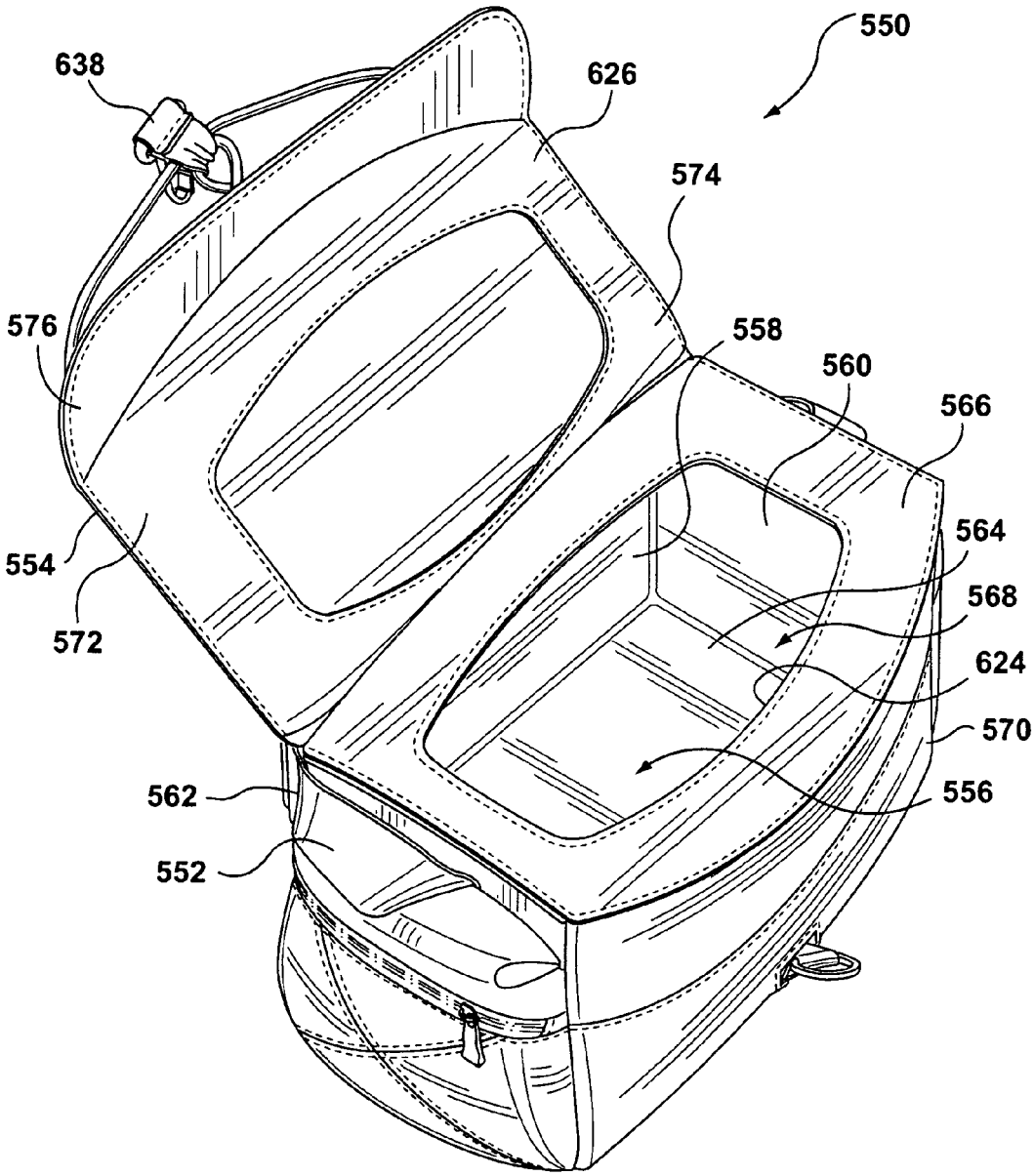
FIG. 11*i* is similar to FIG. 11*a*, showing the container assembly in an open position.
Figure 11J:
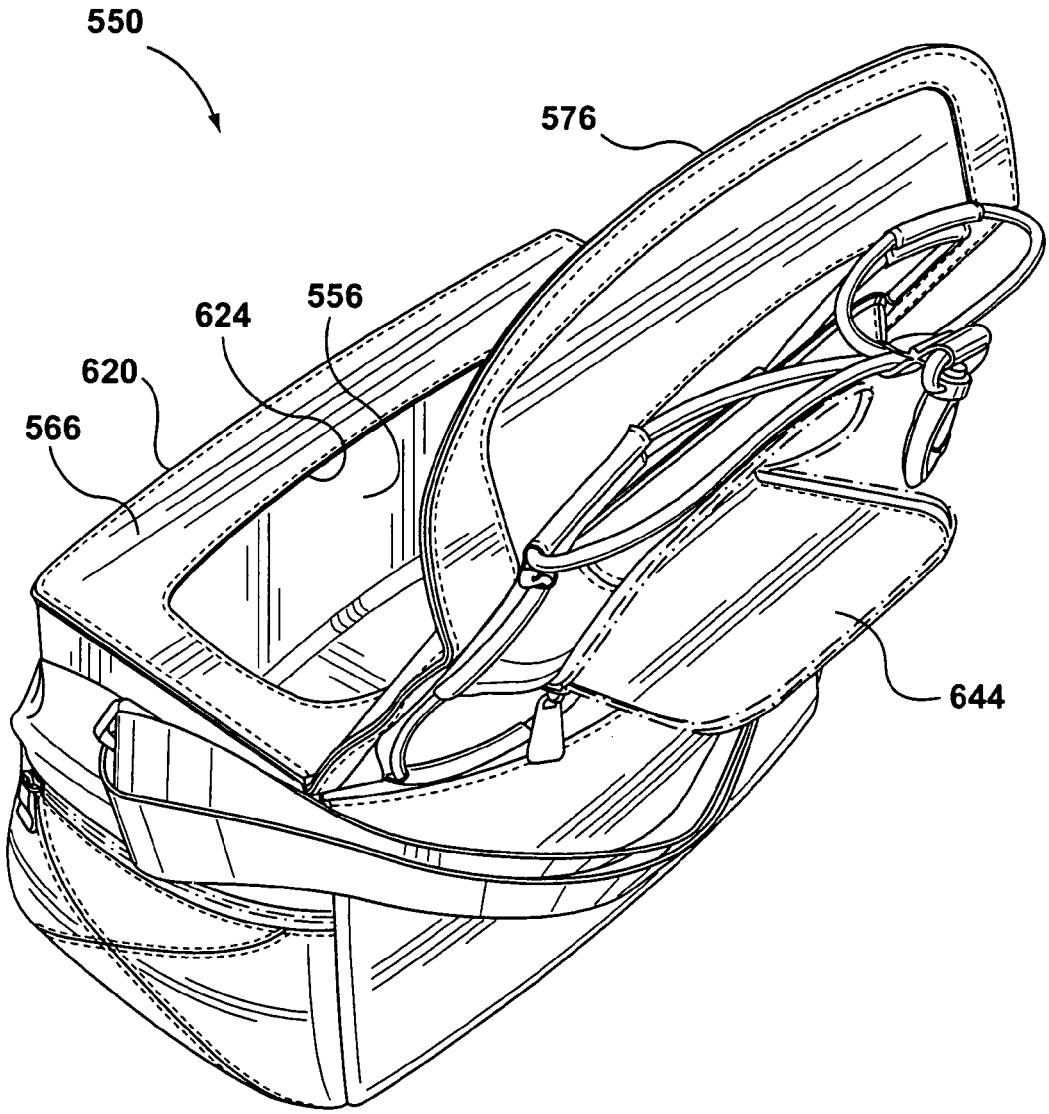
FIG. 11*j* is similar to FIG. 11*b*, showing the container assembly in an open position.
Figure 11K:
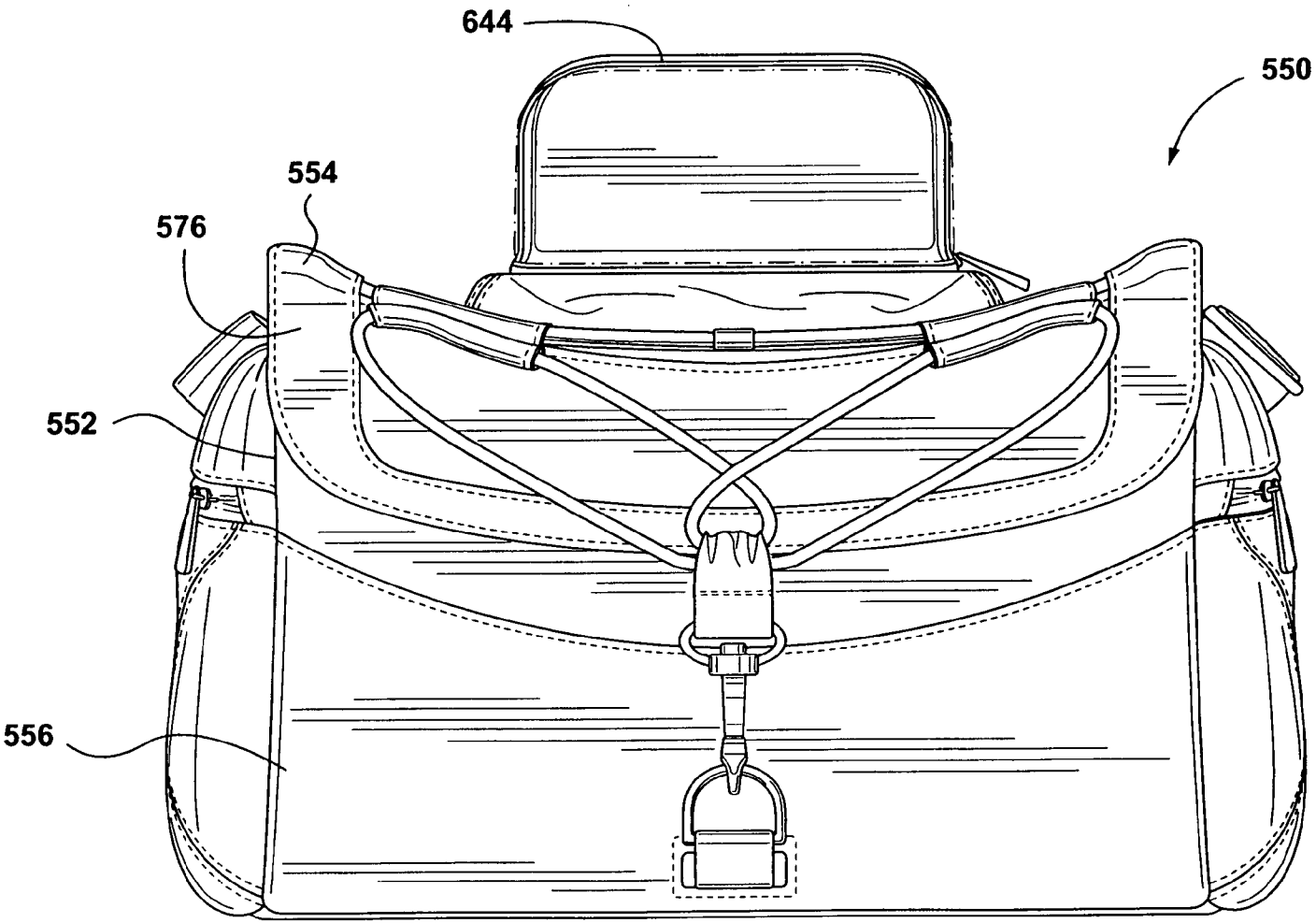
FIG. 11*k* shows the container assembly of FIG. 11*f* with an upper compartment in an open position.
Figure 11I:
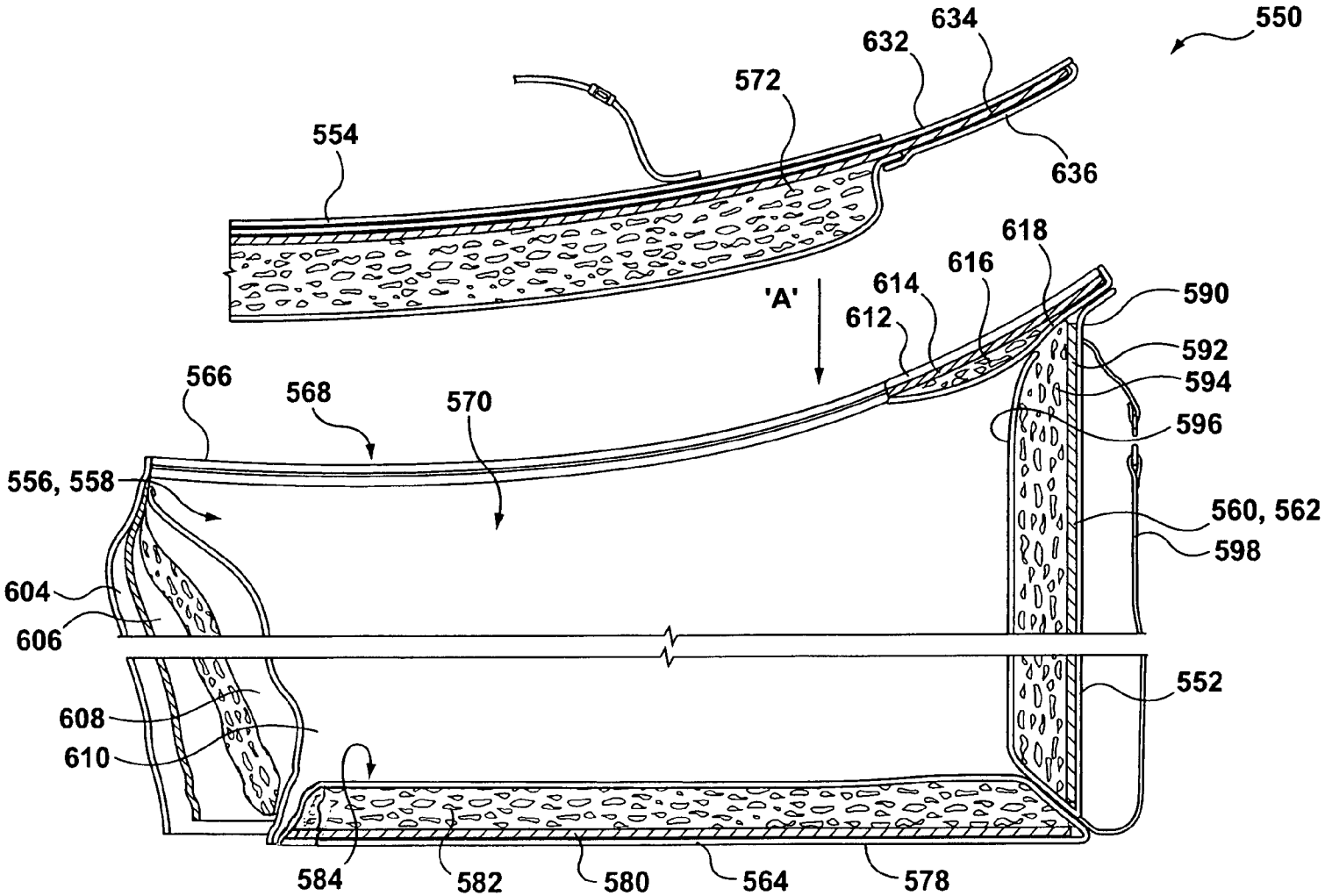

Container assembly 460 may be a collapsible soft-sided container that is movable between a first, expanded, open, or in use position, as seen in FIG. 10*a*, to a second, collapsed, or folded position, as indicated in FIG. 10*m*. In this collapsed or storage position, the interruption at 510 acts as a fold initiation site, that fold being pushed inwardly, such that the left and right hand side panels 466, 468 fold toward each other while the front and rear panels move closed together toward the other side panel while retaining their generally planar condition. The bottom panel may tend to fold inwardly and upwardly. Top panel 470 may be folded to lie along near panel 464. Strap 484 may be adjusted to cinch about container 460 in the collapsed position.

The top panel 470 may be attached to the lower portion 500 of container assembly 460 along one edge by an hinge 512. In one embodiment, hinge 512 may connect the rear edge of top panel 470 to the upper margin of rear wall panel 464. Hinge 512 may be a fabric or plastic hinge, and may be made of woven webbing, leather, nylon, or other suitable material. Top panel 470 may have an exterior covering sheet or web 514, a reinforcement member or batten, indicated as stiffener 516, a thermal insulation pad, or layer, 518, and an inside lining 520. Web 514 may be a wear resistant woven fabric or web, or a nylon or vinyl or polyester sheet, or other suitable material. Inside lining 520 may be made of one of the materials noted above in connection with web 514, or may be made of a reflective sheet, such as a sheet having a plastic layer covered with a reflective metallic layer, of which one type may be referred to as "Thermoflect"™. Insulating layer 518 may be a layer of foam insulation, be it closed cell or open cell foam. Layer 518 may have a thickness, $t_2$, that may be of greater thickness than thickness $t_1$, of the layers of insulation 494 in the sidewall panels. It may be greater than twice as thick, and may be in the range of twice as thick to four times as thick. Layer 518 may have a smaller footprint, or projected area, than top panel 470 generally. Stiffener 516 may be a substantially solid high density plastic sheet, and may extend to cover substantially all of the projected footprint of layer 518. Stiffener 516 may lie between layer 518 and outer covering layer 514. Stiffener 516 may overhang layer 518, and may be substantially co-extensive with layer 514, in one embodiment being seamed thereto around the periphery. Stiffener 516 and layer 514 may extend beyond layer 518 to define a marginal or peripheral land 522. Land 522 may have a footprint corresponding to the opposed, generally rectangular upward end surface of the upstanding peripheral sidewalls of the lower portion 500 of container assembly 460. That correspondence may be such that the two substantially overlie each other when top portion 470 is in the closed or engaged position, or in which land 522 may extend marginally proud of the lower portion of the container assembly. Land 522 may be of a width corresponding generally to the through thickness of the upstanding wall panels, and may terminate at an inward shoulder 524 at layer 518. Layer 518 may be slightly larger in one or both of width and length than the generally rectangular opening 526, such that, when closed, as by motion in the direction of Arrow "A" the downwardly protruding portion 528 of top panel 470 may tend to engage a portion or all of the upper rim, or periphery of the lower portion in an interference fit. In some embodiments, the aspect ratio of the protrusion depth $\delta_1$ to the land width $\delta_2$ may lie in the range of 2:1 to 5:1, and may be about 3:1. In some instances the protrusion depth may be substantially the same as the engaged contract length of the land or shoulders 524 against the corresponding land region 530 of the mating wall panel rim. The ratio of land width or length to overall width or length of top potion 470 may be in the range of 5 to 15%, or, expressed alternately, the ratio of the width or length of top portion 470 overall to the width or length of protruding portion 528 may be of the order of 115 to 150%, and, in one embodiment, may be about 125% (+/− 5%). The aspect ratio of the protruding portion, taken as one or the other of width or length, or both, of the portion 528 in plan view as against the depth of the plug as seen in profile, may be of the order of 5:1 to 10:1 and may be about 7:1. Protruding portion 528 may be thought of as a relatively squat plug with a relatively long engagement distance such as $\delta_1$ against the mating rim portion of the lower portion of container assembly 460. The plug, namely protruding portion 528 may mate with a land region 530 of the sidewall portions, that land being relatively soft or yielding due to the presence of insulation layer 494, but made more firm and peripherally consistent by being stiffened by members 496. Members 496 may overlap land region 530. That is, some or all of members 496 may have a width $\delta_3$ that exceeds the engagement depth $\delta_1$ of the plug. In some embodiments, the ratio of the width of members 496 to the plug depth may be in the range of 125% to 500% and may be in the range of 200% to 400%.

Top panel member 470 can be considered a closure member operable to govern access to the interior chamber 470 of the main portion of container assembly 460. Top panel member 470 is movable between a first, engaged, or closed position, in which it seats athwart opening 500 and a second open, or disengaged position in which it is moved, pivotally, away from opening 500. As may be noted, top panel member 470 may not be secured in position by a tracked fastener, such as a zipper. I.e., it may be a zipperless closure. A securement fitting 534 may be provided to encourage top panel member 470 to remain in the engaged position. Securement fitting 534 may include a resilient member 536, such as may be an elasticized cord, which may be secured at either end, as at a hard eye fitting or grommet 538 which may be located in the upper margin regions of left and right hand side panels 466, 468. Securement fitting 534 may be moved from a first, out of the way, or disengaged position, such as being wrapped around the front face of front panel 462 above the upper wall of secondary wall structure 476 as in FIG. 10*a*, to a second, engaged position in which resilient member 536 may extend across, or overlie, at least a portion of top panel 470 as in FIG. 10*i*. For example, resilient member 536 may stretch across the a margin of top panel 470 distant from hinge 512 and may tend to resist or discourage dislodgement thereof. Resilient member 536 may include a handle, or tab, of finger grip 540 to facilitate its placement, or movement between, one position and the other.

FIGS. 11*a* to 11*l*

In the embodiment of FIGS. 11*a* to 11*l*, an insulated container assembly is identified generally as 550. Container assembly 550 may have the general shape of a six sided box has a lower portion 552, and an upper portion 554 that is movable to engage lower portion 552, and thereby to govern access to the interior thereof. Lower portion 552 may include a front panel 556, a rear panel 558, a left hand side panel 560 and a right hand side panel 562, co-operatively connected to form a generally 4-sided roughly rectangular peripheral sidewall standing upwardly from a bottom panel 564. Lower portion 552 may also include an upper panel, or frame or surround member 566, such as may have an opening 568 formed therethrough by which access may be obtained to the interior chamber 570 defined within lower portion 552. Upper portion 554 may include a top panel 572. Panel 572 may be connected along a rearward margin thereof to an upper margin of rear panel 558 by a connection such as may be in the nature of an hinge 574, such as a fabric, leather or plastic hinge as discussed above. Upper portion 554 may also include a depending member, or brim, or flap 576 extending from the opposite margin thereof distant from hinge 574.

As indicated in FIG. 11*l*, bottom panel 564 may have a cross-section of structure including an outer covering layer 578, which may be of any of the types noted above; a stiffener, reinforcement or batten member 580 which may extend across, and be substantially co-extensive with, substantially all of the surface of bottom panel 564, a layer of thermal insulation 582, such as may be as described above; and an inner wall or liner, or covering layer 584, such as may be of one of the types described above. Bottom panel 564 may have a preset curvature along one or more of its margins, such as an outwardly bulging curvature indicated at 586 and 588 on the frontward and rearward edges, such as may tend to compel a corresponding curvature to be imposed as a preset flex of the adjoining panels, such as front panel 556 and rear panel 558.

The construction of left and right hand side panels 560 and 562 may be substantially the same, each having an outer covering layer 590, which may be as described above a reinforcement, batten, or stiffener 592, a layer of insulation 594, which may be as described above; and an inner covering or liner layer 596, which may also be as described above. Secondary or auxiliary wall structures, such as may be in the nature of pockets or pouches, 598 may be mounted externally on panels 560 and 562. Lifting fittings, such as a lifting ring 600, may be mounted to one or the other, or both of panels 560 and 562 at an upper region thereof, and an associated adjustable length strap member 602 may be mounted for co-operation therewith to provide a handle or lifting member.

The construction of front and rear panels 560 and 562 may be substantially similar. Each may include an outer covering layer 604; a reinforcement, batten or stiffener 606, a layer of insulation 608, and an inside covering layer 610. All of these may be of the nature of those described above. The upper margin of front and rear panels 560 and 562 (an hence stiffener 606) may be trimmed on an arcuate profile such as shown in FIG. 11*l*, such as may tend to compel surround member 566 to conform to, or flex to match, that curvature, and so to have a preset.

Surround member 566 may have similar construction, having an outer covering 612, a stiffener member 614, a layer of insulation 616, and an inner covering 618. The four outer peripheral edges of surround member 566 may each be connected to the corresponding upper marginal edges of front panel 556, rear panel 558, left hand panel 560, and right hand panel 562. the forward and rearward peripheral edges 620, 622 may be trimmed on an arc, generally corresponding to the arcuate preset of front and rear panels 556, 558 imposed by bottom stiffener 580. Surround member 566 has an inner periphery 624 that may define a female socket for the corresponding male engagement plug 626 of top panel 572. The upper surface 628 of surround member 566 defines a land surface for mating engagement with the downwardly facing shoulder surface 630 of top panel 572.

Top panel 572 may include an outer covering 632, a reinforcement, batten, or stiffener 634, and an inner covering layer 636. It may also include plug 626, which may be mounted generally centrally with respect thereto for releasable, or disengageable, mating engagement with the socket defined by inner periphery 624 of surround member 566. Plug 626 may be formed from a resilient, compressible foam material, such as the insulation material used elsewhere on container 550. Plug 626 may tend to be somewhat oversized, such that an interference fit may be achieved between the male plug and the female socket. Flap 576, and its internal stiffener, may also have an outer layer, an inner layer and a stiffener, and may have an edge formed on a negative image of the curve of the adjoining edge of top panel 572. A flap securement 638 may have the form of a quick release fitting, identified as catch 640 and strapping 642. Securement 638 is movable from an engaged to a disengaged position, and, in the disengaged position may tend to discourage the lid portion namely top panel 572, from being dislodged or opened. The engagement of the male and female plug and socket portions, and the securement fittings may be free of tracked fasteners—i.e., they are zipperless. A further secondary or auxiliary wall or housing structure or pouch 644 may be mounted to the outer surface of the top portion 572.

Container assembly 550 has the fundamental construction of a soft sided insulated container, with the addition of an array of stiffening members. The stiffening members are separated by discontinuities in structure along the edges of the stiffeners. In some embodiments, the vertices of the adjacent panels have a degree of float relative to each other, being constrained by the fabric and seaming of the panel members rather than by rigid interconnection to each other. Thus, while the stiffening panels may tend to yield a reinforced soft-sided structure, that structure may tend to be less rigid than an integrally molded hard sided insulated container.

Various embodiments have been described in detail. Since changes in and or additions to the above-described examples may be made without departing from the nature, spirit or scope of the invention, the invention is not to be limited to those details.

The invention claimed is:

1. An insulated container having panels assembled to define a chamber; said insulated container having an opening by which to obtain access to said chamber; portions of said panels being co-operatively assembled to define a periphery of said opening; at least one of said panels including a soft-sided inner covering, a soft-sided outer covering, a flexible layer of thermal insulation and a stiffener member; said stiffener member and said flexible layer of thermal insulation being located between said soft-sided outer covering and said soft-sided inner covering of said at least one of said panels; said insulated container having a closure member movable to an engaged position obstructing said opening; and said stiffener member being located to reinforce said periphery.

2. The insulated container of claim 1 wherein said insulated container is a soft sided insulated container.

3. The insulated container of claim 1 wherein said stiffener member lies outwardly of said flexible layer of thermal insulation.

4. An insulated container having panels assembled to define a chamber;

said insulated container having an opening by which to obtain access to said chamber; portions of said panels being co-operatively assembled to define a periphery of said opening; at least one of said panels including a flexible layer of thermal insulation located between a soft-sided outer covering and a soft-sided inner covering and said insulated container having a closure member movable to an engaged position obstructing said opening; and a batten being located to reinforce said periphery; and said closure member includes a plug, and said plug is insertable into said opening.

5. The insulated container of claim 4 wherein said plug includes a layer of thermal insulation, and said layer of thermal insulation of said plug is substantially thicker than said layer of insulation of said one of said panels.

6. The insulated container of claim 4 wherein said closure member has a peripheral land extending about said plug; said peripheral land has a width, said plug has a depth, and the depth of said plug is greater than the width of said peripheral land.

7. The insulated container of claim 4 wherein said plug has a depth and said batten has a width greater than said depth of said plug.

8. The insulated container of claim 7 wherein said width of said batten is greater than double said depth of said plug.

9. The insulated container of claim 1 wherein said stiffener members are battens, and said panels having battens therein are arranged to form a reinforced periphery extending substantially entirely about said opening.

10. The insulated container of claim 1 wherein one of said panels has a pair of said stiffener members, said stiffener members are battens, and said battens are foldably moveable relative to each other to permit said one of said panels panel to be folded.

11. The insulated container of claim 1 wherein said closure member includes a closure securement operable to retain said closure member in a closed position, and said closure securement is not a tracked fastener.

12. A soft-sided insulated container having a plurality of panels assembled to define an internal chamber, said panels including an inner membrane, an outer membrane a flexible layer of insulation and a batten both being contained between said inner and outer membranes, and a surround member, said surround member having an opening allowing access to said internal chamber, and said surround member including a stiffener layer extending peripherally about said opening, said insulated container including a lid movable between an open position permitting access to said internal chamber, and a closed position obstructing said opening.

13. The insulated container of claim 12 wherein said stiffener layer of said surround member is mounted on an arcuate profile.

14. The insulated container of claim 13 wherein said lid includes a shoulder formed to seat on said arcuate profile of said surround member.

15. The insulated container of claim 12 wherein said lid has a plug insertable in said opening.

16. The insulated container of claim 15 wherein said plug is elastically deformable.

17. The insulated container of claim 16 wherein said plug includes a foam portion.

18. An insulated container having a plurality of panels assembled to define an internal chamber;

said plurality of panels including a bottom panel, a top panel, a front panel, a back panel, a first end panel and a second end panel, said panels being co-operatively connected to have the general form of a six sided box, each of said top, bottom, front and back panels is a soft sided insulated panel including a layer of insulation and a batten contained between inner and outer membranes;

said top panel has a surround member defined therein, said surround member having an opening allowing access to said internal chamber, and said surround member including a stiffener layer extending peripherally about said opening;

said front panel and said back panel each having four edges, of which one respective edge of each is an upper edge at which said top panel mates therewith, and each of said respective upper edges has a curved profile, said top panel conforming to said curved profile.

19. An insulated container having a plurality of panels assembled to define an internal chamber;

said plurality of panels includes a bottom panel, a top panel, a front panel, a back panel, a first end panel and a second end panel, said panels being co-operatively connected to have the general form of a six sided box, each of said top, bottom, front and back panels is a soft sided insulated panel including a layer of insulation and a batten contained between inner and outer membranes;

said top panel has a surround member defined therein, said surround member having an opening allowing access to said internal chamber, and said surround member including a stiffener layer extending peripherally about said opening;

said bottom panel having first and second edges trimmed on respective arcs, said front and back panels having a flexed arcuate shape conforming to said arcs.

20. An insulated container having panels assembled to define a chamber;

said insulated container having an opening by which to obtain access to said chamber;

at least one of said panels including a layer of thermal insulation and a batten;

said insulated container having a closure member movable to an engaged position obstructing said opening;

said panels of said insulated container include a bottom panel, an upstanding wall panel, and a top panel, said bottom, upstanding wall and top panels being soft-sided insulated panels;

said top panel has said opening formed therein;

said top panel includes a surround formed about said opening; and said batten is a reinforcement of said surround of said top panel, said reinforcement extending peripherally about said opening.

* * * * *